US006397018B1

(12) United States Patent
Matsumoto et al.

(10) Patent No.: US 6,397,018 B1
(45) Date of Patent: May 28, 2002

(54) DEVELOPER AMOUNT DETECTING METHOD, DEVELOPING DEVICE, PROCESS CARTRIDGE AND ELECTROPHOTOGRAPHIC IMAGE FORMING APPARATUS

(75) Inventors: Hideki Matsumoto; Kazushige Sakurai, both of Mishima; Isao Ikemoto, Kashiwa; Kazushi Watanabe, Mishima; Toshiyuki Karakama, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/633,258

(22) Filed: Aug. 4, 2000

(30) Foreign Application Priority Data

Aug. 6, 1999 (JP) ..... 11-223344

(51) Int. Cl.[7] ..... G03G 15/08
(52) U.S. Cl. ..... 399/27; 399/30; 399/61
(58) Field of Search ..... 399/27, 28, 29, 399/30, 58, 61, 62; 118/688, 694; 222/DIG. 1

(56) References Cited

U.S. PATENT DOCUMENTS

| | | | |
|---|---|---|---|
| 5,095,335 | A | 3/1992 | Watanabe et al. |
| 5,151,734 | A | 9/1992 | Tsuda et al. |
| 5,208,634 | A | 5/1993 | Ikemoto et al. |
| 5,223,839 | A | 6/1993 | Ikemoto et al. |
| 5,294,960 | A | 3/1994 | Nomura et al. |
| 5,331,372 | A | 7/1994 | Tsuda et al. |
| 5,345,294 | A | 9/1994 | Nomura et al. |
| 5,404,198 | A | 4/1995 | Noda et al. |
| 5,455,665 | A | 10/1995 | Baba et al. |
| 5,463,446 | A | 10/1995 | Watanabe et al. |
| 5,465,136 | A | 11/1995 | Watanabe |
| 5,470,635 | A | 11/1995 | Shirai et al. ..... 428/131 |
| 5,475,470 | A | 12/1995 | Sasago et al. |
| 5,475,471 | A | 12/1995 | Kisu et al. |
| 5,488,459 | A | 1/1996 | Tsuda et al. |
| 5,500,714 | A | 3/1996 | Yashiro et al. |
| 5,510,878 | A | 4/1996 | Noda et al. |

(List continued on next page.)

*Primary Examiner*—Sophia S. Chen
*Assistant Examiner*—Hoang Ngo
(74) *Attorney, Agent, or Firm*—Fitzpatrick, Cella, Harper & Scinto

(57) ABSTRACT

A developing device includes a developer container which is mountable to an electrophotographic image forming apparatus main body, contains a developer for developing an electrostatic latent image formed on an electrophotographic photosensitive member, and includes a developer bearing member for carrying the developer to the electrophotographic photosensitive member, and a plurality of developer remaining amount detectors for successively detecting the remaining amount of developer within the developer container, wherein regions detected by the plurality of developer remaining amount detectors are overlapped with each other, and in the overlapped regions, a detected value by a previous developer remaining amount detector is changed over to a detected value by a succeeding developer remaining amount detector, and the apparatus main body detects the detected value to detect the remaining amount of developer.

95 Claims, 50 Drawing Sheets

U.S. PATENT DOCUMENTS 5,534,344 A 7/1996 Kisu et al. ..... 428/323
5,541,711 A 7/1996 Kisu et al.
5,543,898 A 8/1996 Shishido et al.
5,561,504 A 10/1996 Watanabe et al.
5,581,325 A 12/1996 Tsuda et al.
5,583,613 A 12/1996 Kobayashi et al.
5,585,895 A 12/1996 Yashiro et al.
5,602,623 A 2/1997 Nishibata et al. ..... 399/111
5,608,509 A 3/1997 Shirai et al. ..... 399/351
5,617,579 A 4/1997 Yashiro et al. ..... 399/111
5,623,328 A 4/1997 Tsuda et al. ..... 399/111
5,640,650 A 6/1997 Watanabe et al. ..... 399/117
5,659,847 A 8/1997 Tsuda et al. ..... 399/113
5,669,042 A 9/1997 Kobayashi et al. ..... 399/111
5,689,774 A 11/1997 Shishido et al. ..... 399/111
5,740,499 A 4/1998 Higeta et al. ..... 399/105
5,749,027 A 5/1998 Ikemoto et al. ..... 399/113
5,765,077 A 6/1998 Sakurai et al. ..... 399/176
5,768,658 A 6/1998 Watanabe et al. ..... 399/111
5,768,660 A 6/1998 Kurihara et al. ..... 399/111
5,774,766 A 6/1998 Karakama et al. ..... 399/111
5,790,923 A 8/1998 Oguma et al. ..... 399/106
5,794,101 A 8/1998 Watanabe et al. ..... 399/103
5,809,374 A 9/1998 Tsuda et al. ..... 399/111
5,812,909 A 9/1998 Oguma et al. ..... 399/103
5,828,928 A 10/1998 Sasago et al. ..... 399/111
5,864,731 A 1/1999 Ikemoto et al. ..... 399/27
5,878,304 A 3/1999 Watanabe et al. ..... 399/92
5,878,310 A 3/1999 Noda et al. ..... 399/117
5,884,124 A 3/1999 Karakama et al. ..... 399/123
5,890,036 A 3/1999 Karakuma et al. ..... 399/119
5,899,602 A 5/1999 Noda et al. ..... 399/111
5,903,803 A 5/1999 Kawai et al. ..... 399/116
5,920,752 A 7/1999 Karakama et al. ..... 399/111
5,937,237 A 8/1999 Nonaka et al. ..... 399/106
5,937,242 A 8/1999 Yokoyama et al. ..... 399/114
5,943,528 A 8/1999 Akutsu et al. ..... 399/110
5,966,566 A 10/1999 Odagawa et al. ..... 399/109
5,966,568 A 10/1999 Numagami et al. ..... 399/111
5,987,269 A * 11/1999 Allen et al. ..... 399/27
6,006,058 A 12/1999 Watanabe et al. ..... 399/167
6,016,413 A 1/2000 Yokoyama et al. ..... 399/113
6,029,032 A 2/2000 Watanabe et al. ..... 399/111
6,032,007 A 2/2000 Yamaji et al. ..... 399/104
6,058,278 A 5/2000 Tsuda et al. ..... 399/106
6,070,028 A 5/2000 Odagawa et al. ..... 399/104
6,075,956 A 6/2000 Watanabe et al. ..... 399/92
6,075,957 A 6/2000 Batori et al. ..... 399/114
6,097,908 A 8/2000 Uchiyama et al. ..... 399/111
6,097,909 A 8/2000 Watanabe et al. ..... 399/111
6,101,348 A 8/2000 Nonaka et al. ..... 399/103
6,101,354 A 8/2000 Nakagawa et al. ..... 399/225
6,118,960 A 9/2000 Nakagawa et al. ..... 399/111
6,208,816 B1 * 3/2001 Koizumi et al. ..... 399/27

* cited by examiner

+

⇩

DEVELOPER AMOUNT DETECTING METHOD, DEVELOPING DEVICE, PROCESS CARTRIDGE AND ELECTROPHOTOGRAPHIC IMAGE FORMING APPARATUS

BACKGROUND OF THE INVENTION

1. Field of the Invention

The present invention relates to a developer amount detecting method, a developing device, a process cartridge and an electrophotographic image forming apparatus.

In the present specification, the electrophotographic image forming apparatus is directed to, for example, an electrophotographic copying machine, an electrophotographic printer such as an LED printer or a laser beam printer, an electrophotographic facsimile machine and an electrophotographic word processor.

The process cartridge makes at least one of charging means, developing means and cleaning means and an electrophotographic photosensitive member integrally into a cartridge which is detachably mountable to a main body of the electrophotographic image forming apparatus, or makes at least the developing means and the electrophotographic photosensitive member integrally into a cartridge which is detachably mountable to a main body of the electrophotographic image forming apparatus.

2. Related Background Art

Up to now, in an image forming apparatus using an electrophotographic image forming process, there has been applied a process cartridge system which makes the electrophotographic photosensitive member and process means that operates on the electrophotographic photosensitive member into a cartridge which is detachably mountable to a main body of the electrophotographic image forming apparatus. The process cartridge system can remarkably be improved in the operability since the maintenance of the apparatus can be conducted by a user per se not depending on a service man. For that reason, the process cartridge system has been widely employed in the electrophotographic image forming apparatus.

In the electrophotographic image forming apparatus of the above process cartridge system, a user replaces the cartridge mounted on the apparatus by a fresh one. Therefore, it is a great convenience to provide the electrophotographic image forming apparatus with a function of informing the user that a developer within the process cartridge is completely depleted.

FIG. 54 shows an example of a conventional image forming apparatus A on which a process cartridge B is mounted. A developing device 9, which constitutes developing means by a process cartridge B. includes a developing chamber 9A that supplies a developer T to a latent image formed on a photosensitive drum 7 and visualizes the latent image and a developer container 11A that contains the developer T therein. The developer T within the developer container 11A is fed to the developing chamber 9A by gravity and an agitating device 9*e* or other developer feeding means.

In the developing chamber 9A, a developing roller 9*a,* which serves as a cylindrical developer bearing member for feeding the developer T up to a developing position opposite to the photosensitive drum 7, is disposed in the vicinity of the photosensitive drum 7. The developer T is attracted and held on the surface of the developing roller 9*a,* and the developer T is fed up to the developing position opposite to the photosensitive drum 7 due to the rotation of the developing roller 9*a*.

The amount and height of the developer T are regulated and uniformly coated on the developing roller 9*a* by developer regulating means 9*d* such as a doctor blade while the developer T is being fed.

The developer T is rubbed by the developing roller 9*a,* the developer regulating means 9*d* or the developer T per se so as to be electrically charged during a process where the developer T is fed onto the developing roller 9*a*.

Then, the developer T which has been fed to a portion of the developing roller 9*a* opposite to the photosensitive drum 7, that is, to a developing position by the developing roller 9*a* is transferred onto the photosensitive drum 7 due to an appropriate developing bias voltage applied between the photosensitive drum 7 and the developing roller 9*a* by a developing bias power supply 54 which serves as bias applying means, and an electrostatic latent image on the photosensitive drum 7 is then developed to form a toner image.

The developer T, which has not been used for development, is fed while it remains on the developing roller 9*a,* and then permitted to be again contained in the developing portion.

On the other hand, a recording medium 2 set in a sheet feed cassette 3*a* is conveyed to a transfer position by a pickup roller 3*b,* a pair of conveying rollers, a registration roller (not shown) and so on in synchronism with the formation of the toner image. A transfer roller 4 is disposed as transfer means at the transfer position, and the toner image on the photosensitive drum 7 is transferred onto the recording medium 2 by application of a voltage.

The recording medium 2 onto which the toner image has been transferred is conveyed to fixing means 5. The fixing means 5 includes a fixing roller 5*b* having a heater 5*a* therein and a driving roller 5*c,* and applies heat and pressure to the recording medium 2, which is passing through the fixing roller 5*b* to fix the transferred toner image onto the recording medium 2. Thereafter, the recording medium 2 is discharged to the outside of the apparatus.

The photosensitive drum 7 from which the toner image has been transferred onto the recording medium 2 by the transfer roller 4 is subjected to a succeeding image forming process after the developer remaining on the photosensitive drum 7 has been removed by cleaning means 10. The cleaning means 10 scrapes off the residual developer on the photosensitive drum 7 by an elastic cleaning blade 10*a* disposed so as to be abutted against the photosensitive drum 7 and collects the residual developer thus scrapped off into a waste developer reservoir 10*b*.

As described above, in the developing device 10, the developer T is depleted every time the developing operation is repeated. And if there is a shortage of developer, there may occur a defect such as a deterioration of the image density or a lack of the image. For that reason, it is necessary to monitor the presence/absence of the developer T in the developing chamber 9A and the develop container 11A so as to prevent the shortage of the developer T.

Under the above circumstances, the conventional developing device 9 includes a developer amount detecting device as means for detecting the residual amount of the developer. The developer amount detecting device includes a bar-shaped antenna electrode 35 for detection of the residual amount of the developer which is disposed horizontally in the interior of the developing chamber 9A as a member for the electrode to detect the residual amount of the developer T.

The developer amount detecting device further includes a developer amount measuring circuit 50. The developer amount measuring circuit 50 is equipped with a capacitance detecting circuit 52 as means for measuring a capacitance between the antenna electrode 35 and the developing roller 9*a*. The capacitance detecting circuit 52 is connected with the antenna electrode 35. With this structure, the developing bias voltage which is applied to the developing roller 9*a* by the developing bias power supply 54 is detected by the antenna electrode 35 to measure the capacitance between antenna electrode 35 and the developing roller 9*a*.

The developer amount measuring circuit 50 also includes a reference capacitance 53 as means for setting a capacitance which is a reference for comparison and a capacitance detecting circuit 51 as means for measuring the reference capacitance 53. The reference capacitance 53 and the developing bias power supply 54 are connected to each other, and the developing bias voltage is detected through the reference capacitance 53, to thereby obtain the capacitance which is a reference in measurement of a unknown capacitance.

The developer amount detecting device compares an output of the capacitance detecting circuit 51 with an output of the capacitance detecting circuit 52 for the reference capacitance by a comparing circuit 55 serving as comparing means to detect a difference therebetween. Then, the developer amount detecting device judges the developer amount as the depletion of developer T by a developer amount warning circuit 57 and notifies the user that the amount developer T is small if the difference is lower than a given value.

The above system is mainly employed in a small-sized image forming apparatus on which the process cartridge is mounted since the system is simple in structure and inexpensive.

However, as described above, in the conventional image forming apparatus, the antenna electrode 35 is disposed within the developing chamber 9A. Therefore, this detecting method can detect a time immediately when the developer is completely depleted with a high accuracy (near-end detection). However, the amount of developer could not be successively detected.

The conventional developer amount detecting device is so designed as to detect the presence/absence of the developer within the developer container. That is, the conventional developer amount detecting device can merely detect that the amount of developer is small immediately before the developer within the developer container has been completely depleted. In other words, the device could not detect the remaining amount of developer within the developer container.

On the other hand, if the remaining amount of developer within the developer container can be successively detected, the user can be informed of the developer depleted state within the developer container so that the user can prepare a fresh process cartridge at a replacing timing. This is very convenient for the user.

In order to solve the above problem, there has been proposed a developer remaining amount detecting method based on a pixel counting system in which the depleted amount of developer is calculated in accordance with the number of dots drawn by a laser. However, in this method, the depleted amount of developer to be detected is different between a graphic pattern and a text pattern. For that reason, in the case where the lifetime of the process cartridge is short, so that, for example, it can print 3000 to 5000 sheets, the method is effective because the error in calculation is small. However, in the case where the lifetime of the cartridge is such that it can print 10000 sheets or more, it is presumed that the error in calculation becomes large in the latter half of its lifetime because of the difference in the depleted amount of developer due to the pattern.

FIG. 55 shows a state in which the developer is borne on the text pattern and the graphic pattern (solid image) as a schematic diagram showing the depleted amount of toner. This figure shows that the depleted amount of developer (toner) per one dot in the text pattern is more than that in the graphic pattern. FIG. 56 shows how the developer is decreased in the case where only the text pattern and only the graphic pattern are printed on 10000 sheets, respectively. It is understood from the figure that an error in calculation with respect to the pattern of the pixel count system is about ±10% in a lifetime of 10000 sheets printed by the process cartridge, which is filled with toner of 500 g. That is, in the larger-capacity process cartridge, an improvement is further required to successively and accurately detect the remaining amount of developer.

Under the above circumstances, the present inventors have found out that the provision of a plurality of developer remaining amount detecting means is effective to detect the developer remaining amount with a higher accuracy, and have proposed a developing device, a process cartridge and an electrophotographic image forming device to which a successively remaining amount detecting system having a plurality of developer remaining amount detecting means for successively detecting the developer remaining amount within the developer container is applied.

However, as a result of conducting a large number of studies and experiments by the present inventors, it has been found that there is a case in which an indicated result for the user is different, depending on the weight given to the output value of detecting means among a plurality of detecting means, even if the remaining amount of developer is successively detected by the provision of at least two developer remaining detecting means as described above. For that reason, in the case of using a plurality of developer remaining amount detecting means, in order to exhibit a more preferable successive remaining amount detecting result for the user, it is necessary to determine which value among a plurality of output values should be employed at what rate in advance.

The present invention has been made on the basis of the novel views of the present inventors, and is therefore directed to a further improvement in a developing device, a process cartridge and an electrophotographic image forming apparatus, each having a plurality of developer remaining amount detecting means for successively detecting a developer remaining amount within a developer container.

SUMMARY OF THE INVENTION

An object of the present invention is to provide a developer amount detecting method, a developing device, a process cartridge and an electrophotographic image forming apparatus which are capable of successively detecting the amount of developer.

Another object of the present invention is to provide a developer amount detecting method, a developing device, a process cartridge and an electrophotographic image forming apparatus which are capable of detecting the amount of developer with accuracy.

Still another object of the present invention is to provide a developer amount detecting method, a developing device, a process cartridge and an electrophotographic image forming apparatus which are capable of properly informing a user of the amount of developer.

Yet still another object of the present invention is to provide a developer amount detecting method, a developing device, a process cartridge and an electrophotographic image forming apparatus. each having a plurality of developer remaining amount detecting means for successively detecting a developer remaining amount within a developer container in which the developer remaining amounts, detectable by the respective developer remaining amount detecting means, overlap each other, and values detected by the respective developer remaining amount detecting means are weighted, respectively.

Yet still another object of the present invention is to provide a developer amount detecting method, a developing device, a process cartridge and an electrophotographic image forming apparatus which are capable of indicating a developer remaining amount more preferably for a user by shifting from a detected value of a first developer remaining amount detecting means to a detected value of a second developer remaining amount detecting means on the basis of a relation between regions detectable by the plurality of developer remaining amount detecting means and an error in detection in an appropriate method.

Yet still another object of the present invention is to provide a developer amount detecting method, a developing device, a process cartridge and an electrophotographic image forming apparatus that are capable of using a developer without adversely affecting an image, without troubling a user, and without any uselessness.

Yet still another object of the present invention is to provide a developer amount detecting method, a developing device, a process cartridge and an electrophotographic image forming apparatus that are inexpensive, each having a developer amount detecting device with a simple structure that is capable of detecting a developer full state to a near-end state, which is immediately before printing becomes defective, even if the developing device or the process cartridge has a long lifetime, with high accuracy and with high precision, and that are capable of further improved convenience when the user employs the device.

Yet still another object of the present invention is to provide a developer amount detecting method, a developing device, a process cartridge and an electrophotographic image forming apparatus that are inexpensive, each having a developer amount detecting device that is capable of monitoring a depleted state of the developer with accuracy and determining a replacement timing of the developing device or the process cartridge with accuracy even if a plurality of users employ the device or a large-scale print job is conducted, and that are capable of further improved convenience when the user employs the device.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Hereinafter, a description will be given in more detail of a developing device, a process cartridge and an electrophotographic image forming apparatus in accordance with the present invention with reference to the accompanying drawings.

(First Embodiment)

First, an electrophotographic image forming apparatus on which a process cartridge is mountable in accordance with an embodiment of the present invention will be described with reference to FIGS. 1 to 3. In this embodiment, the electrophotographic image forming apparatus is formed of an electrophotographic laser beam printer A which is so adapted as to form an image on a recording medium such as a recording paper, an OHP sheet or a cloth through an electrophotographic image forming process.

Figure 1:
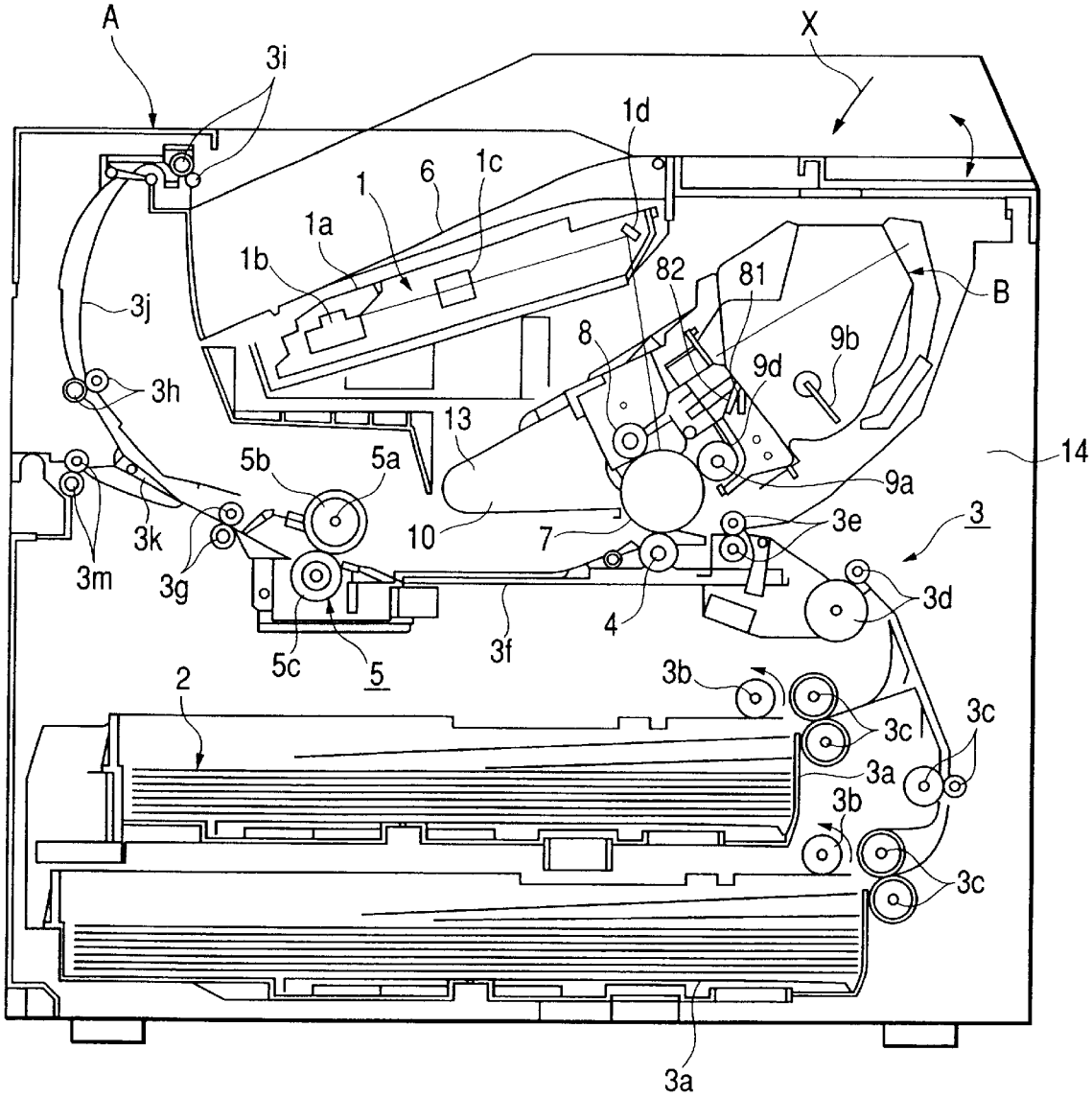
FIG. 1 is a schematic structural diagram showing an electrophotographic image forming apparatus in accordance with an embodiment of the present invention.
Figure 2:
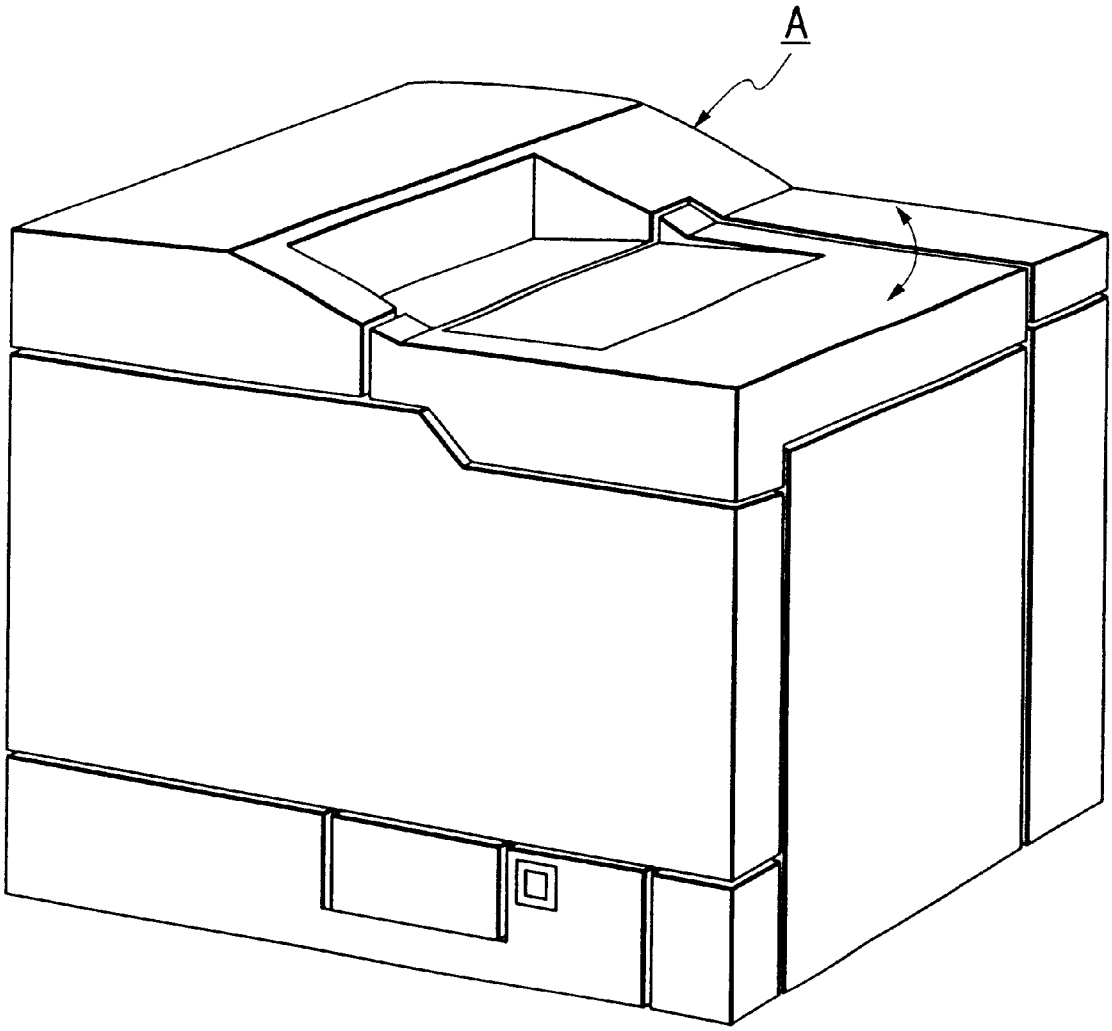
FIG. 2 is a perspective view showing the appearance of an electrophotographic image forming apparatus in accordance with the present invention.
Figure 54:
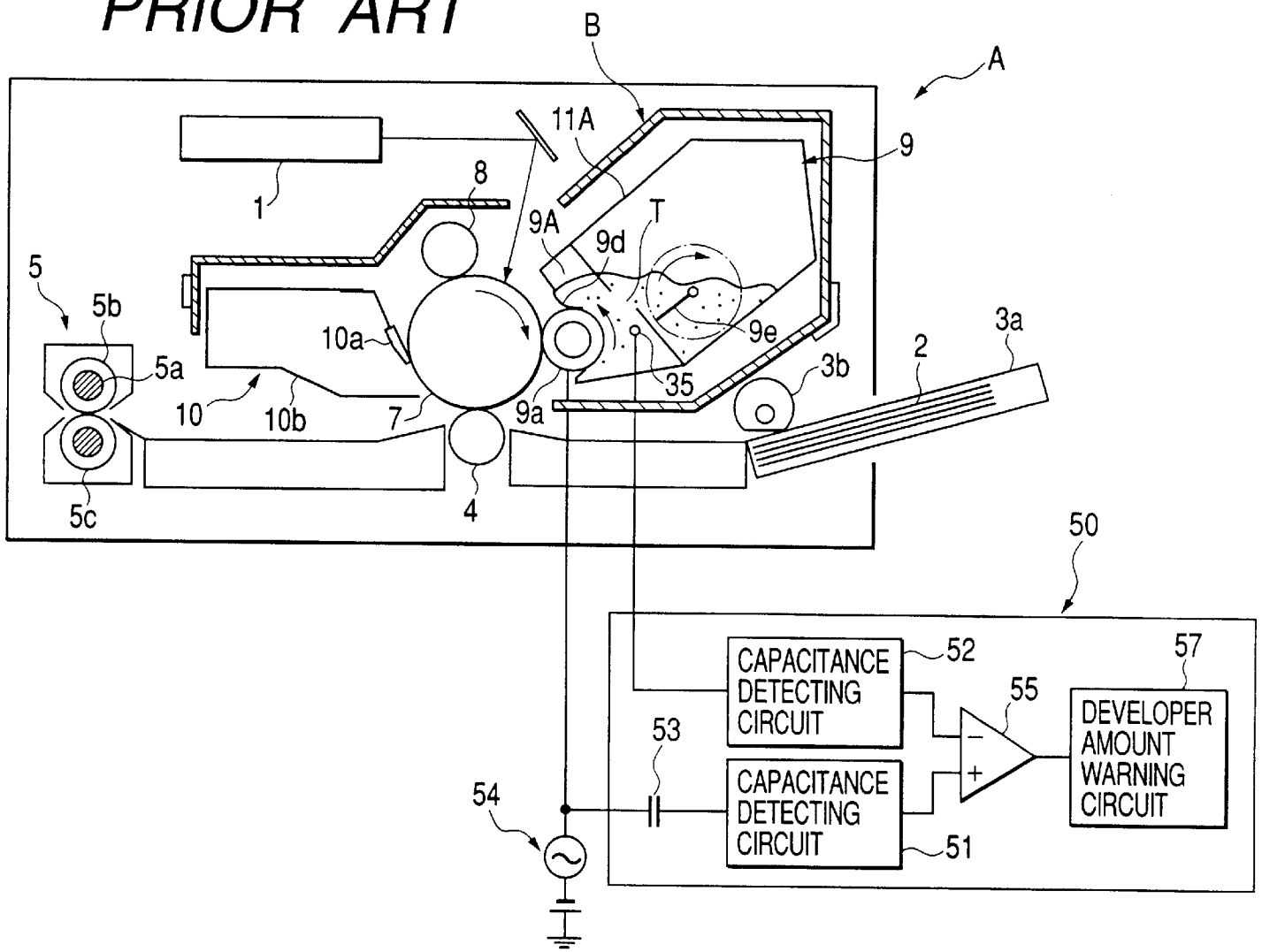
FIG. 54 PRIOR ART
FIG. 54 is a schematic structural diagram showing an example of an electrophotographic image forming apparatus.
Figure 55:
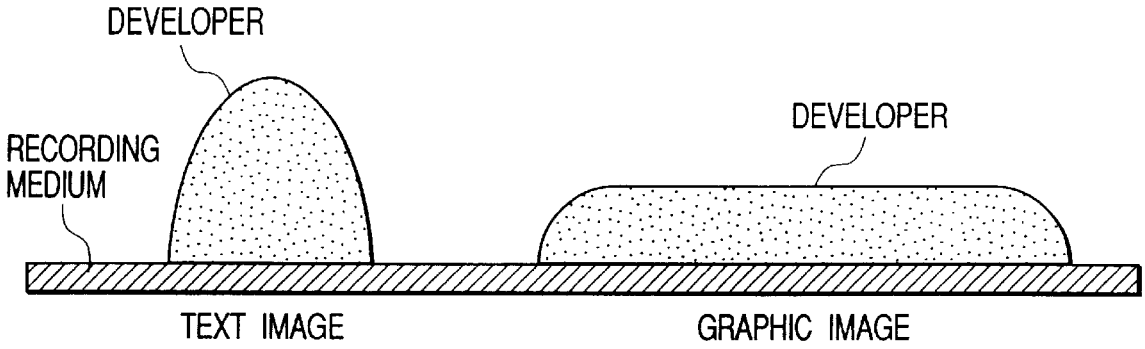
FIG. 55 PRIOR ART
FIG. 55 is a diagram showing a difference in the bearing amount of a developer between a text image and a graphic image.
Figure 56:
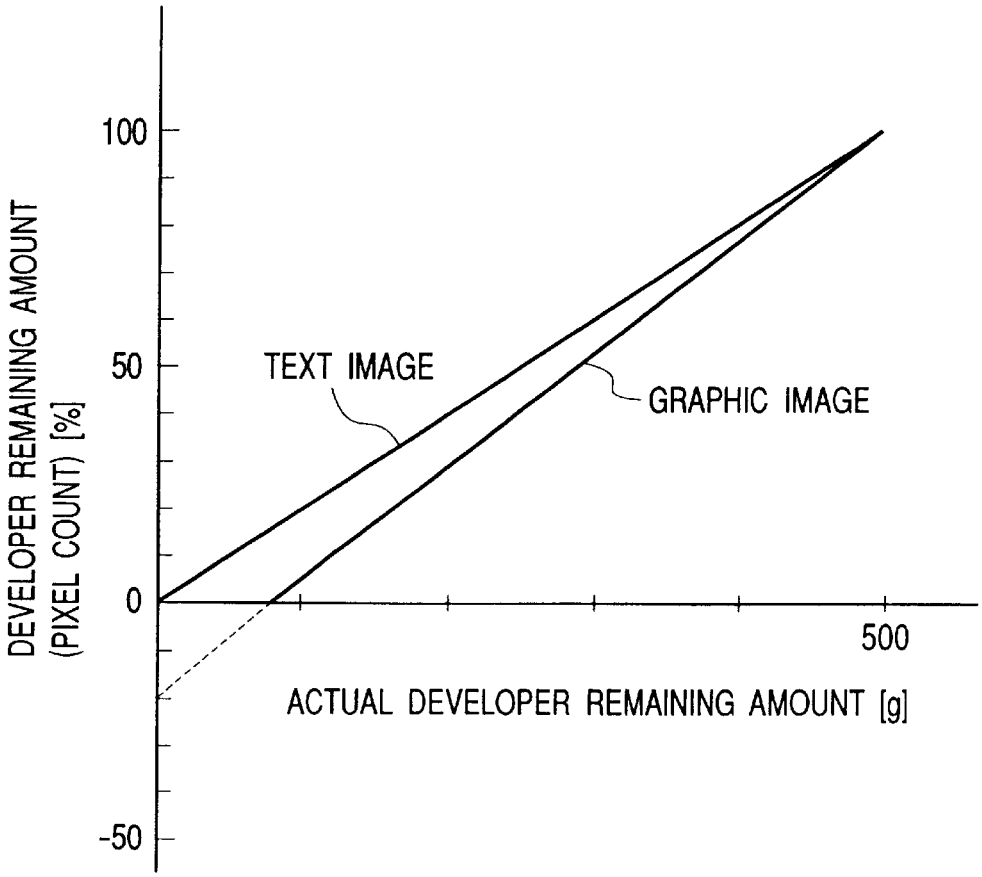
FIG. 56 PRIOR ART
FIG. 56 is a diagram showing a developer depleted state of the text image and the graphic image in a conventional pixel count system.

FIG. 1 shows a schematic diagram of a laser beam printer. In this embodiment, a laser beam printer A is identical in the entire structure with the laser beam printer A described in the above with reference to FIG. 54, and includes a drum-shaped electrophotographic photosensitive member, that is, a photosensitive drum 7. The photosensitive drum 7 is electrically charged by a charging roller 8 which functions as charging means, and a laser beam then irradiates the photosensitive drum 7 from optical means 1 having a laser diode 1*a,* a polygon mirror 1*b,* a lens 1*c,* and a reflecting mirror 1*d* in response to image information, to thereby form a latent image corresponding to the image information on the photosensitive drum 7. The latent image is developed by a developing device 9 to form a visible image, that is, a toner image.

That is, the developing device 9 is equipped with a developing chamber 9A which includes a developing roller 9*a* that functions as a developer bearing member. A developer contained in the developer container 11A, which functions as a developer containing portion that is so formed as to be adjacent to the developing chamber 9A, is fed to the developing roller 9*a* of the developing chamber 9A by rotation of a developer feeding member 9*b.* The developing chamber 9A is equipped with an developer agitating device 9*e* in the vicinity of the developing roller 9*a* to circulate the developer within the developing chamber. Also, the developing roller 9*a* includes a stationary magnet 9*c* therein, and the developer is carried by rotation of the developing roller 9*a*. Then, the developer is given triboelectrication charges and formed into a developer layer having a predetermined thickness by a developing blade 9*d.* Thereafter, the developer is supplied to a developing region of the photosensitive drum 7. The developer supplied to the developing region is translated into a latent image on the photosensitive drum 7, thus forming a toner image. The developing roller 9*a* is connected to a developing bias circuit so that a developing bias voltage resulting from superimposing a d.c. voltage on an a.c. voltage is normally applied to the developing roller 9*a*.

On the other hand, a recording medium 2 set in a sheet feeding cassette 3*a* is conveyed to a transfer position by a pickup roller 3*b,* pairs of conveying rollers 3*c,* 3*d,* and a pair of registration rollers 3*e* in synchronism with the formation of the toner image. A transfer roller 4 is disposed as transfer means at the transfer position, and the toner image on the photosensitive drum 7 is transferred onto the recording medium 2.

The recording medium 2 onto which the toner image has been transferred is conveyed to fixing means 5 by a conveying guide 3*f.* The fixing means 5 includes a fixing roller 5*b* having a heater 5*a* therein and a driving roller 5*c,* which applies heat and pressure to the recording medium 2 that is passing through the fixing roller 5*b* to fix the transferred toner image onto the recording medium 2.

The recording medium 2 is conveyed by pairs of discharge rollers 3*g,* 3*h* and 3*i* and then discharged to a discharge tray 6 through a surface reverse path 3*j.* The discharge tray 6 is disposed on an upper surface of a device body 14 of the laser beam printer A. Alternatively, a swingable flapper 3*k* may be operated so as to discharge the recording medium 2 by a pair of discharge rollers 3*m* not through the surface reverse pa th 3*j.* In this embodiment, the convey ing means is made up of the pickup roller 3*b,* the pairs of conveying rollers 3*c,* 3*d,* and the pair of registration rollers 3*e,* the conveying guide 3*f,* the pairs of discharge rollers 3*g,* 3*h,* 3*i* and the pair of discharge rollers 3*m.*

The photosensitive drum 7 from which the toner image has been transferred onto the recording medium 2 by the transfer roller 4 is subjected to a succeeding image forming process after the developer remaining on the photosensitive drum 7 has been removed by cleaning means 10. The cleaning means 10 scrapes off the residual developer on the photosensitive drum 7 by an elastic cleaning blade 10*a* abutted against the photosensitive drum 7 and collects the residual developer into a waste developer reservoir 10*b.*

Figure 3:
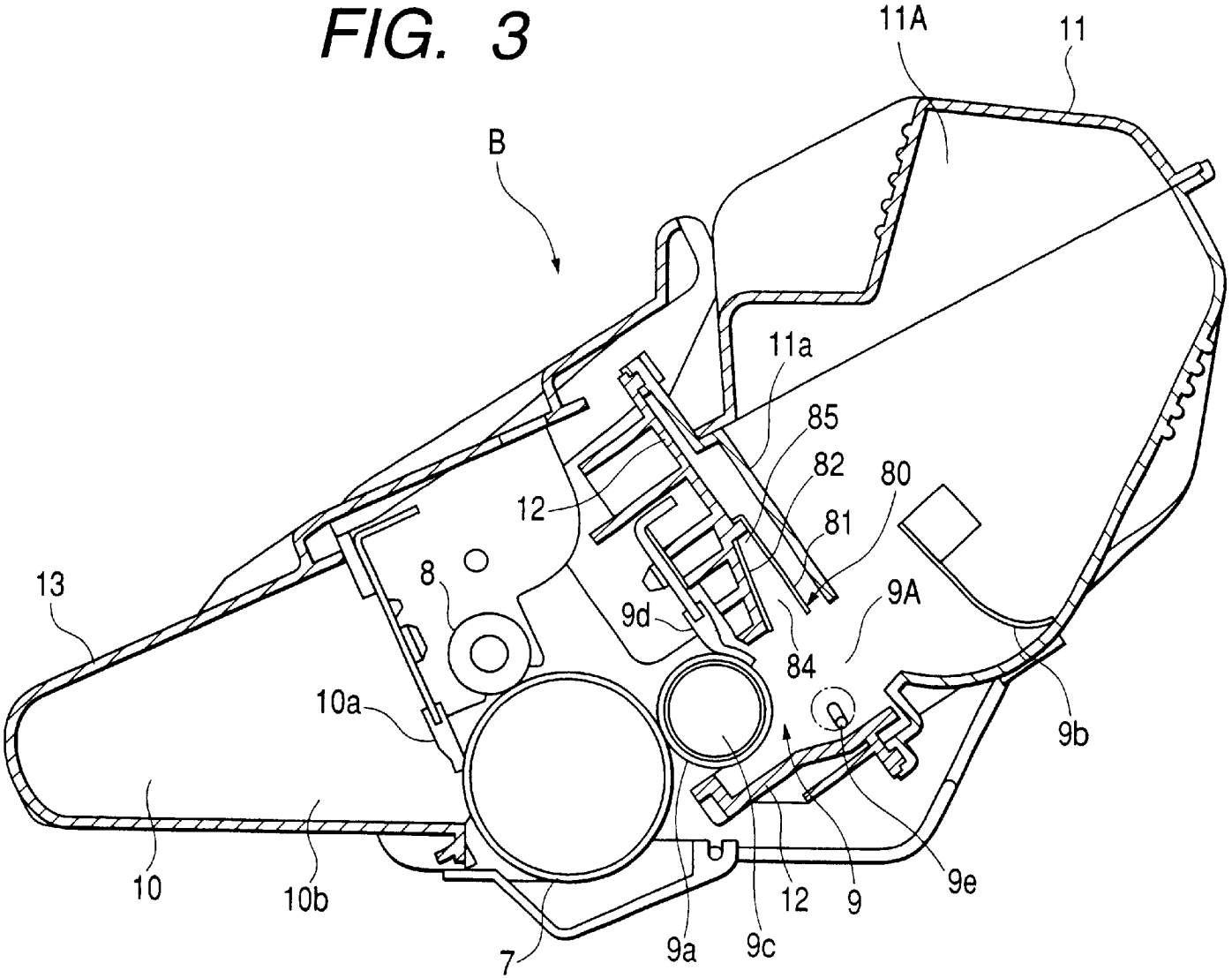
FIG. 3 is a cross-sectional view showing a process cartridge in accordance with an embodiment of the present invention.

On the other hand. in this embodiment, as shown in FIG. 3, a process cartridge B is produced in such a manner that a developer frame 11 having the developer container (developer containing portion) 11A that contains the developer therein and a developer feeding member 9*b* and a developing frame 12 that ho ds the developing means 9, such as the developing roller 9*a* and the developing blade 9*d,* are welded integrally into a developing unit, and a cleaning frame 13 to which the photosensitive drum 7, the cleaning means 10, such as the cleaning blade 10*a,* and the charging roller 8, are fitted, is integrally coupled to the developing unit into a cartridge.

Figure 4:
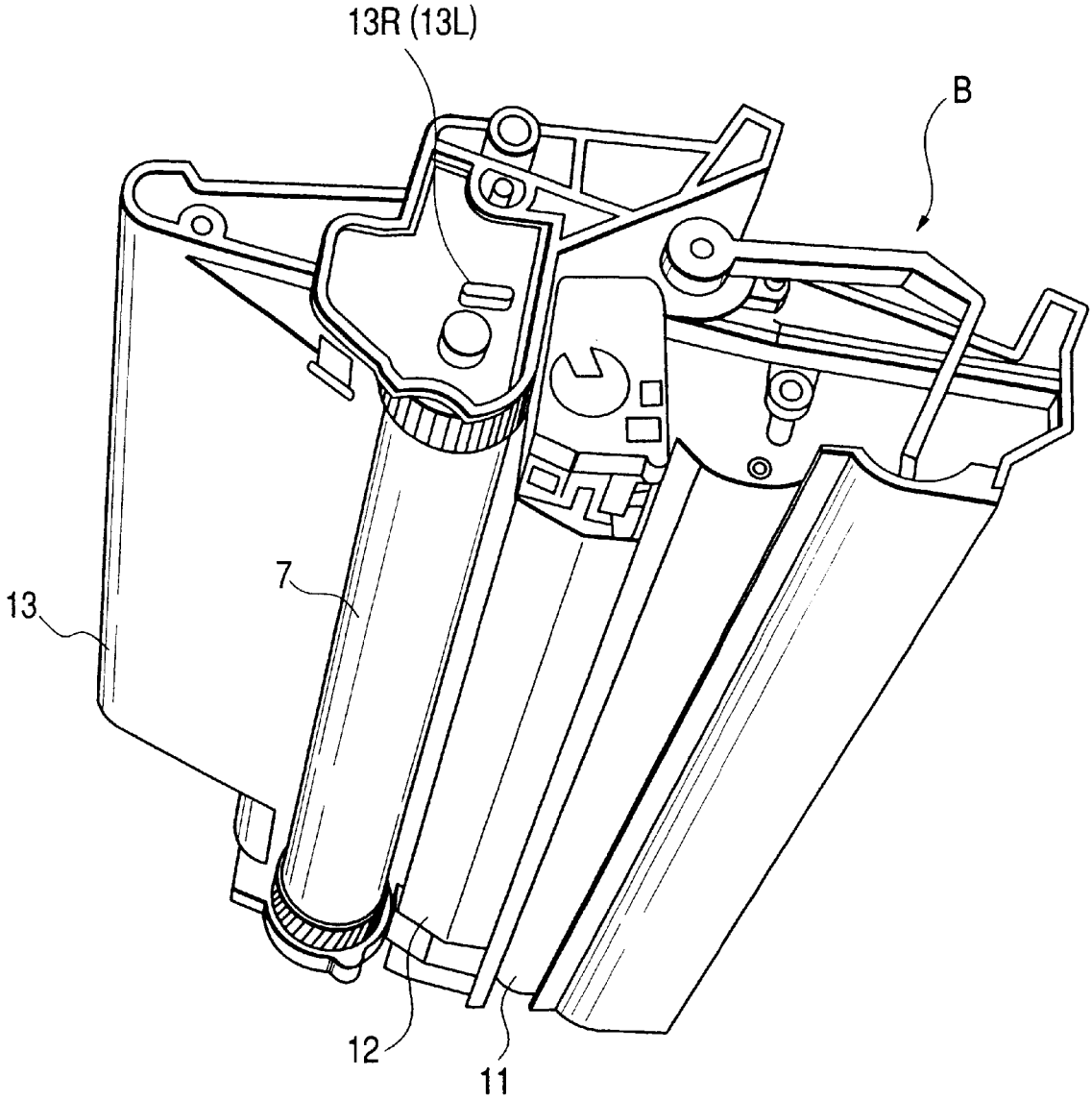
FIG. 4 is a perspective view showing the appearance of the process cartridge viewed from the lower portion.
Figure 5:
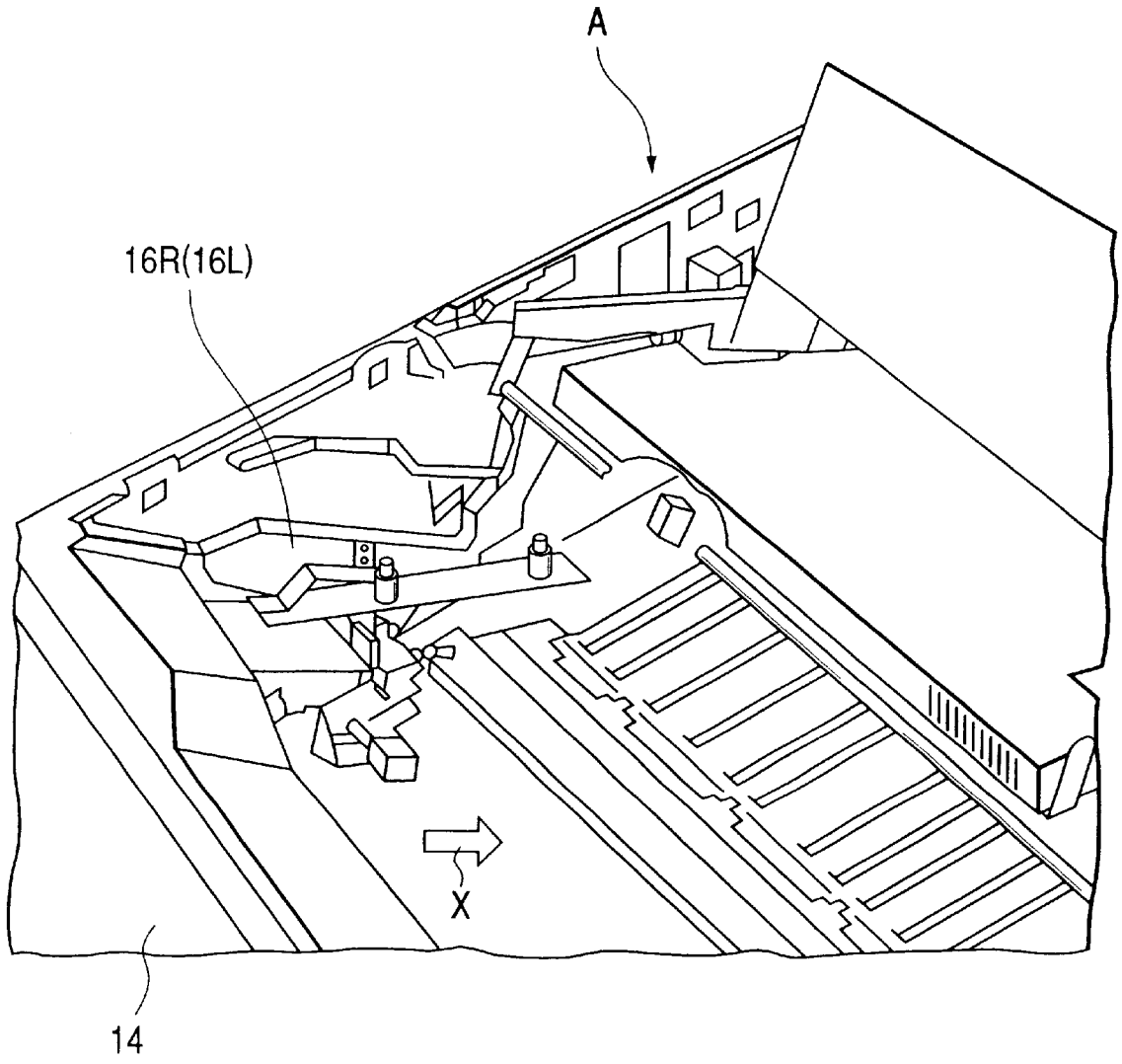
FIG. 5 is a perspective view showing the appearance of a mounting portion of a device body for mounting the process cartridge.

The process cartridge B is detachably mounted on the cartridge mounting means disposed in a main body 14 of the image forming apparatus by a user. According to this embodiment, the cartridge mounting means is made up of guide means 13R (13L) formed on both of outer side surfaces of the process cartridge B as shown in FIG. 4 and a guide portion 16R (16L) (FIG. 5) formed in the main body 14 of the apparatus so that the guide means 13R (13L) is insertable into the guide portion 16R (16L).

According to the present invention, the process cartridge B includes a developer amount detecting device that is capable of successively detecting the remaining amount of developer in accordance with the depletion of the developer within the developer container 11A. According to the present invention, the developer amount detecting device includes a plurality of developer remaining amount detecting means, and in this embodiment, the developer amount detecting device is made up of a first developer remaining amount detecting means and a second developer remaining amount detecting means.

First, the first developer remaining amount detecting means will be described. According to this embodiment, as shown in FIGS. 6A and 6B, the first developer remaining amount detecting means includes a measuring electrode member 20A that detects the amount of developer and a reference electrode member 20B that detects the circumstance, that is, the temperature and the humidity of the atmosphere and acts as a comparing member that outputs a reference signal.

Figure 6A:
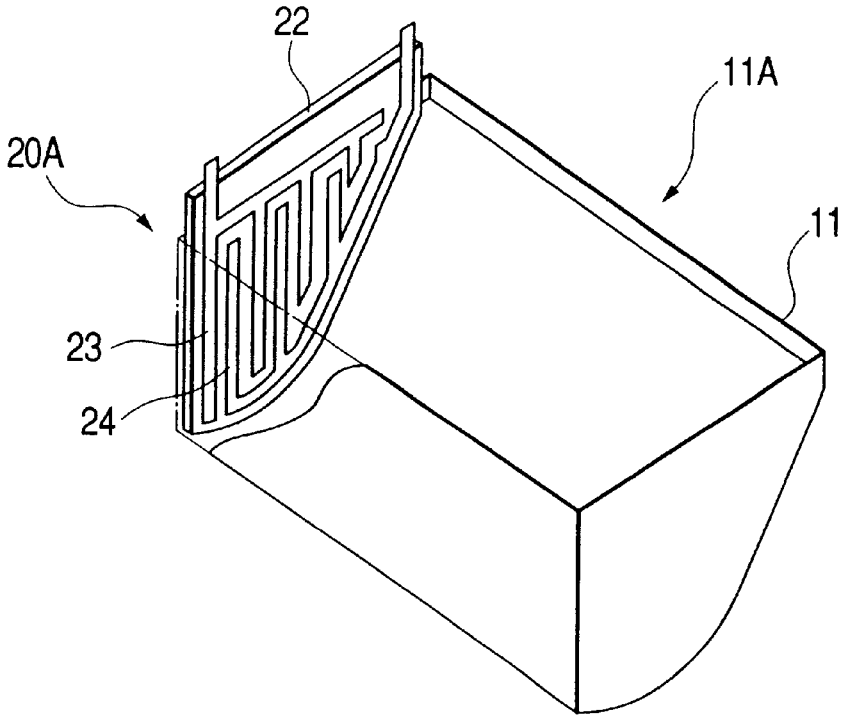
FIGS. 6A and 6B are perspective views showing a developer container, a measuring electrode member and a reference electrode member for explanation of a developer amount detecting device in accordance with the present invention, respectively.
Figure 6B:
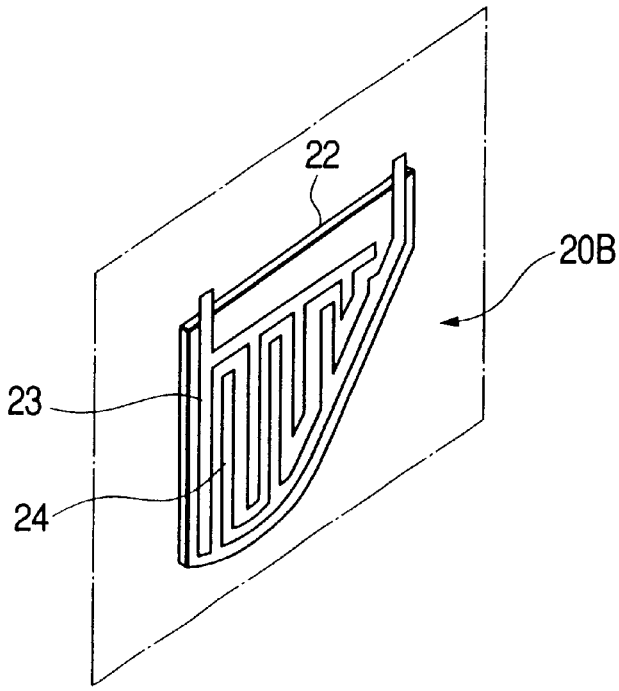
Figure 13:
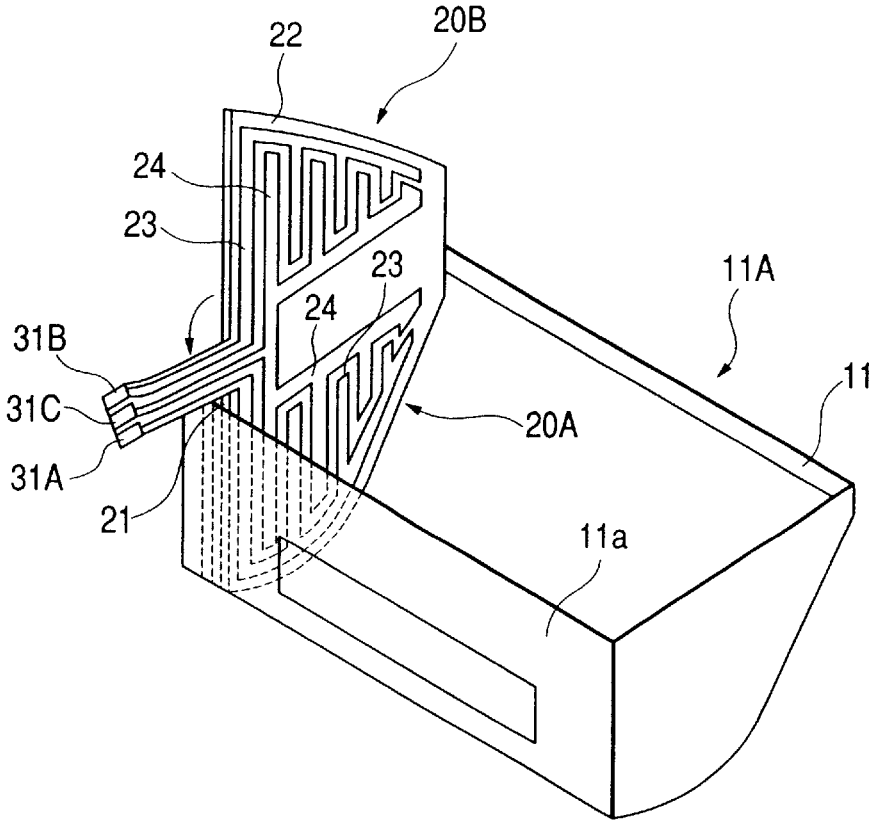
FIG. 13 is a perspective view showing a developer container for explanation of the developer amount detecting device in accordance with an embodiment of the present invention.
Figure 14:
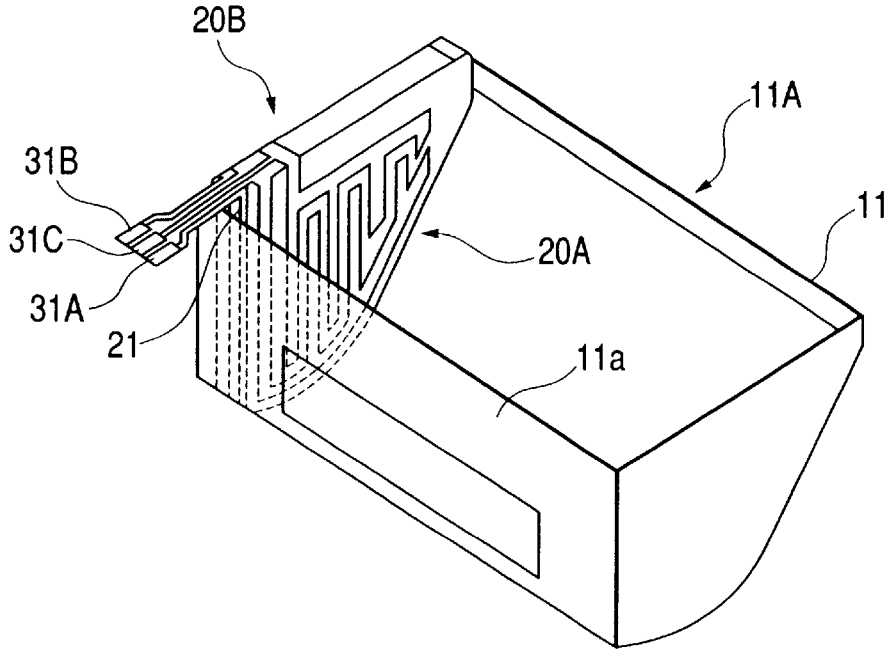
FIG. 14 is a perspective view showing the developer container for explanation of a mode in which the reference electrode member is located within the developer container as in FIG. 13.

For example, as shown in FIG. 6A, the measuring electrode member 20A is disposed at a position which is in contact with the developer on the inner side surface of the developer container 11A of the developing device 9 or the bottom surface of the developer container 11A thereof, and also in a direction along which the contact area with the developer is varied as the developer is reduced. Also, although being described in more detail later, the reference electrode member 20B may be disposed within the developer container at the same side as a side where the measuring electrode member 20A is disposed and also at a portion sectioned by a partition wall 21, which is out of the developer as shown in FIGS. 13 and 14.

Figure 7:
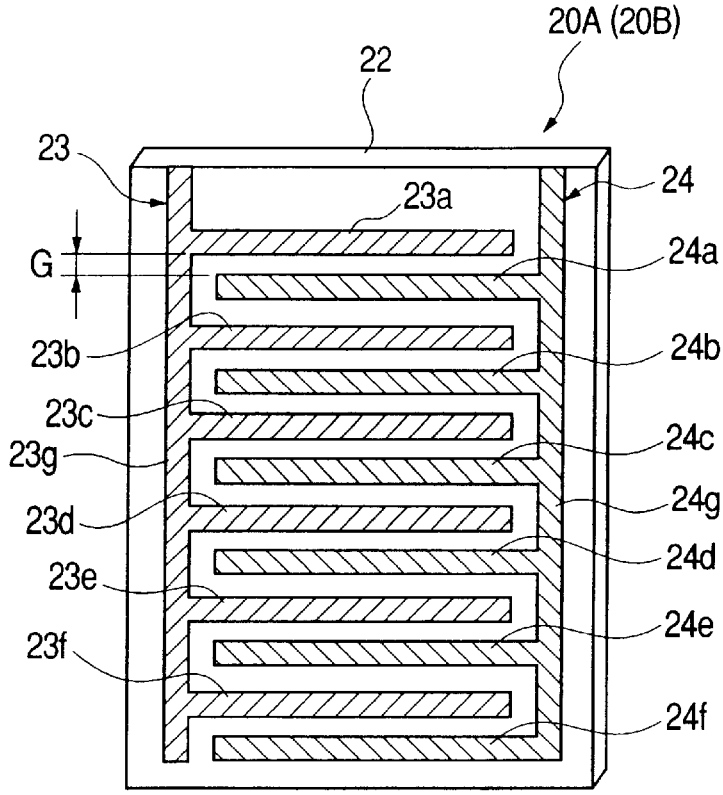
FIG. 7 is a front view showing the measuring electrode member and the reference electrode member in accordance with an embodiment of the present invention.
Figure 8:
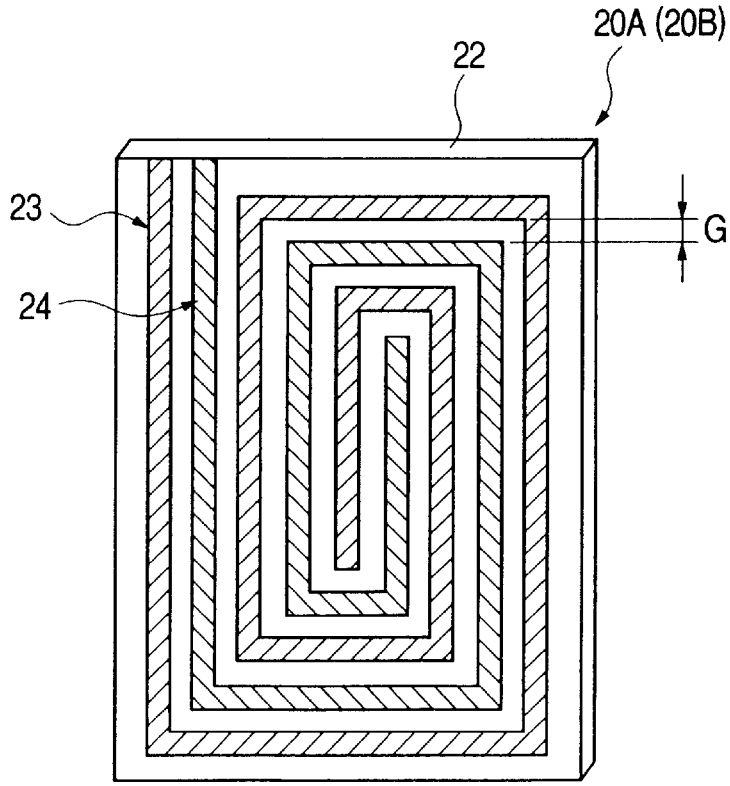
FIG. 8 is a front view showing the measuring electrode member and the reference electrode member in accordance with another embodiment of the present invention.

The measuring electrode member 20A includes a pair of electrodes, that is, an input side electrode 23 and an output side electrode 24, which are formed in parallel with each other on a substrate 22 at a given interval as shown in FIG. 7. In this embodiment, electrodes 23 and 24 have at least a pair of electrode portions 23*a* to 23*f* and 24*a* to 24*f* that are disposed in parallel with each other at a given interval G, and the respective electrode portions 23*a* to 23*f* and 24*a* to 24*f* are connected to each other by connecting electrode portions 23*g* and 24*g*, respectively. Those two electrodes 23 and 24 are made in a large number of concave/convex shapes that are associated with each other. It is needless to say that the electrode pattern of the measuring electrode member 20A is not limited to the above structure, but the electrode pattern may be formed in such a spiral shape that a pair of electrodes 23 and 24 are disposed in parallel with each other at a given interval as shown in FIG. 8.

The measuring electrode member 20A can successively detect the remaining amount of developer within the developer container 11A by measuring the capacitance between the pair of parallel electrodes 23 and 24. In other words, because the developer is larger in dielectric constant than air, the capacitance between the pair of electrodes 23 and 24 increases by bringing the developer in contact with the surface of the measuring electrode member 20A.

Therefore, according to this embodiment, the use of the measuring electrode member 20A with the above structure enables the amount of developer within the developer container 11A to be measured from an area of the developer that is in contact with the surface of the measuring electrode member 20A by the application of a given correction curve regardless of the sectional shape of the developer container 11A or the shape of the measuring electrode member 20A.

The electrode patterns 23 and 24 of the above measuring electrode member 20A can be obtained by forming conducting metal patterns 23 and 24 made of copper or the like on a hard print substrate 22, which is, for example, 0.4 to 1.6 mm in thickness and made of, for example, paper phenol, glass epoxy or the like, or a flexible printed board 22, which is about 0.1 mm in thickness and made of polyester, polyimide or the like through etching or printing. Those electrode patterns 23 and 24 can be manufactured by the-same method as the normal method of forming a wiring pattern on the printed board. Therefore, the electrode patterns 23 and 24 can be readily manufactured even if they are in a complicated electrode pattern shape as shown in FIGS. 7 and 8, and the manufacturing costs are also almost identical with those for a simple pattern.

The use of the complicated pattern shape shown in FIGS. 7 and 8 enables an opposed length between the electrodes 23 and 24, and the application of the pattern forming method, such as etching, enables an interval G between the electrodes 23 and 24 to be narrowed to the degree of about several tens $\mu$m, thereby being capable of obtaining a larger capacitance. Also, the amount of change in capacitance can be increased, thereby being capable of enhancing accuracy in detection. Specifically, the electrodes 23 and 24 are set to 0.1 to 0.5 mm in width and 17.5 to 70 $\mu$m in thickness, and the interval G is set to 0.1 to 0.5 mm. Also, a metal pattern formation surface can be laminated by a thin resin film which is, for example, about 12.5 to 125 $\mu$m in thickness.

As described above, in the developer amount detecting device according to the present invention, a change in the contact area of the developer with respect to the measuring electrode member 20A located in a direction along which the developer on the inner side surface or the inner bottom surface of the developer container 11A is reduced, that is, a change in the capacitance of the measuring electrode member 20A is measured, and the amount of developer of the entire developer container is successively detected in accordance with the measured value.

In other words, because the dielectric coefficient of the developer is larger than that of air, a portion of the measuring electrode member 20A which is in contact with the developer (a portion where the developer exists) is larger in outputted capacitance than a portion of the measuring electrode member 20A which is out of contact with the developer (a portion where no developer exists). Consequently, if a change in the capacitance is measured, the amount of developer within the developer container 11A can be presumed.

According to the present invention, the developer remaining amount detecting device has a reference electrode member 20B having the same structure as that of the measuring electrode member 20A as shown in FIGS. 6A and 6B.

The reference electrode member 20B may be structured in the same manner as that of the above measuring electrode member 20A. As shown in FIG. 7, the reference electrode member 20B includes a pair of an input side electrode 23 (23*a* to 23*f*) and an output side electrode 24 (24*a* to 24*f*) which are formed in parallel with each other on a substrate 22 at a given interval G as shown in FIG. 7, and those two electrodes 23 and 24 may be associated with each other into a large number of concave/convex shapes, or may be formed in a spiral shape as shown in FIG. 8. Similarly, the reference electrode member 20B can be manufactured by the same method as the normal method of forming a wiring pattern on the printed board.

According to this embodiment, as described above, the reference electrode member 20B varies in capacitance depending on the circumstantial conditions such as the temperature and the humidity and functions as a comparing member for reference with respect to the measuring electrode member 20A.

In other words, in the first developer remaining amount detecting means according to this embodiment, an output of the measuring electrode member 20A is compared with an output of the reference electrode member 20B which varies in accordance with the circumstance variable. For example, if a given capacitance of the reference electrode member 20B is set to the same value as that of the measuring electrode member 20A to take a difference between the output of the reference electrode member 20B and the output of the measuring electrode member 20A, an output of only the change in the capacitance due to the developer can be obtained, thereby enhancing the precision in the detection of the developer remaining amount.

The principle of the developer amount detection according to this embodiment will be further described. Since the measuring electrode member 20A measures the capacitance of a contact portion of the pattern surface and presumes the amount of developer within the developer container 11A, the value of the developer amount varies with the circumstance variable (humidity, temperature, etc.).

For example, since the amount of steam in air becomes larger as the humidity increases, the dielectric coefficient of the atmosphere, which is in contact with the detecting member 20A, also increases. For that reason, even when the amount of developer is the same, the output from the measuring electrode member 20A also changes with the circumstance variable. Also, if the substrate 22 on which the pattern is formed is made of a hygroscopic material, because the dielectric coefficient changes due to the hygroscopicity, the circumstance varies.

For that reason, the reference electrode member 20B that functions as the comparing member having the same circumstance variable as the measuring electrode member 20A, that is, for example, the reference electrode member 20B having the same structure as that of the measuring electrode member 20A, which is out of contact with the developer, is located under the same circumstance as those of the measuring electrode member 20A, both outputs of those electrode members 20A and 20B are compared with each other to determine a difference therebetween and cancel the circumstance variable, thereby being capable of measuring the remaining amount of developer without being adversely affected by the circumstance variable.

Figure 9:
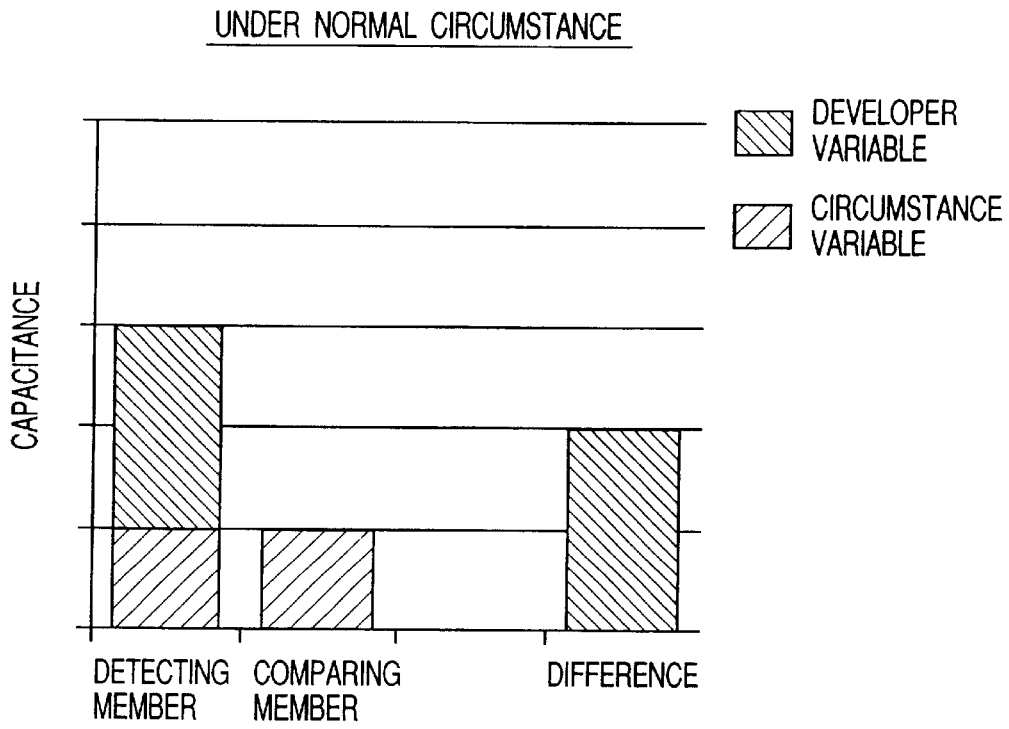
FIG. 9 is a graph for explanation of a developer amount detecting principle in accordance with the present invention.

As shown in a bar graph on the most left side of FIG. 9, the capacitance measured from the measuring electrode member 20A, which is a detecting member that detects the amount of developer, is outputted after the circumstance variable is added to the variable caused by the developer, which is in contact with the surface of the detecting member. Then, the outputted capacitance is shifted to the high-temperature high-humidity circumstances, because the circumstance variable increases, although the variable caused by the developer does not change as shown in the bar graph on the most left bar graph of FIG. 10, and the capacitance is thereby caused to increase regardless of the same amount of developer.

Figure 10:
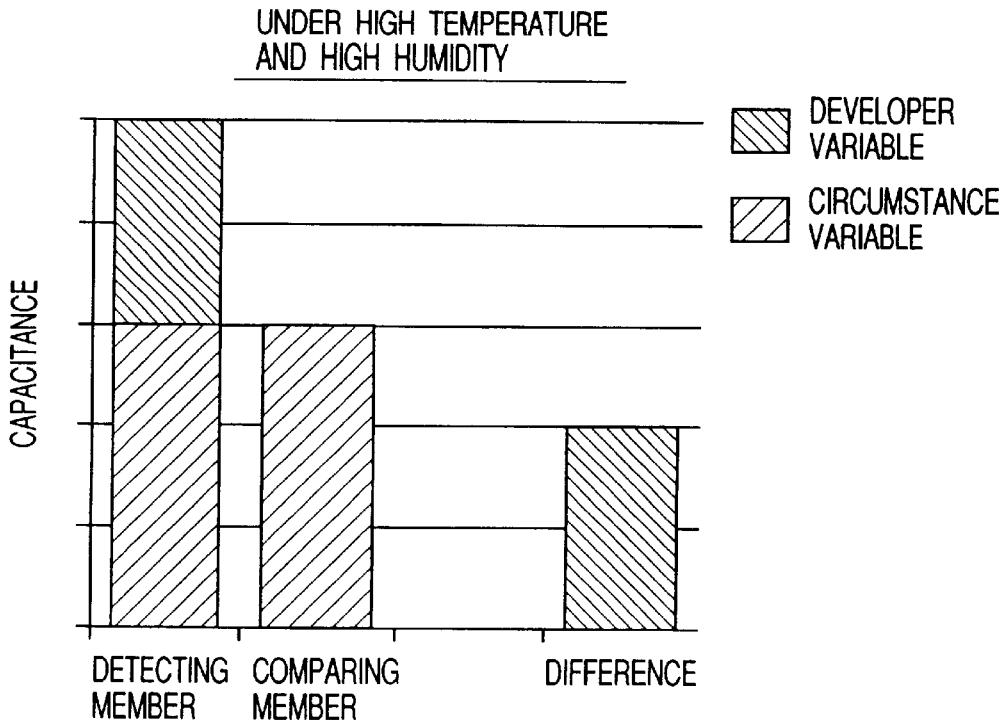
FIG. 10 is a graph for explanation of the developer amount detecting principle in accordance with the present invention.

Under the above circumstance, as shown in the middle bar graphs of FIGS. 9 and 10, the reference electrode member (comparing member) 20B having the same circumstance variable as that of the measuring electrode member (detecting member) 20A is disposed to take a difference therebetween (a bar graph on the right side), thereby being capable of measuring only the capacitance caused by the developer.

Figure 11:
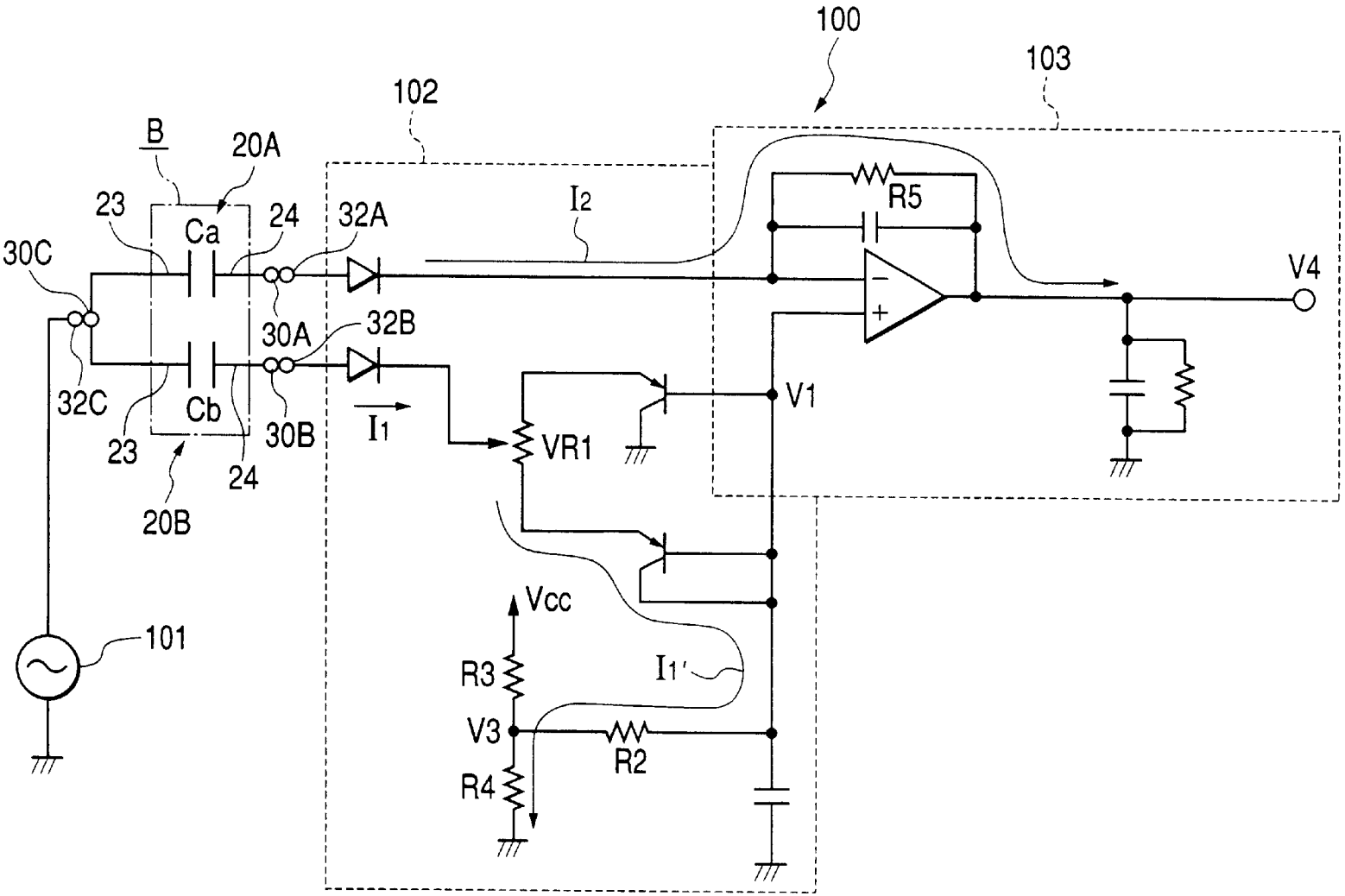
FIG. 11 is a diagram showing a developer amount detecting circuit for the developer amount detecting device in accordance with an embodiment of the present invention.

The developer amount detecting device that embodies the principle of the present invention will be described with reference to FIG. 11. FIG. 11 shows an example of a developer amount detecting circuit together with a connecting mode of the measuring electrode member 20A and the reference electrode member 20B in the image forming apparatus.

Each of the measuring electrode member 20A that functions as a detecting member having the capacitance Ca that varies with the amount of developer and the reference electrode member 20B that functions as a comparing member having the capacitance Cb that varies with the circumstantial conditions are designed in such a manner that one input side electrode 23 that functions as an impedance element is connected to a developing bias circuit 101 that functions as the developing bias applying means through a contact point 30C (the apparatus main body side contact point is 32C) whereas the other output side electrode 24 is connected to a control circuit 102 of the developer amount detecting circuit 100 through the contact points 30A (apparatus main body side contact point 32A) and 30B (apparatus main body side contact point 32B). The reference electrode member 20B is set with a reference voltage V1 in detection of the remaining amount of developer by using an a.c. (alternating) current $I_1$ supplied through the developing bias circuit 101.

As shown in FIG. 11, the control circuit 102 adds a voltage drop amount V2 caused by an a.c. current $I_1$ which is a value resulting from dividing the a.c. current $I_1$ which is supplied to the reference electrode member 20B, that is, an impedance element by a volume VR1, and a resistor R2 to a set voltage V3 set by resistors R3 and R4 to determine the reference voltage V1.

Therefore, an a.c. (alternating) current $I_2$ that is supplied to the measuring electrode member 20A is inputted to an amplifier 103 and outputted as a detected value V4 ($V1-I_2 \times R5$) of the remaining amount of developer. Then, the output value is used as the detected value of the remaining amount of developer.

As described above, according to the developer amount detecting device of the present invention, since the reference electrode member 20B that varies in the capacitance according to the circumstance as in the measuring electrode member 20A, the circumstance variable of the measuring electrode member 20A can be canceled, thereby being capable of detecting the remaining amount of developer with a high precision.

Figure 12:
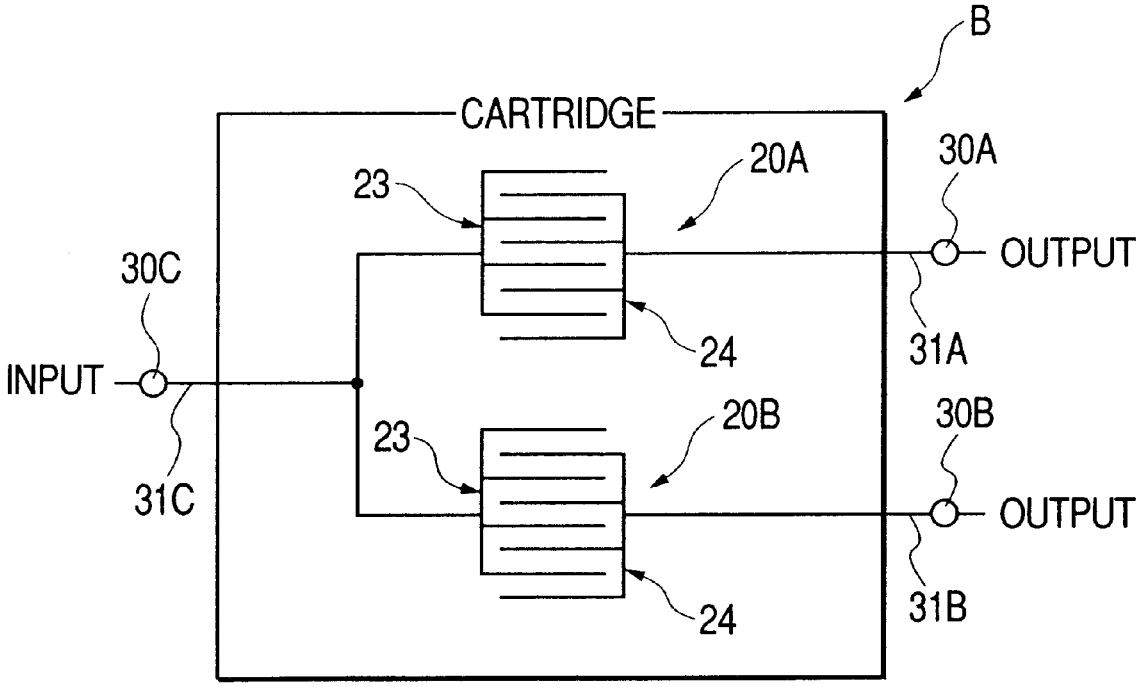
FIG. 12 is a diagram for explanation of the arrangement structure of the measuring electrode member and the reference electrode member.

According to this embodiment, as shown in FIGS. 12 to 14, the measuring electrode member 20A and the reference electrode member 20B, structured for comparison in the same manner as that of the measuring electrode member, are disposed in the developer container 11A of the developing means 4. Because the above structure includes the measuring electrode member 20A and the reference electrode member 20B in the developer container, the circumstance variable can be canceled, and the measuring electrode member 20A and the reference electrode member 20B can be located under substantially the same circumstances, thereby being capable of enhancing the precision of detection.

Further, according to this embodiment, as is understood with reference to FIGS. 13 and 14, the measuring electrode member 20A and the reference electrode member 20B can be designed in such a manner that the respective electrodes 23 and 24 are formed on one surface of a single bendable substrate 22, such as a flexible printed board, and folded back so as to be disposed within the developer container. Also, in this embodiment, the measuring electrode member 20A and the reference electrode member 20B have the same electrode pattern. That is, the patterns of both the electrodes 23 and 24 of the measuring electrode member 20A and the reference electrode member 20B are so shaped as to be substantially identical in capacitance and substantially identical in pattern width, length, interval, and the opposed area. The reference electrode member 20B thus manufactured is folded back on substantially the center of the substrate and is disposed on a location which is in the interior of the developer container 11A where the measuring electrode member 20A is disposed, which is sectioned by a partition wall 21 and which is out of contact with the developer.

As described above, the measuring electrode member 20A and the reference electrode member 20B are manufactured by the same process as a normal printed board manufacturing process, and therefore there occur a variation in the coefficient of moisture absorption of the material and the dielectric coefficient of the material and a variation in the capacitance of the substrate due to a difference in the etching conditions and variations in the electrode pattern width and height. In the present invention, since a single substrate serves as the detecting member and the comparing member with the formation of the measuring electrode member 20A and the reference electrode member 20B on the same surface of the substrate, two or more substrates are not required, thereby decreasing costs. Also, since the electrode patterns are formed on the same material, a variation in the material difference can be suppressed, and also since the patterns are formed on the same surface, a variation in the pattern formation, such as etching, can be suppressed. In addition, with the above structure, the detecting pattern can be disposed onto the upper portion of the developer container, and for that reason, the amount of developer can be measured even in a state where the developer container is almost full with the developer.

In the description of the above embodiments, the patterns of both the electrodes 23 and 24 of the measuring electrode member 20A and the reference electrode member 20B are so shaped as to be substantially identical in capacitance and substantially identical in pattern width, pattern length, pattern interval, and opposed area. However, the areas of the electrode patterns 23 and 24 of the reference electrode member 20B for comparison may be made different from the areas of the electrode patterns 23 and 24 of the measuring electrode member 20A. In this case, an output of the reference electrode member 20B is converted into an output resulting from multiplying the output by a given coefficient, and the output thus converted is compared with an output of the measuring electrode member 20A. With the above structure, since the reference electrode member 20B can be small-sized, a space for disposing the detecting member can be made small. Also, the structure can be made in such a manner that the measuring electrode member 20A and the reference electrode member 20B are disposed on the same wall surface on the same side of the developer container 11A, and the reference electrode member 20B is sectioned so as to be out of contact with the developer. In this case, the ratio of the pattern to the limited area on the detecting member 20A side can be increased, thereby enhancing the variation and precision in the capacitance.

In the present specification, a description that the value of the capacitance occurring when a voltage is applied to the electrode member is the same was made. However, the same value includes not only the case where the value is completely the same but also the case where the electrode members are manufactured intentionally so that the value becomes the same. Accordingly, for example, an error caused by the manufacturing variation or the like of the electrode members is included in the same value.

Similarly, the description that the numeric values and the shapes are the same such that the interval between the electrode members is kept constant, the opposed length of the electrodes are the same, the interval of the opposed portion is the same, and the shapes of the measuring electrode member and the reference electrode member are identical includes the case where the electrode members are intentionally manufactured so that the values or the shapes are the same.

Accordingly, for example, an error in numerical values caused by the manufacturing fluctuations or the like and the difference in shapes are included in the same value or the same shape.

Subsequently, the second developer remaining amount detecting means of the developer amount detecting device will be described.

According to this embodiment, as shown in FIGS. 1 and 3, the second developer remaining amount detecting means is structured in such a manner that a first electrically conductive portion (electrode) 81 and a second electrically conductive portion (electrode) 82, which function as measuring electrode portions that constitute the developer detecting portion 80 of the second developer remaining amount detecting means, are disposed along the developing roller 9*a,* and a voltage is applied to any one of the first electrode 81 and the second electrode 82, whereby a capacitance is induced between both the electrodes 81 and 82 and the capacitance is measured to detect the amount of developer. In this embodiment, as will be described in more detail later, a voltage is applied to the first electrode 81.

The magnetic developer attracted onto the surface of the developing roller 9*a* by a magnetic force of a magnet roller 9*c* surrounded by the developing roller 9*a* is scrapped off by the developing blade 9*d* when the developing roller 9*a* rotates and made uniform on the surface of the developing roller 9*a*.

The first and second electrodes 81 and 82 are disposed on positions where the developer scrapped off from the surface of the developing roller 9*a* enters a space between both the electrodes 81 and 82.

Figure 15:
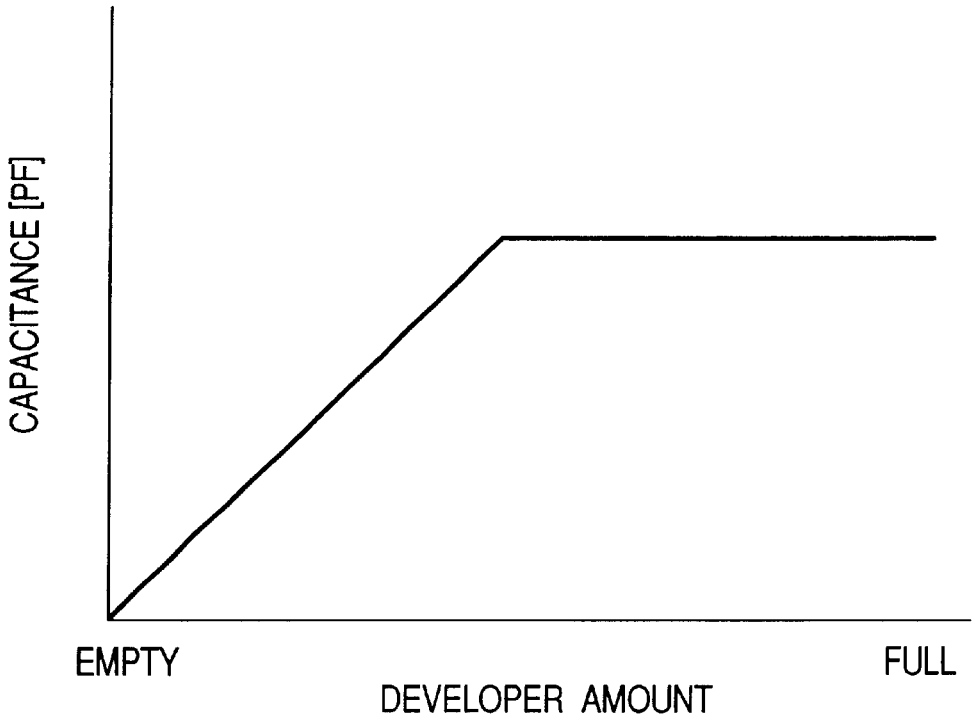
FIG. 15 is a graph showing a relation between a developer amount and a capacitance in the developer amount detecting device in accordance with the present invention.

Because the dielectric coefficient of the developer is higher than that of air, when the developer exists between the first and second electrodes 81 and 82, the capacitance increases. Accordingly, as will be described later, if sufficient developer exists within the developing chamber 9H, the above-described scrapped-off developer successively enters the space between the first and second electrodes 81 and 82, and therefore a larger capacitance is always outputted. Also, the developer that enters the space between the first and second electrodes 81 and 82 is also further decreased as the developer within the developing chamber 9A is further depleted, and the capacitance is also decreased. That is, the developer amount detecting device can successively detect the amount of developer with a detection of a change in the capacitance. FIG. 15 schematically shows the above detection.

Also, in order to improve the precision of detection in successively detecting the amount of developer, the variation of the capacitance may be increased. Accordingly, it is preferable that the first and second electrodes 81 and 82 are made large in size, and the capacitance is increased. In particular, it is preferable that the widths of the first and second electrodes 81 and 82 on the opposed side are set to be larger than the interval therebetween.

Figure 19:
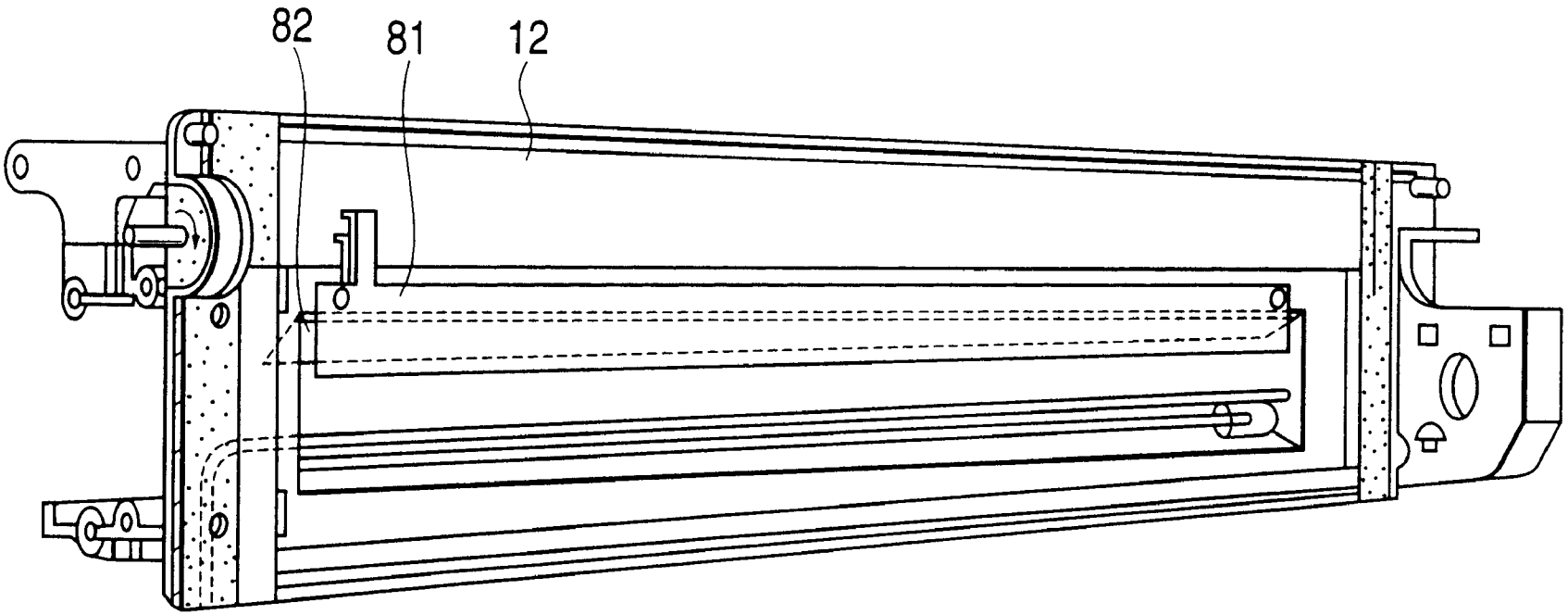
FIG. 19 is a perspective view showing one mode in which the first and second electrodes are fitted onto a developing frame.
Figure 26:
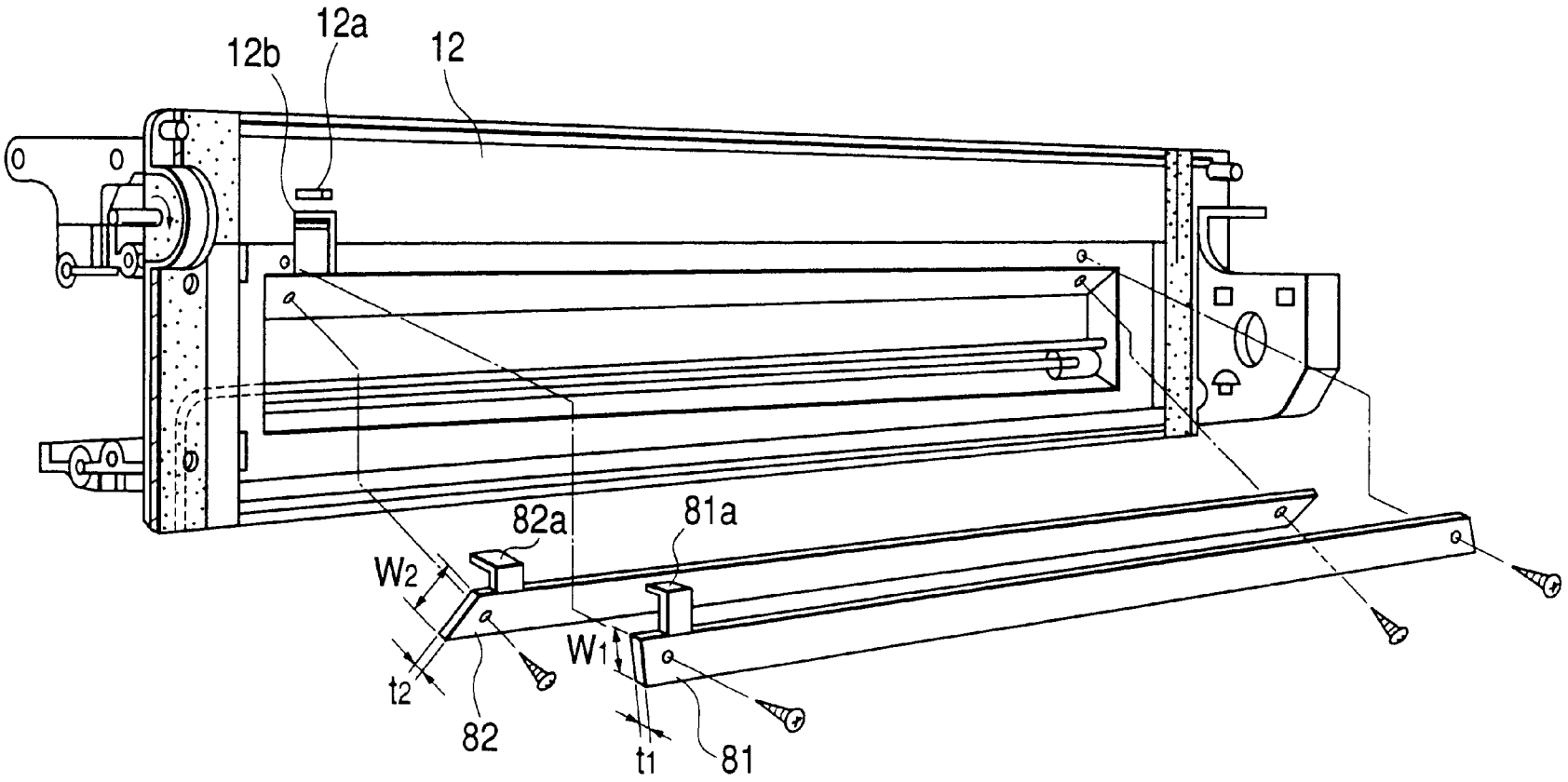
FIG. 26 is a perspective view showing a mode in which the first and second electrodes are fitted onto the developing frame in accordance with an embodiment of the present invention.

As may be better understood with reference to FIGS. 19 and 26, in this embodiment, the first and second electrodes 81 and 82 are in a slender shape extending along the longitudinal direction of the developing roller 9*a* and made of an electrically conductive material such as stainless steel (SUS), iron, phosphor bronze, aluminum or an electrically conductive resin. In this way, if the first and second electrodes 81 and 82 are made of the electrically conductive material all of those electrodes 81 and 82 conduct the equivalent operation. However, in the present invention, a non-magnetic metal material such as a non-magnetic SUS material is used in order to avoid circulation of the developer.

More specifically, in this embodiment, the first electrode 81 is made of a non-magnetic SUS material that is 14 mm in width ($W_1$) and 0.3 mm in thickness ($t_1$), the second electrode 82 is made of a non-magnetic SUS material that is 17 mm in width ($W_2$) and 0.5 mm in thickness ($t_2$), and those first and second electrodes 81 and 82 are disposed along the longitudinal direction of the developing roller 9*a,* thereby permitting an excellent result to be obtained. Also, both the electrodes 81 and 82 are not limited to this structure, but it is preferable that those electrodes 81 and 82 are disposed in the form of V so that an entrance side 84 of the developer becomes larger than a back side 85, for example, as shown in FIG. 3.

Figure 16A:
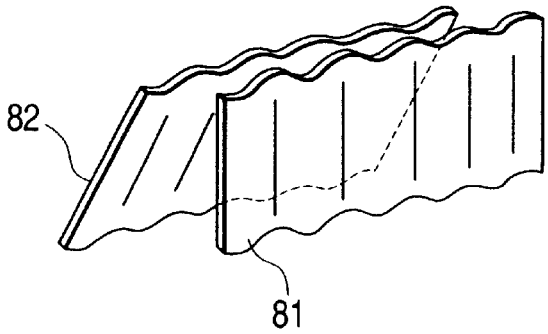
FIGS. 16A and 16B are perspective views showing first and second electrodes of the developer amount detecting device in accordance with the present invention, respectively.
Figure 16B:
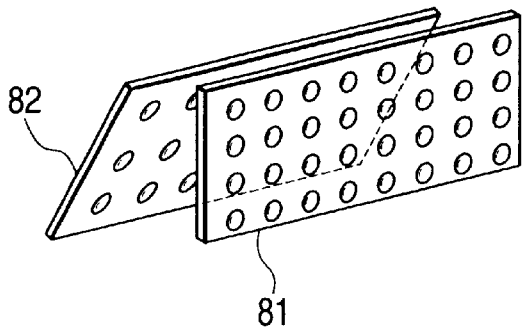
Figure 17:
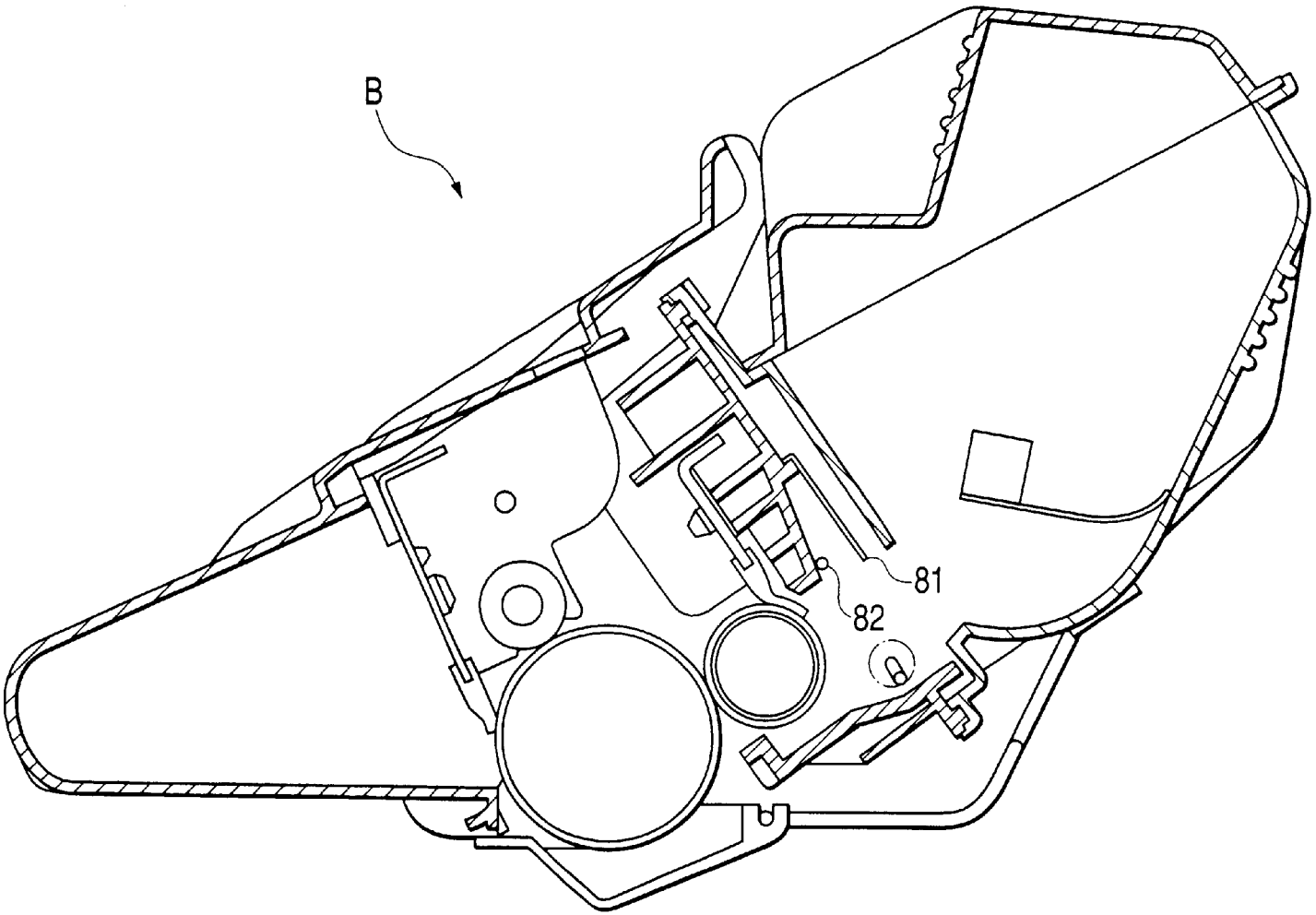
FIG. 17 is a longitudinal cross-sectional view showing the process cartridge in accordance with another embodiment of the present invention.
Figure 18:
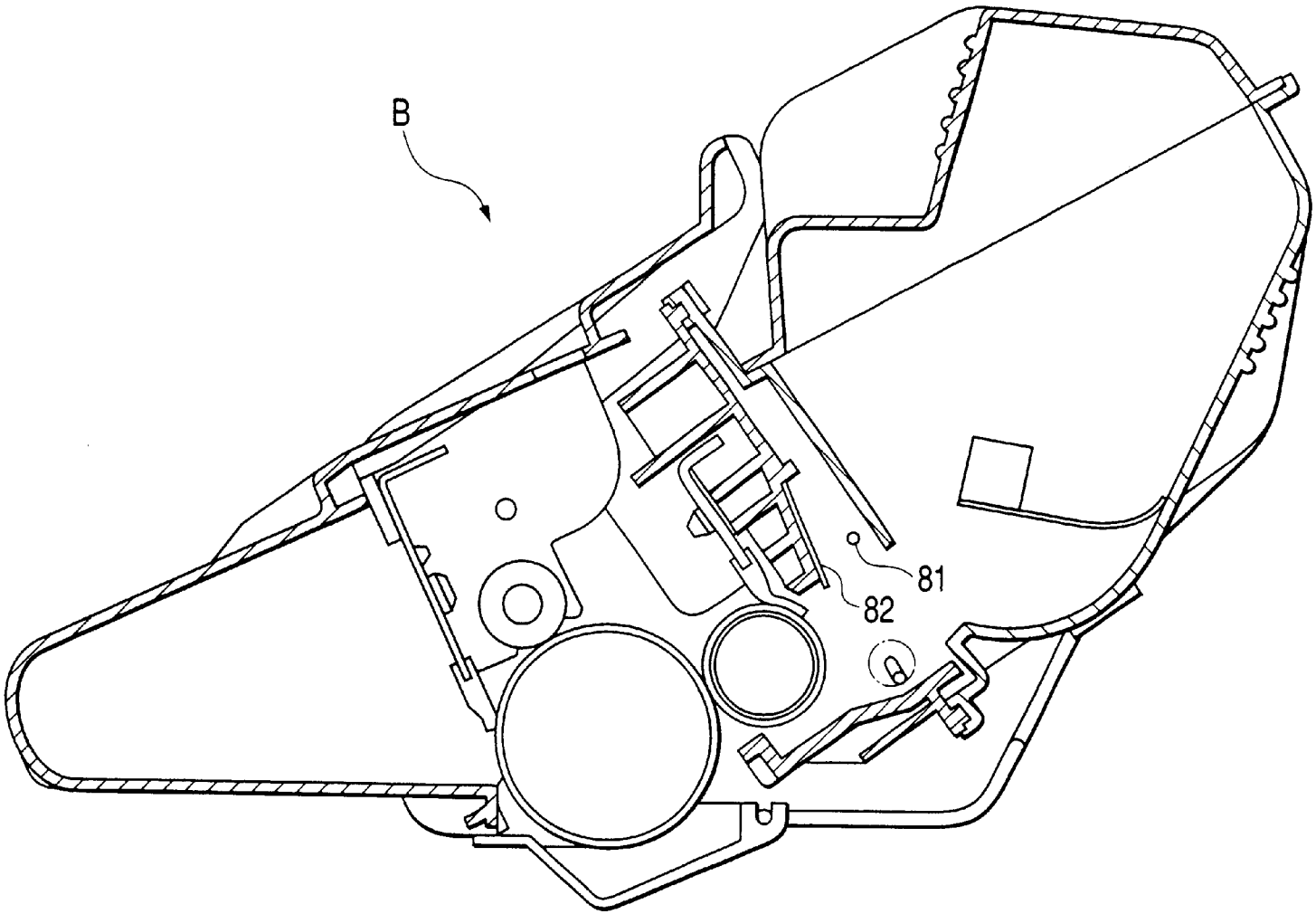
FIG. 18 is a longitudinal cross-sectional view showing the process cartridge in accordance with still another embodiment of the present invention.

Also, in order to increase the surface area of the electrodes 81 and 82, the surfaces of the electrodes 81 and 82 may be corrugate-shaped or drawing (embossed)-shaped as shown in FIGS. 16A and 16B. Contrarily, in the case where the space for the electrodes cannot be ensured, or the costs are intended to be reduced, any one of the first electrode 81 or the second electrode 82 may be formed of a round-bar shaped conductor as shown in FIGS. 17 and 18. FIG. 17 shows an embodiment in which the second electrode 82 is shaped in a round bar whereas FIG. 18 shows an embodiment in which the first electrode 81 is shaped in a round bar. In the embodiments of FIGS. 17 and 18, one round-bar is provided. However, a plurality of round-bars may be provided.

Figure 20:
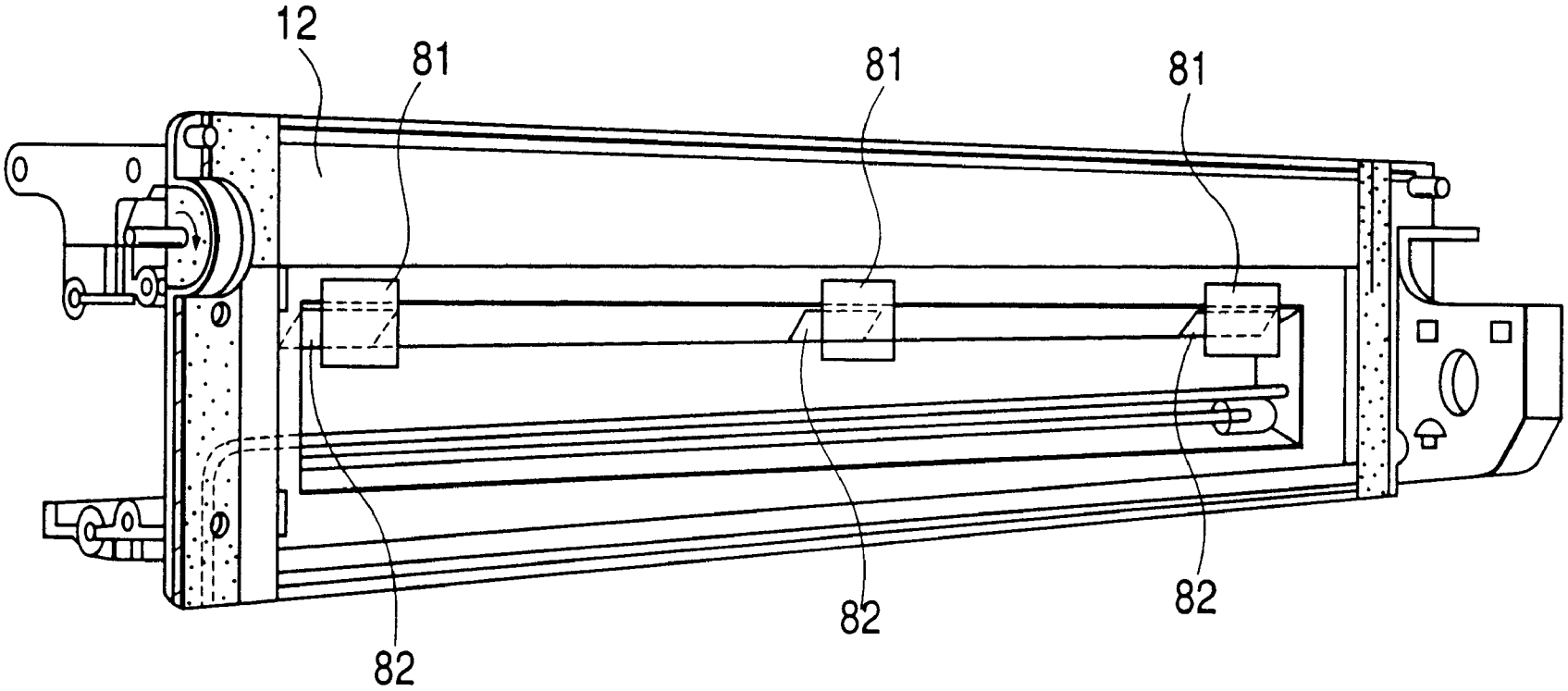
FIG. 20 is a perspective view showing another mode in which the first and second electrodes are fitted onto a developing frame.

Subsequently, an arrangement of the electrodes 81 and 82 in the longitudinal direction will be described. As described above, the first and second electrodes 81 and 82 are set to be substantially the same length as that of the image region along the longitudinal direction of the developing roller 9*a* with the results that the capacitance can be increased, thereby improving the precision of detection as described above. On the other hand, if high precision in detection is not relatively required, for example, the electrodes, each having a narrower width in correspondence with a portion close to a center or an end of an image, etc., can be disposed so that the costs can be reduced. However, in this case, since a variation in the amount of developer in the longitudinal direction cannot be detected, in order to prevent this defect, it is desirable that the electrodes 81 and 82 narrow in width are disposed on a plurality of portions including both ends and the center thereof as shown in FIG. 20.

Subsequently, the circulation of the developer within the developing chamber 9A will be described with reference to FIGS. 21 to 24.

Figure 21:
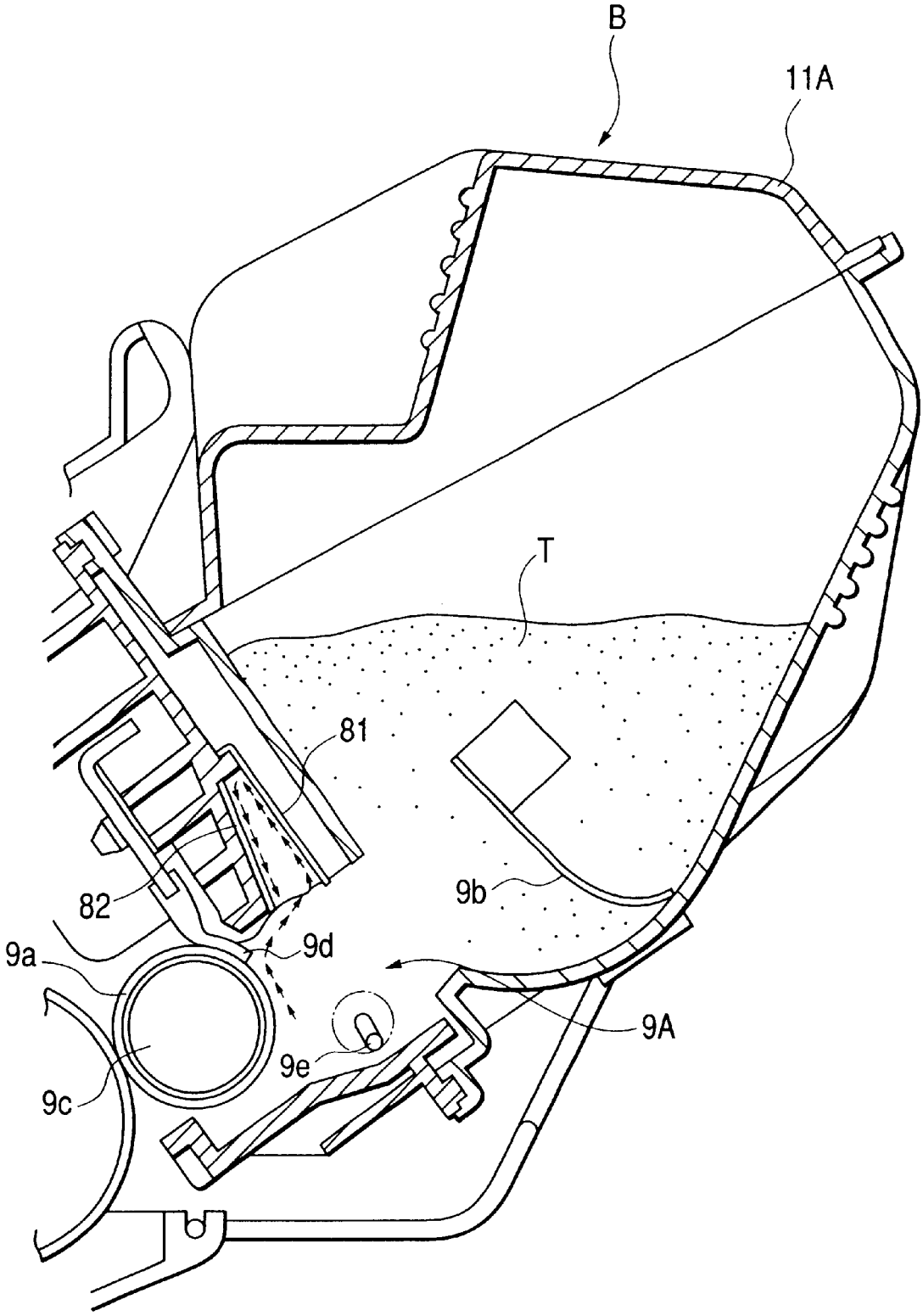
FIG. 21 is a longitudinal cross-sectional view for explanation of a mode in which a developer is circulated in a developing chamber of the process cartridge in accordance with the present invention.

In the case where the process cartridge of the present invention, that is, the structural portion of the developing device, is used for the first time, no developer exits between the first and second electrodes 81 and 82 and a sufficient developer T exists within the developer container 11A and the developing chamber 9A. In this situation, as shown in FIG. 21, the developer T within the developing chamber 9A is fed to the developing roller 9*a* side by the agitating member 9*e* and thereafter attracted onto the surface of the developing roller 9*a*. Then, with the rotation of the developing roller 9*a*, the developer on the surface of the developing roller 9*a* is scrapped off by the developing blade 9*d*, and the developer T successively enters a space between the first and second electrodes 81 and 82.

Figure 22:
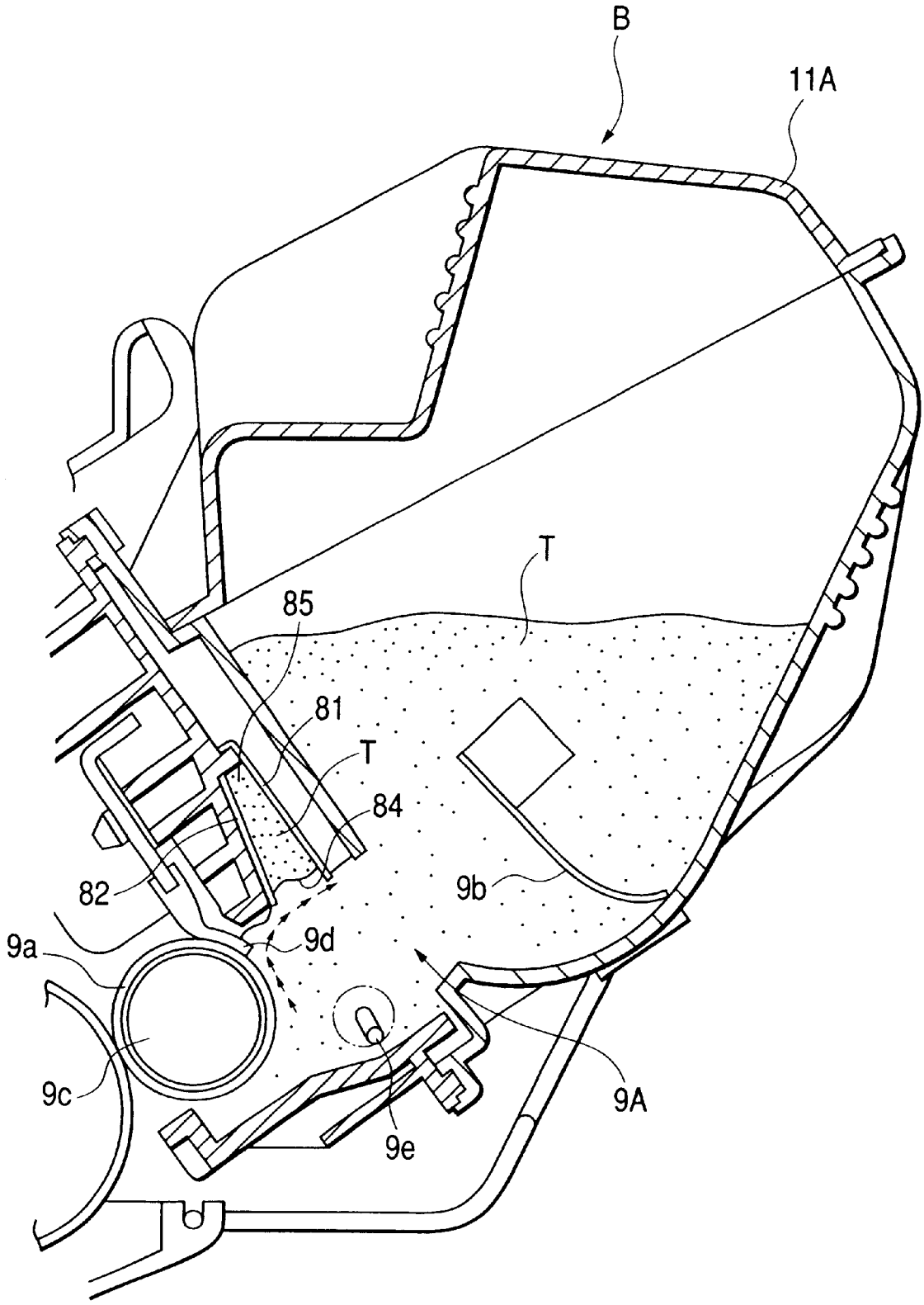
FIG. 22 is a longitudinal cross-sectional view for explanation of a mode in which the developer is circulated in the developing chamber of the process cartridge in accordance with the present invention.

After the developer T successively enters a space between the first and second electrodes 81 and 82, as shown in FIG. 22, the space between the first and second electrodes 81 and 82 is filled with the entering developer T. In this situation, because the developing chamber 9A is filled with the developer T, an inlet/outlet 84 of the developer T between the electrodes 81 and 82 is closed. For that reason, the developer T between the electrodes 81 and 82 does not freely drop down due to gravity or the like until the developer within the developing chamber 9A is decreased. That is, if sufficient developer T exists within the developing chamber 9A, because the space between the first and second electrodes 81 and 82 is filled with the developer T, the capacitance between the electrodes 81 and 82 becomes high.

Figure 23:
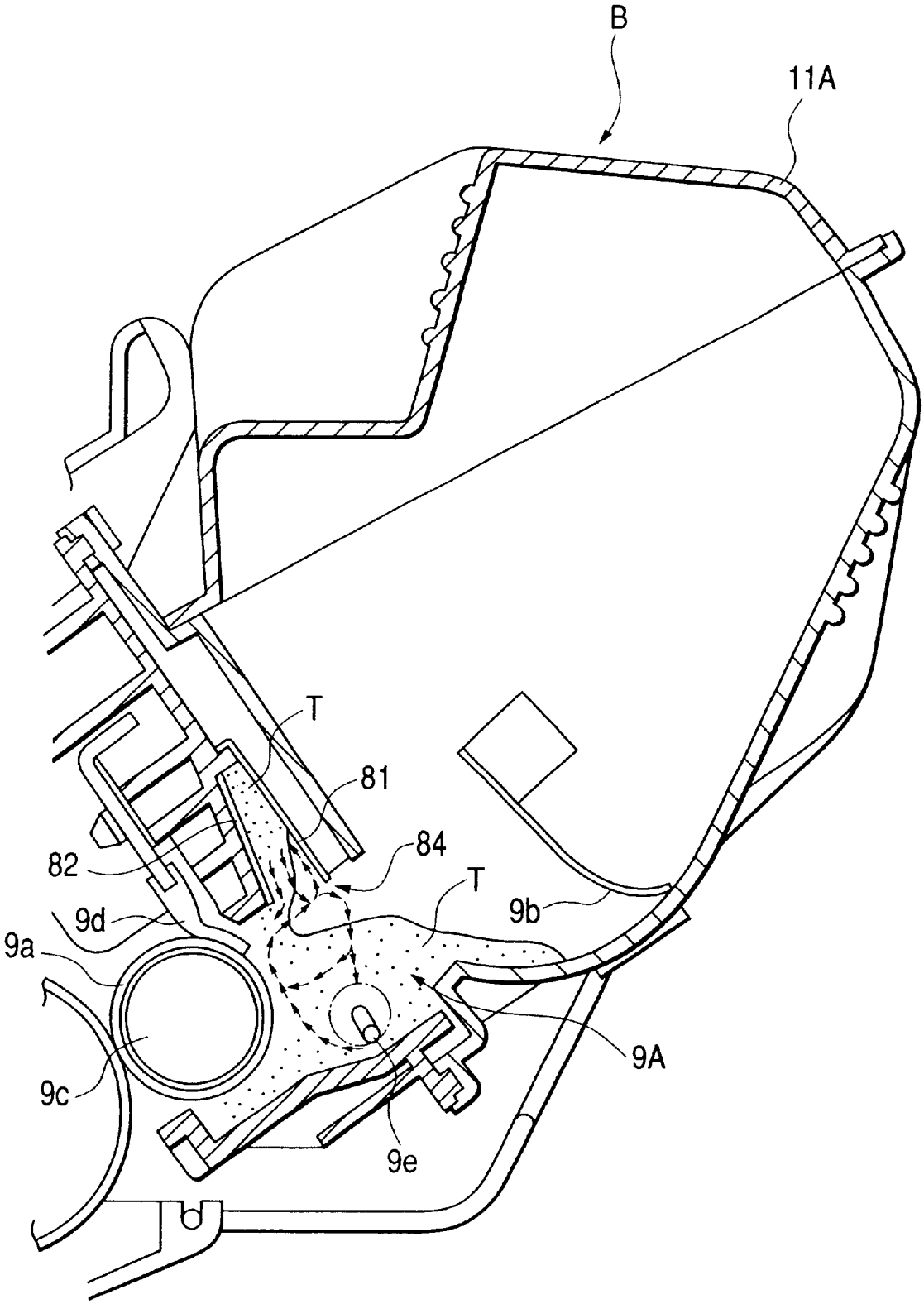
FIG. 23 is a longitudinal cross-sectional view for explanation of a mode in which the developer is circulated in the developing chamber of the process cartridge in accordance with the present invention.

As shown in FIG. 23, if the developer is depleted and the developer within the developer container 11A and the developing chamber 9A is reduced, the developer that closes the inlet/outlet 84 of the developer T between the electrodes 81 and 82 is eliminated, and the developer T between the first and second electrodes 81 and 82 drops down in the direction of gravity by its weight. The dropped developer is attracted onto the developing roller 9*a* by a magnetic force while the developer is dropping or again supplied to the developing roller 9*a* by the agitating member 9*e*. Also, a part of the developer is directly returned to the surface of the developing roller 9*a* by the magnetic force from the space between the first and second electrodes 81 and 82.

In a state shown in FIG. 23, the developer within the developing chamber 9A is reduced, and the developer between the first and second electrodes 81 and 82 goes out of the space between the first and second electrodes 81 and 82. However, since the developer scrapped off by the developing blade 9*d* is always supplied to the space between the first and second electrodes 81 and 82 so far as the developer exists within the developing chamber 9A, the developer between the electrodes 81 and 82 is reduced in accordance with the amount of developer within the developing chamber 9A.

Figure 24:
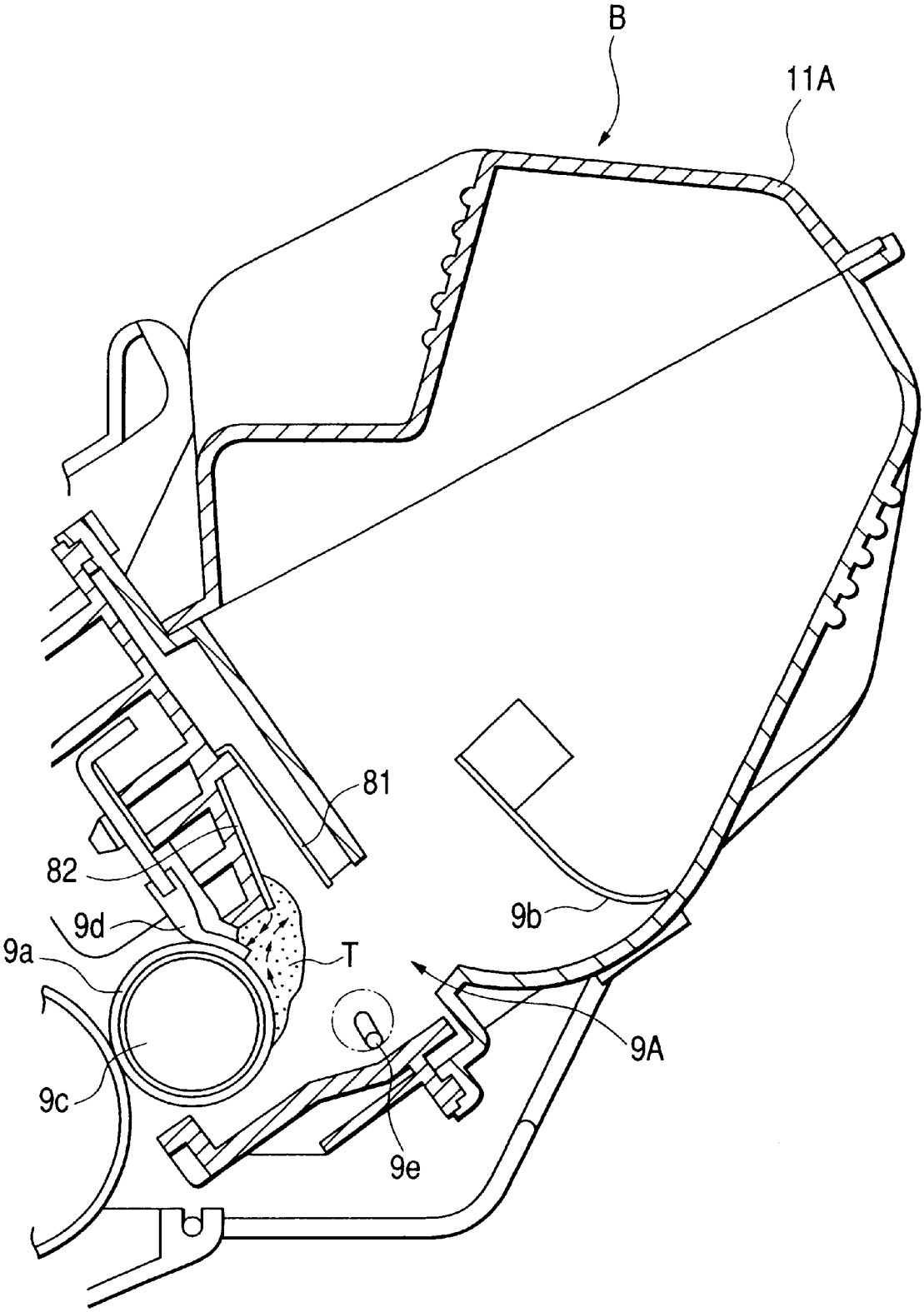
FIG. 24 is a longitudinal cross-sectional view for explanation of a mode in which the developer is circulated in the developing chamber of the process cartridge in accordance with the present invention.

Finally, the developer within the developer container 11A and the developing chamber 9A is depleted, and as shown in FIG. 24, since the developer between a leading edge of the developing blade 9*d* that scrapes off the developer on the surface of the developing roller 9*a*, that is, the developing roller 9*a* and the developer amount detecting portion 80 is depleted, a blank area in an image occurs, resulting in a developer end (=no developer) state.

In this way, according to the present invention the amount of developer within the developing chamber 9A can be successively detected by measuring the amount of developer between the first and second electrodes 81 and 82, that is, by measuring the capacitance between the first and second electrodes 81 and 82.

According to the above embodiment, as shown in FIGS. 3 and 19, the peripheral structure of the first and. second electrodes 81 and 82 is made in such a manner that the back side 85 between the first and second electrodes 81 and 82 is closed, and the number of the inlet/outlet 84 of the developer T between the first and second electrodes 81 and 82 is one. For that reason, as described above, it is effective that the space between the first and second electrodes 81 and 82, which is located on the entrance side 84 of the developer, is made large.

However, if the developer per unit time on the developing roller 9*a* that is scrapped off by the developing blade 9*d* increases due to the rotating speed-up of the developing roller 9*a*, etc., there is a case in which the developer filled up in the space between the first and second electrodes 81 and 82 is increased and packed. When the developer is packed, because the developer between the first and second electrodes 81 and 82 cannot be circulated, the developer does not drop down by its weight or the magnetic force of the magnet roller 9*c*. This phenomenon is remarkable under the high-humidity circumstance where the developer that absorbs the moisture, and in this state, because the capacitance between the first and second electrodes 81 and 82 does not change, the amount of developer is not detected.

Figure 25:
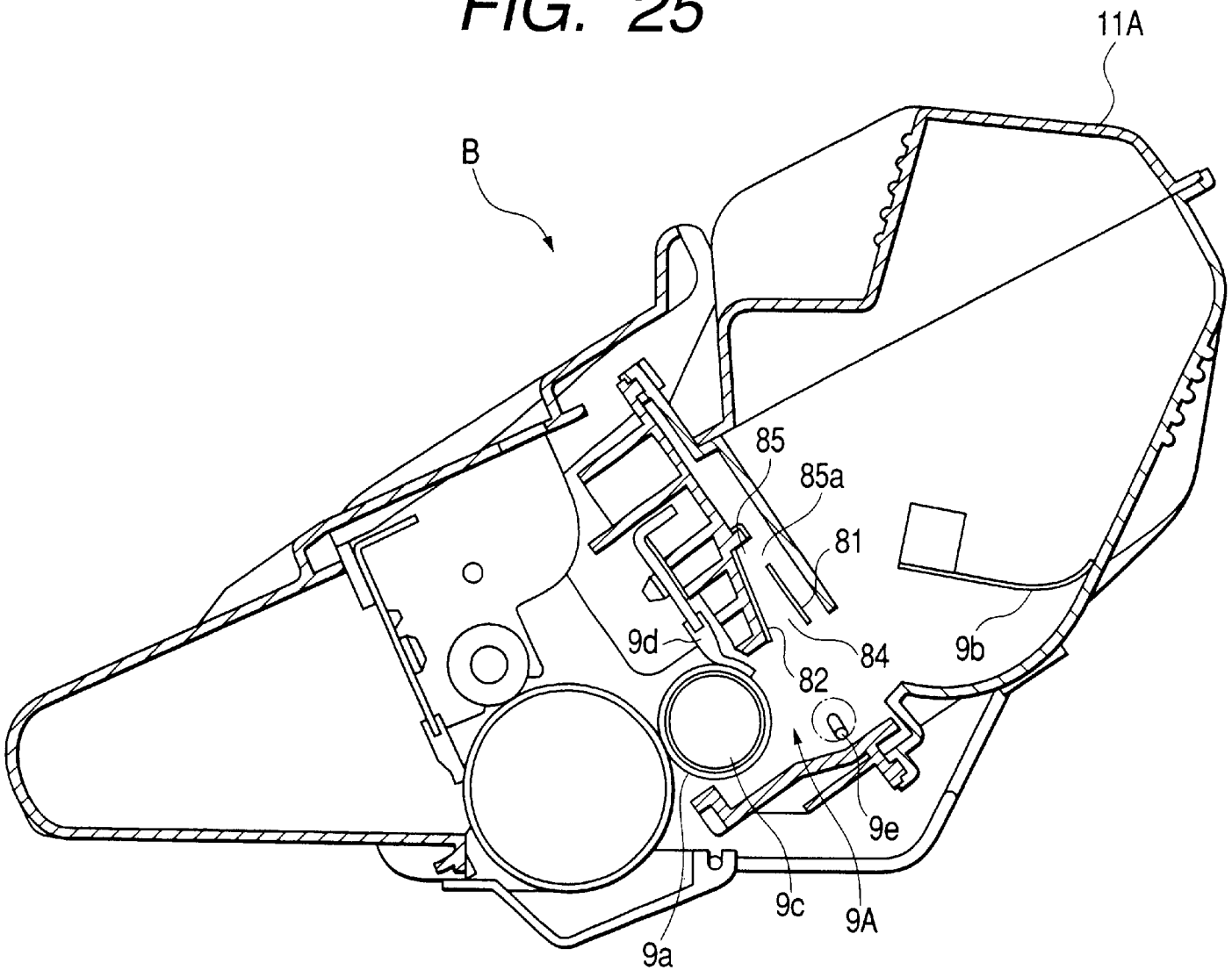
FIG. 25 is a longitudinal cross-sectional view showing a process cartridge in accordance with another embodiment of the present invention.

In view of the above, as shown in FIG. 25, an outlet 85*a* different from the inlet 84 of the developer is defined on the back side 85 between the first and second electrodes 81 and 82 so that the developer can pass through the space between the first and second electrodes 81 and 82, thereby being capable of preventing the developer between the first and second electrodes 81 and 82 from being packed.

Subsequently, the structure of mounting the first and second electrodes 81 and 82 onto the structural portion of the developing device will be described.

Since the developer amount detecting portion 80 using the first and second electrodes 81 and 82 is so adapted as to detect the capacitance between the first and second electrodes 81 and 82, the precision in the position between the first and second electrodes 81 and 82 is extremely important. Also, since an object of the present invention is to accurately detect the timing at which a blank area occurs in an image because the developer is completely depleted, the first and second electrodes 81 and 82 should be arranged in the vicinity of the developing roller 9*a* where the developer remains to the last.

In view of the above, according to this embodiment, as shown in FIG. 26, the first and second electrodes 81 and 82 are mounted on a developing frame, that is, the developing frame 12. A means of mounting the first and second electrodes 81 and 82 may be formed of a screw, an adhesive, a caulking, insert molding or the like. With the above structure, the first and second electrodes 81 and 82 can be relatively positioned with high precision and the first and second electrodes 81 and 82 are disposed in the vicinity of the developing roller 9*a,* thereby being capable of detecting a timing just before the amount of developer is reduced.

Also, according to this embodiment, as described above, the first and second electrodes 81 and 82 are made of the non-magnetic SUS material. However, the developing frame 12 may be directly subjected to processing, such as vacuum evaporation or printing, or an electrically conductive resin may be dichroic-molded to form an electrically conductive portion, thereby structuring the first and second electrodes 81 and 82. In this case, because the mounting tolerance and the parts tolerance are reduced as compared with the electrodes formed of different members, the precision in position is improved.

Figure 27:
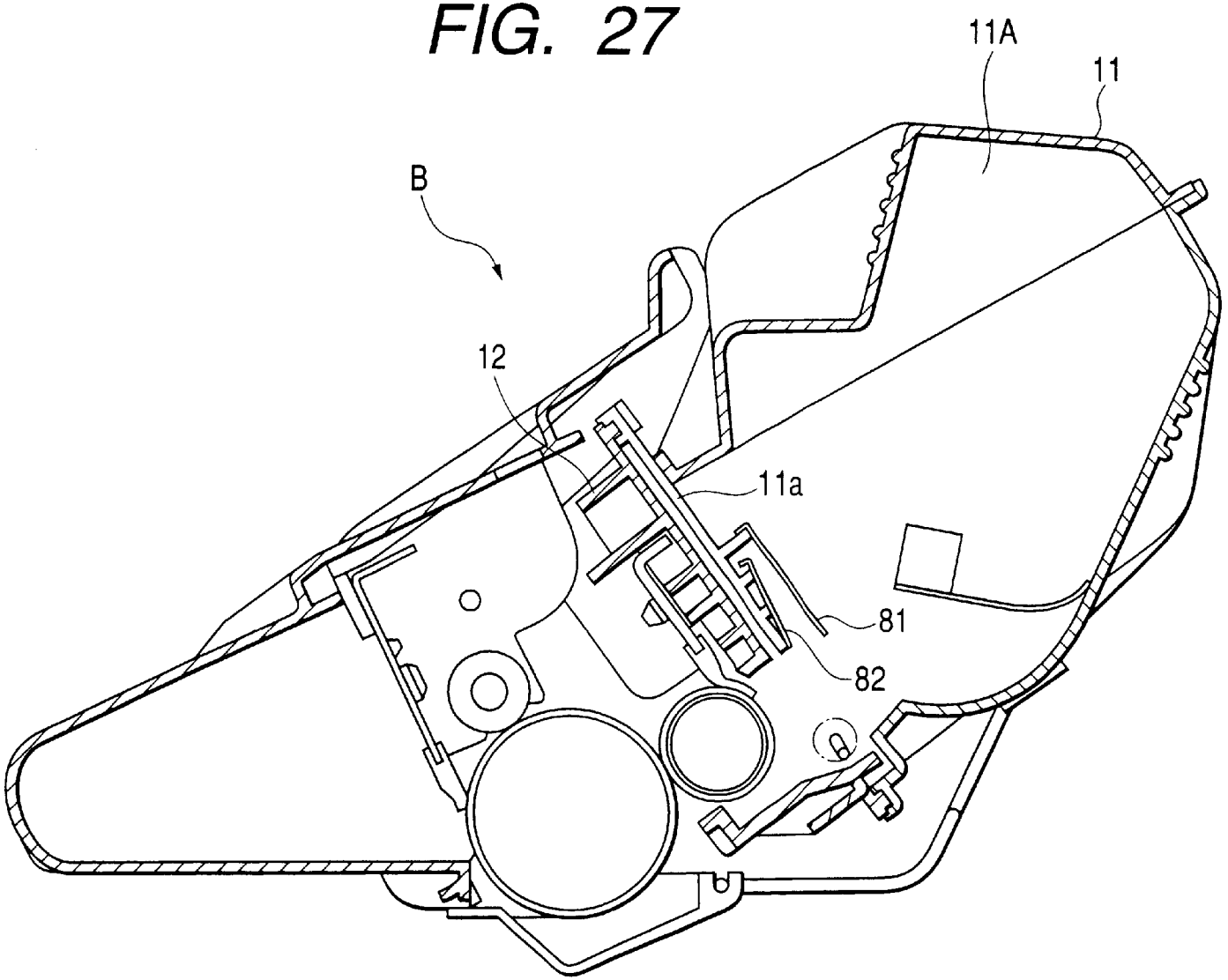
FIG. 27 is a longitudinal cross-sectional view showing a process cartridge in accordance with another embodiment of the present invention.

In addition, for example, in the case where the developing frame 12 is small, as shown in FIG. 27, the first and second electrodes 81 and 82 may be mounted on a front wall 11*a* of the developer container 11A for convenience of design. In this case, a position between the first and second electrodes 81 and 82 can be located with high precision.

Figure 28:
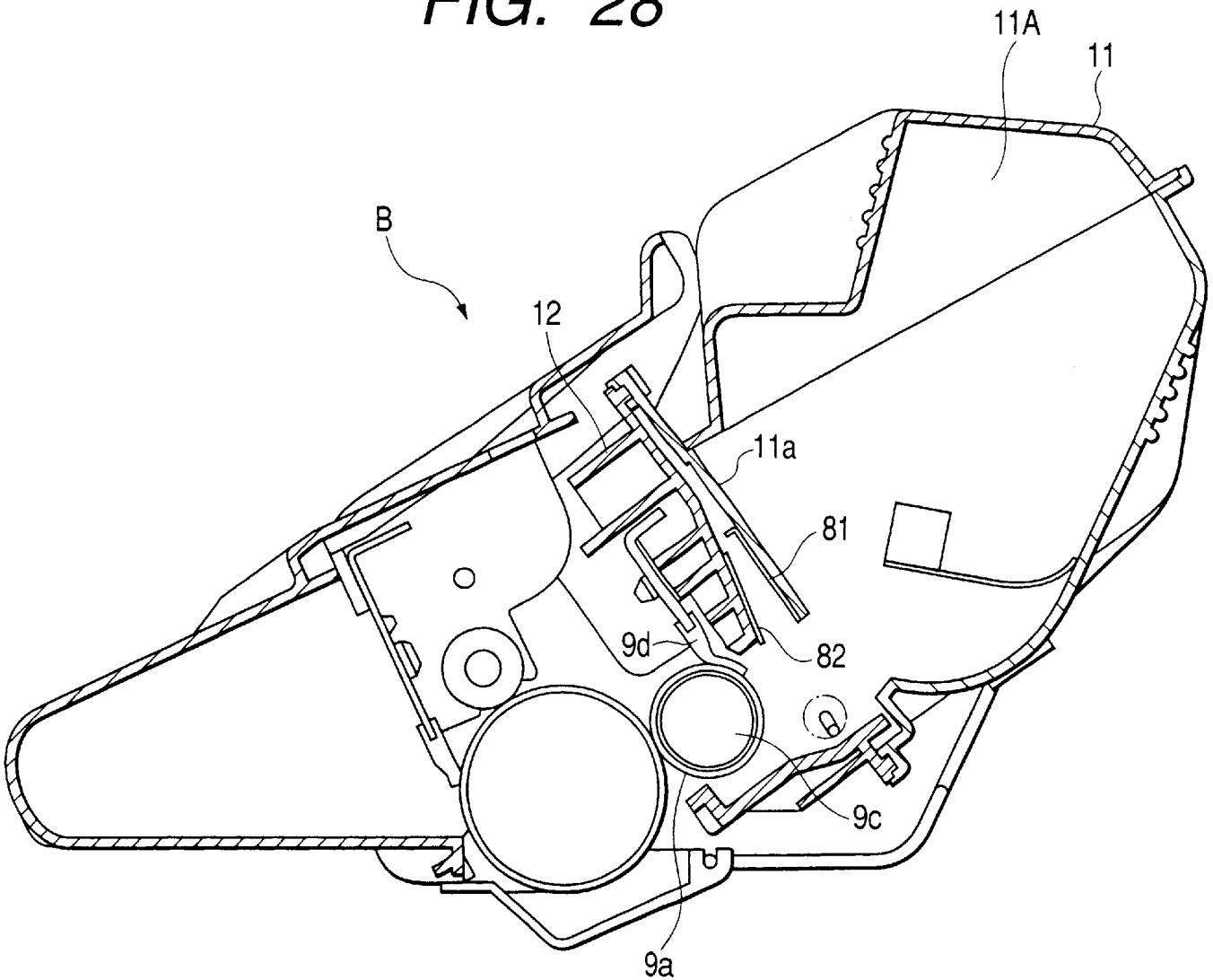
FIG. 28 is a longitudinal cross-sectional view showing a process cartridge in accordance with still another embodiment of the present invention.

Further, as shown in FIG. 28, the second electrode 82 is mounted on the developing frame 12, the first electrode 81 is mounted on the front wall 11*a* of the developer container 11A, and the developing frame 12 and the developer container 11A are coupled to each other so that the first and second electrodes 81 and 82 may be opposed to each other. In this case, the degree of freedom of the respective frame structures increases.

Figure 29:
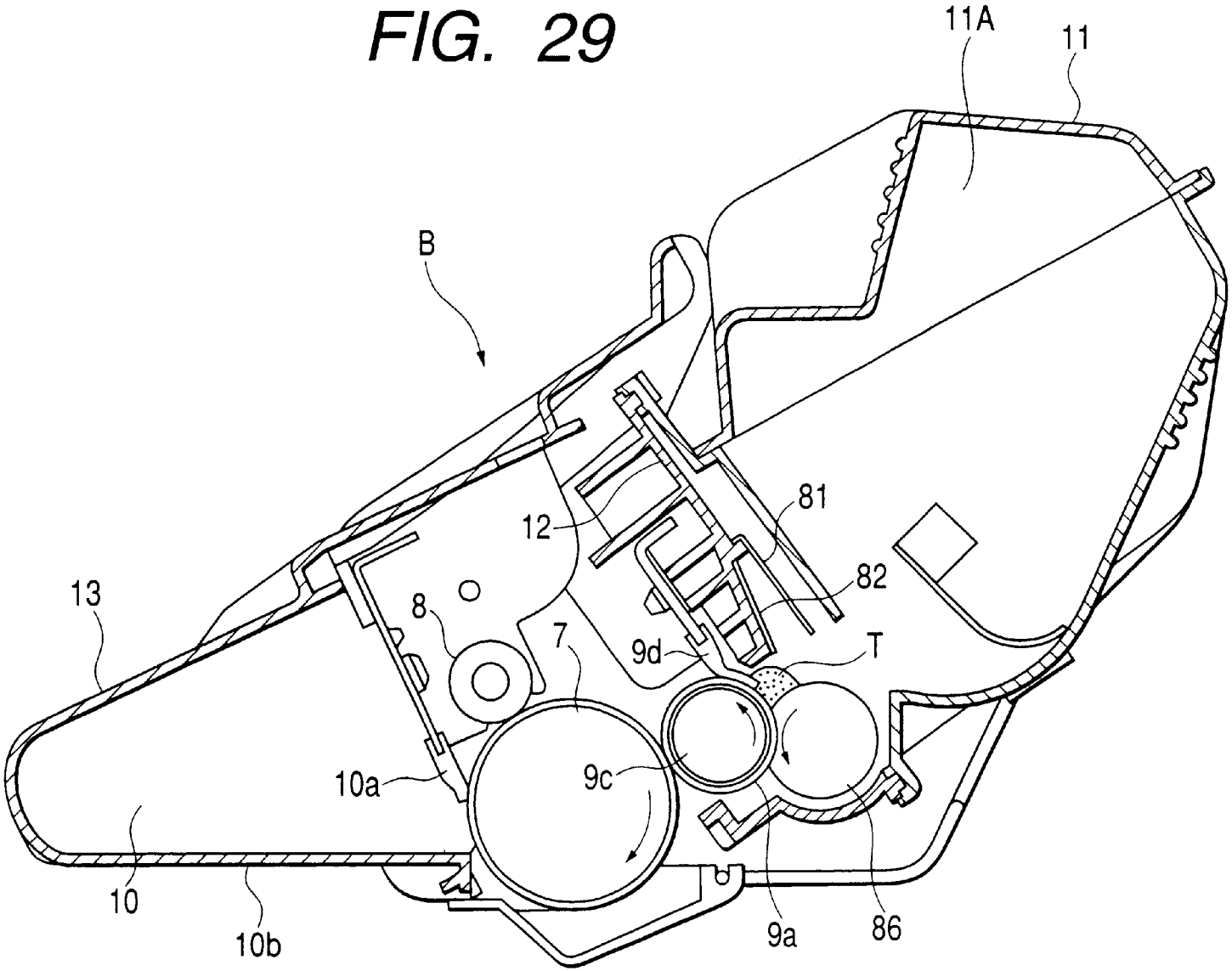
FIG. 29 is a longitudinal cross-sectional view showing a process cartridge in accordance with still another embodiment of the present invention.

In the above-described embodiment, the structure of successively detecting the developer in the case of using the magnetic developer as the developer was described. However, the present invention can be applied to a process cartridge having the structure of a developing device using a non-magnetic developer as shown in FIG. 29.

In the structure of the developing device using the non-magnetic developer, a developer coating roller 86 is employed as means for supplying the developer to the developing roller 9*a*. The developer coating roller 86 is formed of an elastic member, such as sponge, and rotates in a counter direction while being abutted against the developing roller 9*a* and coats the developer on the developing roller 9*a* by a Coulomb force developed there. In this situation, the developer T finally depleted is on an upper portion of a contact portion of the developing roller 9*a* with the developer coating roller 86. Therefore, if the first and second electrodes 81 and 82 are disposed in the vicinity of that upper portion, the amount of developer can be successively detected as in the process cartridge using the magnetic developer.

Figure 30:
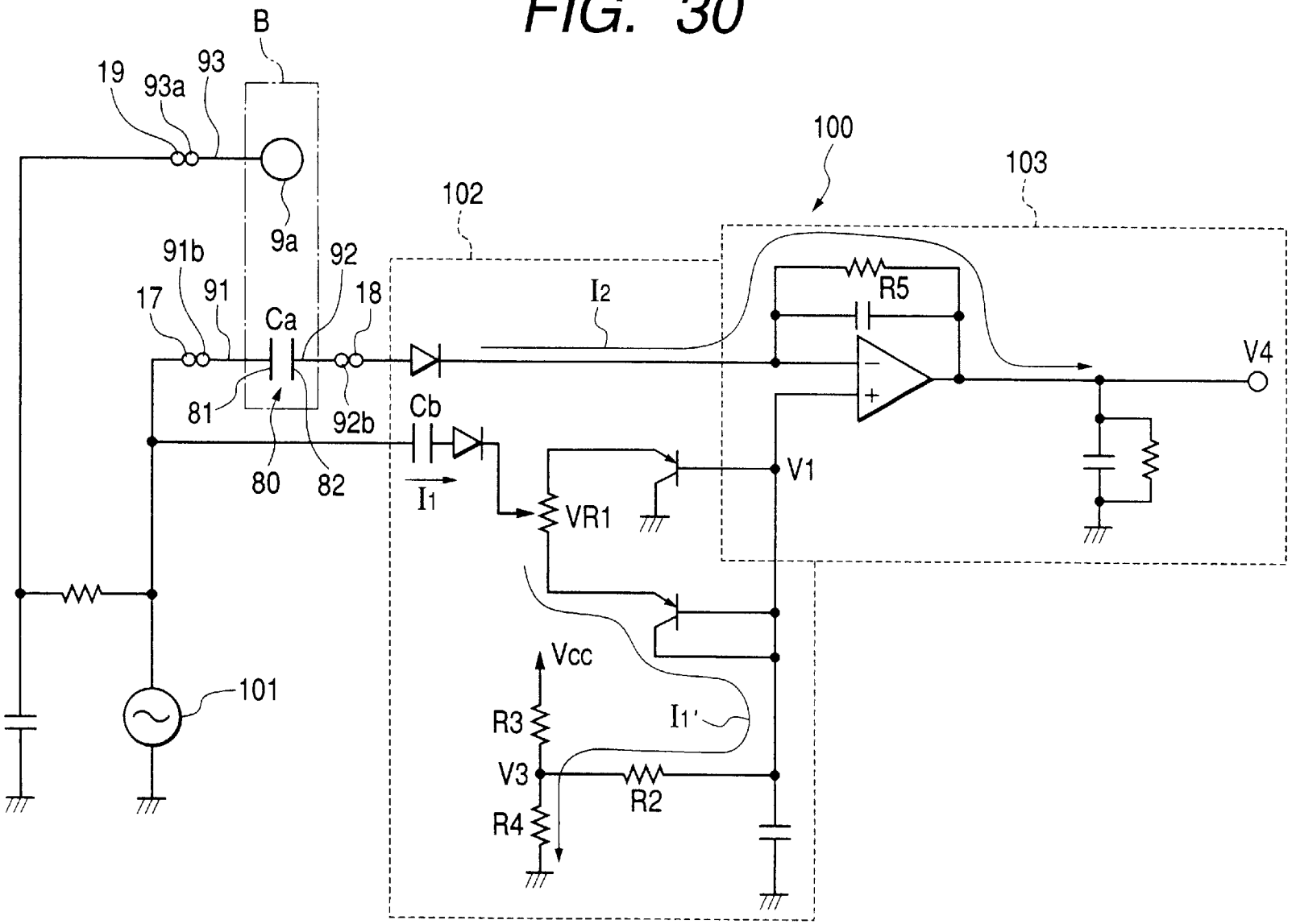
FIG. 30 is a diagram showing a developer amount detecting circuit for the developer amount detecting device in accordance with an embodiment of the present invention.

The developer amount detecting device that embodies the principle of the present invention will be further described with reference to FIG. 30. FIG. 30 shows an example of the developer amount detecting circuit together with a connecting mode of the developer amount detecting portion 80 having the first and second electrodes 81 and 82 in the image forming apparatus.

In the detecting portion 80 having a capacitance Ca that varies in accordance with the amount of developer, one input side electrode of an impedance element, in this embodiment, the first electrode 81, is connected to the developing bias circuit 101 that functions as the developing bias applying means through a first electric contact point 91, and the other output side electrode, in this embodiment, the second electrode 82, is connected to the control circuit 102 of the developer amount detecting circuit 100 through a second electric contact point 92. A reference capacitance element (Cb) is also connected to the developing bias circuit 101 and sets the reference voltage V1 in the detection of the remaining amount of developer by using the a.c.(alternating) current $I_1$ that is supplied through the bias circuit 101. It is needless to say that the developing roller 9*a* is applied with the developing bias voltage from the bias circuit 101 by electrically connecting a contact point 19 disposed in the apparatus main body 14 to a contact point portion 93*a* of the electric contact point 93 of the developing roller 9*a* when the process cartridge B is installed in the apparatus main body 14.

The control circuit 102 adds a voltage drop amount V2 caused by an a.c. current $I_1'$ which is a value resulting from dividing the a.c. current $I_1$ that is supplied to the reference impedance element by a volume VR1, and a resistor R2 to a set voltage V3 set by resistors R3 and R4 to determine the reference voltage V1.

Therefore, an a.c. (alternating) current $I_2$ which is supplied to the developer amount detecting portion 80 is inputted to an amplifier 103 and outputted as a detected value V4 ($V1-I_2 \times R5$) of the remaining amount of developer. Then, the output value is used as the detected value of the remaining amount of developer.

According to the image forming apparatus of the present invention, as described above, the amount of developer between the first and second electrodes 81 and 82, which constitute the second developer remaining amount detecting means, is successively detected and the depleted amount of developer is indicated on the basis of the detected information, thereby calling the user's attention to the preparation of a fresh process cartridge or a developer supplementary cartridge, and also calling the user's attention to the replacement of the process cartridge or the supplement of the developer in accordance with the detected information of the developer end.

Figure 31:
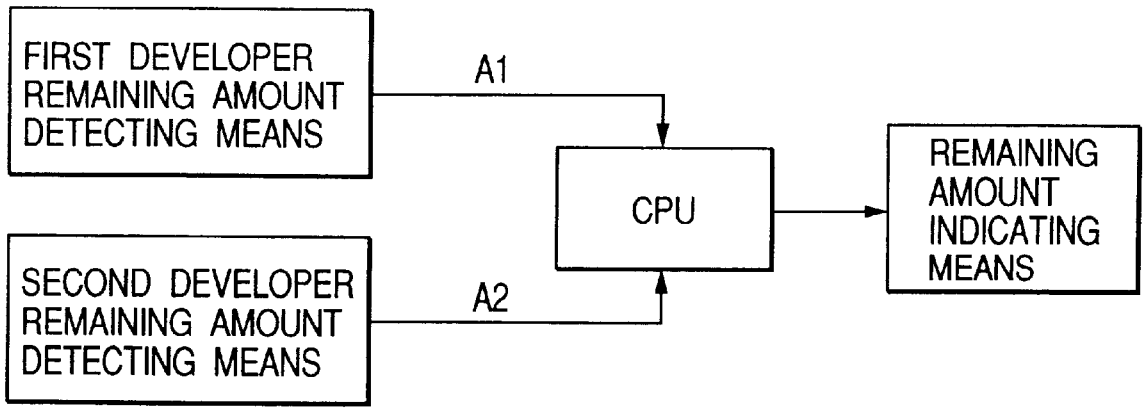
FIG. 31 is a block diagram showing a flow of the detected result in successively detecting the developer remaining amount in accordance with the present invention.

FIG. 31 is a block diagram showing a flow of the detected result in successively detecting the remaining amount of developer by the developer amount detecting device in accordance with the present invention.

As shown in FIG. 31, in this embodiment, values A1 and A2 detected by the first and second developer remaining amount detecting means are inputted to a CPU (not shown) disposed in the main body of the image forming apparatus where those values A1 and A2 are arithmetically operated on, and their results are transmitted to the remaining amount indicating means from the CPU.

Conversion tables that convert the detected values A1 and A2 into the amount of developer are prepared within the CPU in accordance with the first and second developer remaining amount detecting means.

A method of controlling the detected results by the developer remaining amount detecting means in the developer amount detecting device will be further described in more detail in a third embodiment.

(Second Embodiment)

Figure 32:
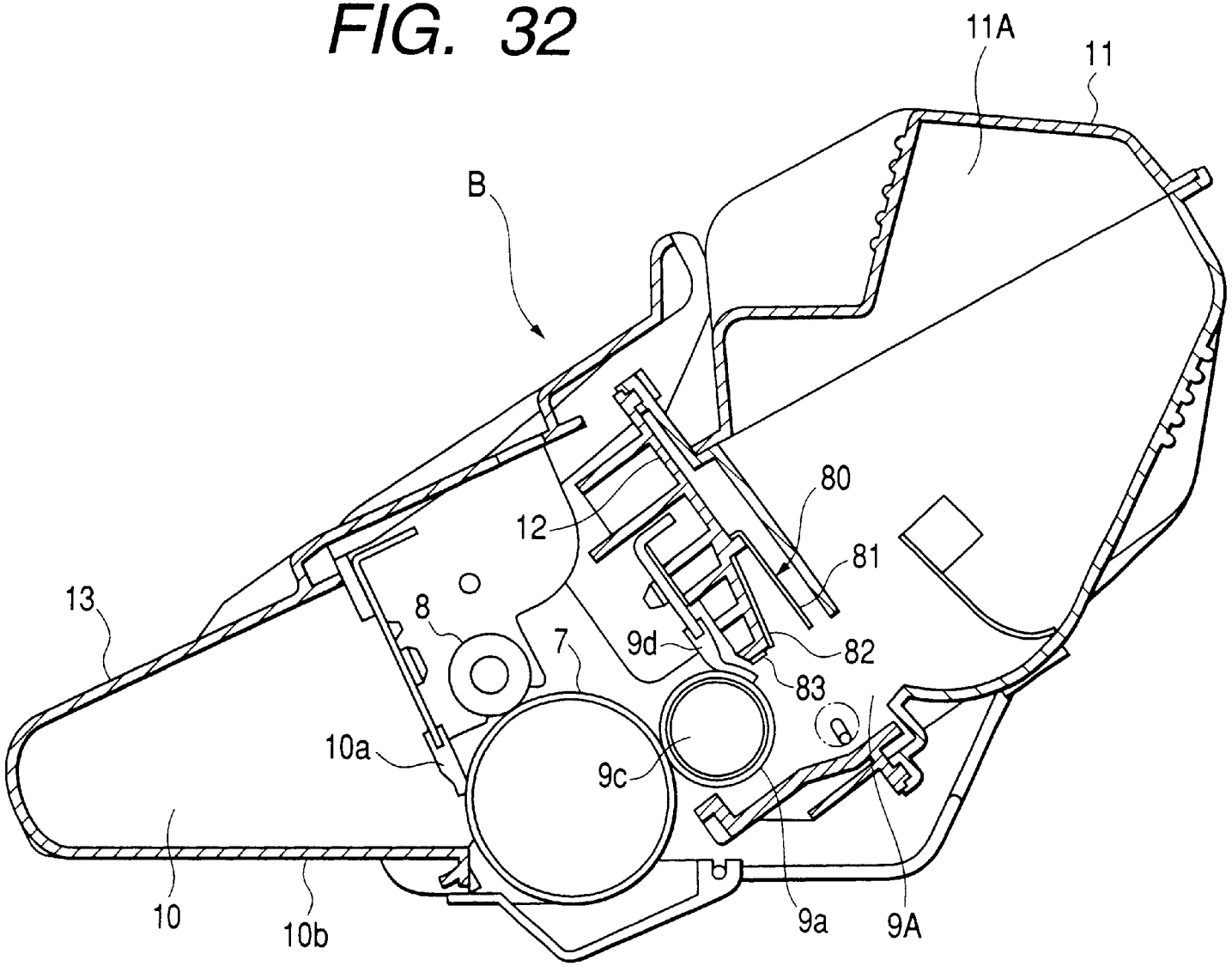
FIG. 32 is a longitudinal cross-sectional view showing a process cartridge in accordance with still another embodiment of the present invention.

FIG. 32 shows another embodiment of the present invention. A process cartridge B of this embodiment is structured as the same developing device as the process cartridge B in the first embodiment except that a third electrically conductive portion (electrode) 83 is further provided as the measuring electrode member of the developer amount detecting portion 80. Accordingly, the members identical in structure and operation are designated by the same reference numeral, and their detailed description will be omitted.

Incidentally, a description of the structure and operation which are duplicated with those in the first embodiment, for example, the structure and arrangement of the first and second electrically conductive portion 81 and 82 structured in accordance with the present invention, the circulation of the developer between the first and second electrodes 8*y*, the peripheral structure of the first and second electrodes 8*y*, and the method of mounting the first and second electrodes 8*y*, will be omitted.

A main object of the structure of this embodiment is to accurately detect the time just before a blank area occurs in an image. In order to achieve this object, the amount of developer at a portion where the developer is finally depleted may be detected. Accordingly, this embodiment is structured so as to detect the amount of developer between the second and third electrodes 82 and 83 and the developing roller 9*a* as described with respect to the circulation of the developer in the first embodiment.

In other words, according to the developer amount detecting device of the present invention, as shown in FIG. 32, the first electrode 81 and the second electrode 82 are located as in the first embodiment, and the third electrode 83 is also disposed along the developing roller 9*a*. The third electrode 83 is located at a position closer to the developing roller 9*a* than the first and second electrodes 8*y*.

In the above structure, the capacitance Ca is induced between the first and second electrodes 8*y* by application of a voltage to the first electrode 81, and at the same time, a capacitance Cc is also induced between the developing roller 9*a* and the third electrode 83 by the developing bias voltage applied to the developing roller 9*a*. Then, those capacitances Ca and Cc are measured to detect the amount of developer.

Figure 33:
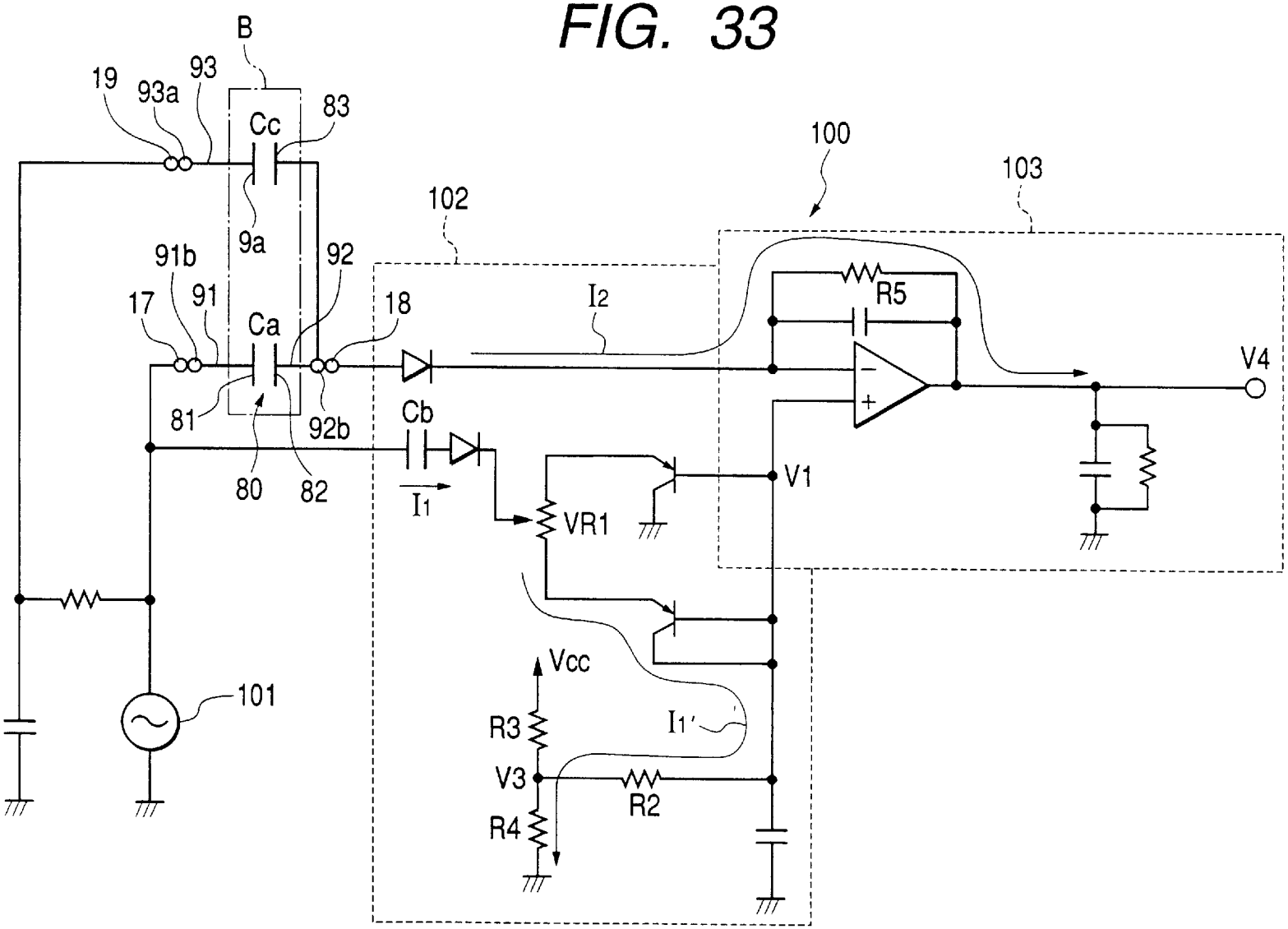
FIG. 33 is a diagram showing a developer amount detecting circuit for the developer amount detecting device in accordance with another embodiment of the present invention.

An example of the developer amount detecting circuit in accordance with this embodiment is shown in FIG. 33. The entire circuit structure is identical with that of the developer detecting circuit according to the first embodiment, which is shown in FIG. 30, except for the structure in which the third electrode 83 is disposed opposite to the developing roller 9*a*, and the capacitance Cc is induced between the developing roller 9*a* and the third electrode 83.

In this embodiment, as shown in FIG. 33, there are provided a contact 91 that electrically comes in contact with the electrode 17 of the main body 14 of the electrophotographic image forming apparatus in order to apply a voltage to the first electrode 81 and a contact 93 that electrically comes in contact with the electrode 19 of the main body 14 of the apparatus in order to apply the developing bias voltage to the developing roller 9*a*. Because those contacts 91 and 93 are provided separately, the degree of freedom of design is improved.

Also, if the voltage applied to the first electrode 81 is applied from the developing bias circuit 101, the number of power supplies is not increased, thereby preventing costs from being raised.

In addition, if those contacts 91 and 93 are formed of one component, the capacitance can be accurately measured without producing any parasitic capacitance between those contacts 91 and 93.

Figure 34A:
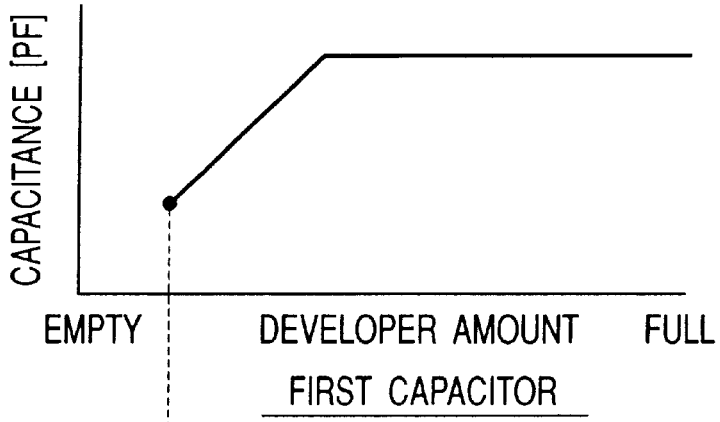
FIGS. 34A, 34B an 34C are graphs for explanation of the developer amount detecting principle in accordance with the present invention, respectively.
Figure 34B:
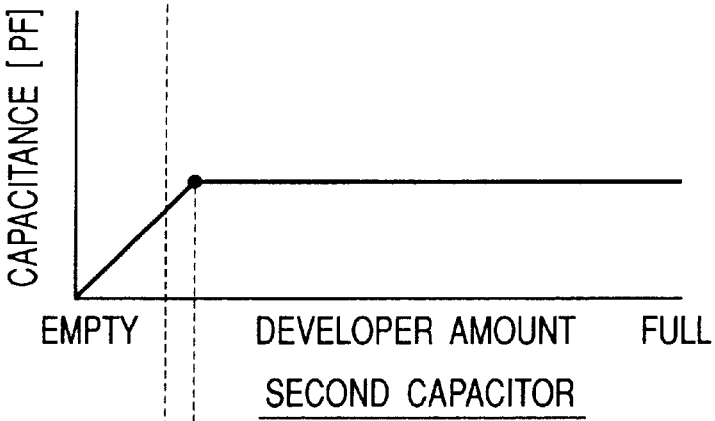
Figure 34C:
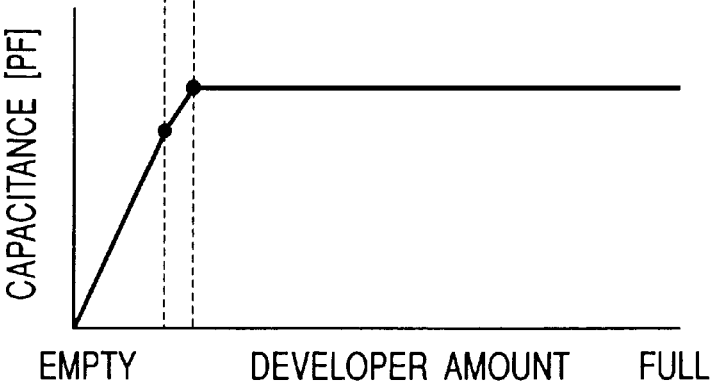

As described above, similarly, in this embodiment, the amount of developer can be successively detected with a reduction of the developer within the developing chamber 9A between the first and second electrodes 8*y*, and an end detection of the amount of developer can be accurately conducted between the developing roller 9*a* and the third electrode 83. A relation between the amount of developer and its output at this time is schematically shown in FIGS. 34A, 34B and 34C.

Also, as shown in FIG. 33, if the first capacitance element (Ca) formed by the first and second electrodes 8*y* and the second capacitance element (Cc) formed by the developing roller 9*a* and the third electrode 83 are disposed in parallel with each other, the number of contacts of the image forming apparatus main body 14 with the process cartridge B can be reduced, thereby reducing the costs.

Figure 35:
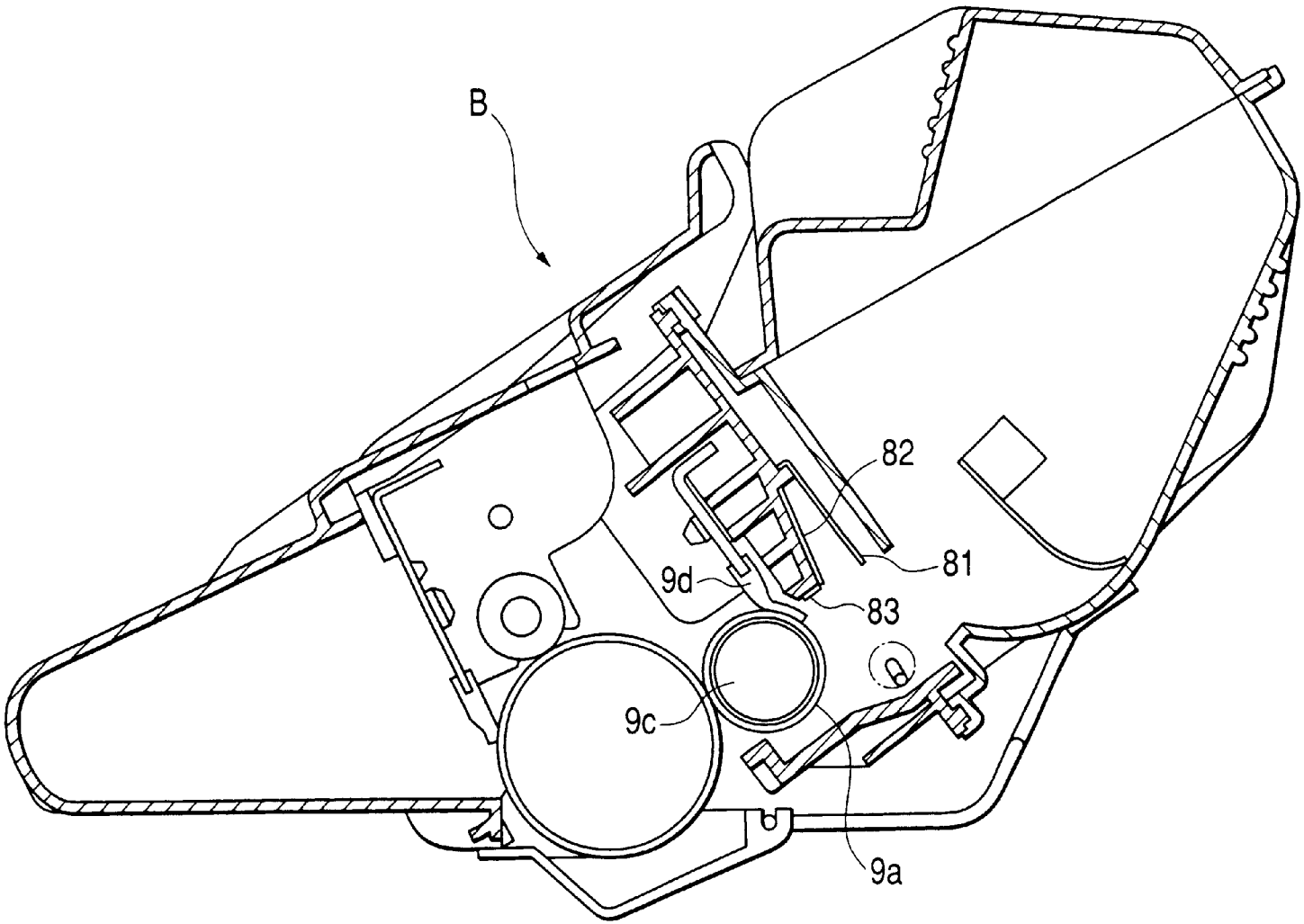
FIG. 35 is a longitudinal cross-sectional view showing a process cartridge in accordance with still another embodiment of the present invention.

In addition, if the electric conductors are wired, the capacitance is produced between the conductors, to thereby cause a deterioration in the precision of detection. A reduction in wiring of the electric conductors leads to an improvement in the precision of detection. Therefore, as shown in FIG. 33, it is preferable that the second and third electrodes 82 and 83 are electrically connected to each other. More preferably, as shown in FIG. 35, if the second and third electrodes 82 and 83 are formed integrally, the wiring can be suppressed at the minimum, thereby accurately maintaining the precision in detection. In this situation, the third electrode 83 is structured so as to be folded with respect to the second electrode 82, and as described above, the third electrode 83 becomes closer to the developing roller 9*a*.

According to this embodiment, because the first developer remaining detecting means is of the system of detecting the amount of developer in the vicinity of the surface of the developer remaining amount detecting means, that is, in the vicinity of the surface of the measuring electrode member 20A, if the remaining amount of developer is large, a detection, relatively high in precision can be conducted. However, it is difficult to determine a state immediately before a blank area in an image occurs, which is a defective image caused when there is a shortage of developable developer on the developing roller 9*a*.

This is because the state just before the blank area occurs in an image can be more accurately detected by the system of directly detecting the amount of developer that exists on the surface of the developing roller 9*a*. Also, even if there is a shortage in developer within the developer container 11A, there is no case in which there is a complete shortage of developer on the surface of the measuring electrode member 20A, resulting in a variation factor.

On the other hand, in principle, the second developer remaining amount detecting means can select a portion high in precision of the detection by the arrangement of the electrically conductive members, that is, the first, second and third electrodes 81, 82 and 83 although the selection is within a permissible range of the shape of the developer container 11A. However, it is necessary to further widen the interval between the first and second electrodes as the remaining amount of developer is going to be more wholly detected, as a result of which, a change in the capacitance becomes small, to thereby cause a deterioration in the precision of detection.

In this embodiment, there are provided the first and second electrodes 81 and 82 that successively detect a state where the remaining amount of developer is relatively small, and the third electrode 83 that more accurately detects the remaining amount of developer just before a blank area occurs in an image, and the respective electrodes are located in such a manner that the remaining amount of developer can be successively detected with high precision from a state where the remaining amount of developer is relatively small to a state where the blank area occurs in an image by connecting two kinds of capacitors consisting of those electrodes 81, 82 and the developing roller 9*a* in parallel with each other.

Figure 36A:
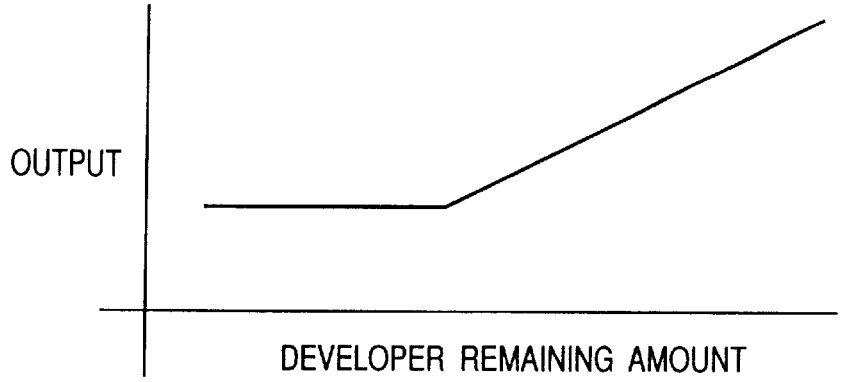
FIGS. 36A, 36B, and 36C are graphs for explanation of the developer amount detecting principle in accordance with the present invention, respectively.
Figure 36B:
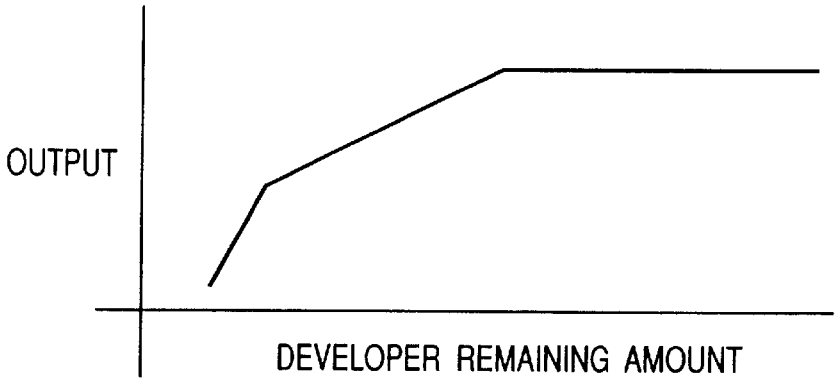
Figure 36C:
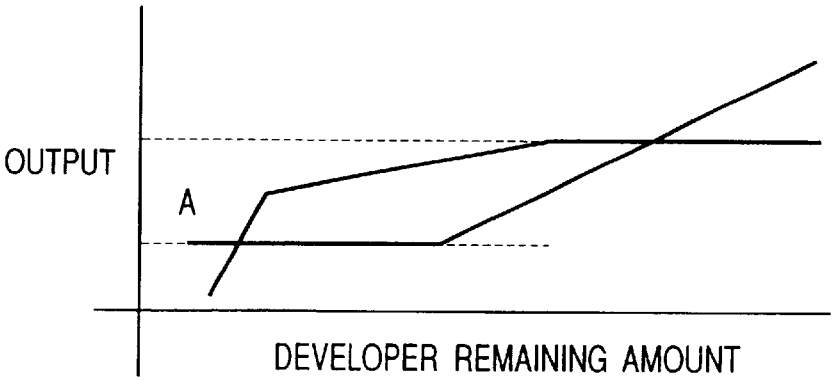

Referring to FIGS. 36A, 36B and 36C, a transition of the capacitance with respect to the remaining amount of developer of the first developer remaining amount detecting means is shown in FIG. 36A, a transition of the capacitance with respect to the remaining amount of developer of the second developer remaining amount detecting means is shown in FIG. 36B, and a transition of the capacitance with respect to the remaining amount of developer of the combination of the first and second developer remaining amount detecting means is shown in FIG. 36C. In FIGS. 36A, 36B and 36C, portions where an output changes are detectable ranges.

As shown in FIG. 36C, the provision of a plurality of developer remaining amount detecting means enables a developer remaining amount successive detection high in precision to be always conducted in a state where the amount of developer is large to a state where a blank area occurs in an image.

In this embodiment, the use of two kinds of developer remaining amount detecting means improves the precision in detection. However, it is needless to say that the present invention is not limited to two kinds of developer remaining amount detecting means, and the same effect can be obtained by the provision of a plurality of developer remaining amount detecting means.

Subsequently, a description will be provided of a method of controlling the detected results of the two kinds of developer remaining amount detecting means in accordance with the present invention.

As described above, according to the developer amount detecting device of the present invention, in the case where the first developer remaining amount detecting means and the second developer remaining amount detecting means are combined together, the detectable ranges can be overlapped with each other as shown in FIG. 36C.

Figure 37A:
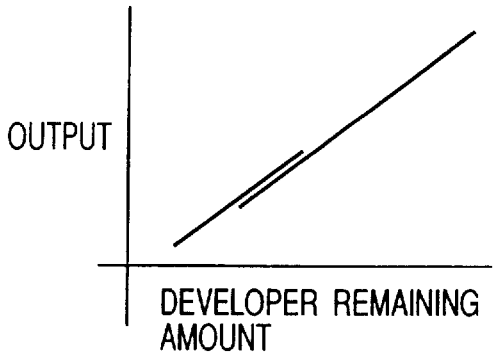
FIG. 37A, 37B, 37C, 37D and 37E are graphs showing a relation between a detected value from the respective developer remaining amount detecting means and a developer remaining amount in accordance with the present invention, respectively.

Referring to FIGS. 37A, 37B, 37C, 37D and 37E, the axis of the abscissa represents a developer remaining amount indicating value, whereas the axis of the ordinate represents an output value, that is, a detected value. If no detection error exists between the detected results of the first developer remaining amount detecting means and the second developer remaining amount detecting means, as shown in FIG. 37A, there arises no problem even if the detected result of the first developer remaining amount detecting means is shifted to the detected result of the second developer remaining amount detecting means at any portion within the limit that the detectable regions of the first and second developer remaining amount detecting means are overlapped with each other.

Figure 37B:
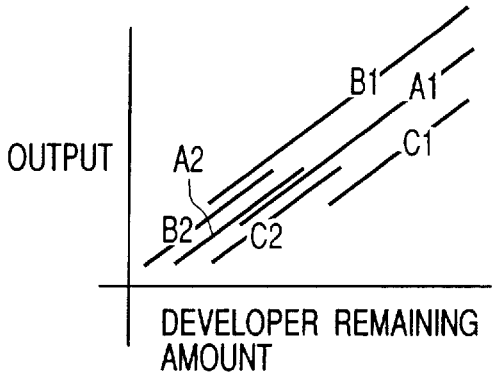

However, in fact, although it is presumed that the manufacturing variation, the detecting variation of the detecting circuit, etc., are main factors, the detection error shown in FIG. 37B occurs. In FIG. 37B, a straight line A1 is representative of a case of the detected value of the first developer remaining amount detecting means being ideal, that is, there is no detection error, whereas straight lines B1 and C1 represent the case of the detection error. Accordingly, the detection error becomes larger as the straight lines B1 and C1 are apart from each other.

In addition, a straight line A2 represents a case in which the detected value of the second developer remaining amount detecting means is ideal, that is, there is no detection error, whereas straight line B2 represents the case of a detection error.

Figure 37C:
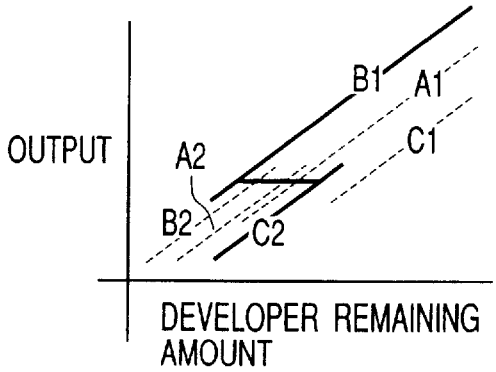

FIG. 37C shows the case of the combination of the first developer remaining amount detecting means showing the straight line B1 with the second developer remaining amount detecting means showing the straight line C2 by using the developer remaining amount detecting means with the above relation. In this case, even if the detecting system is shifted on any portion where the detectable regions are overlapped with each other, the remaining amount of developer as an indicating value is greatly increased, to thereby perplex the user.

Figure 37D:
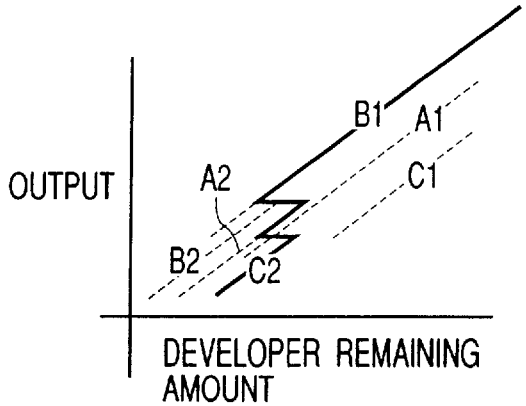

On the contrary, as shown in FIG. 37D, if the remaining amount of developer enters the overlapped portion, the remaining amount of developer is indicated by the average value of two detected values, and the detection of the developer remaining amount is completely shifted to the second developer remaining amount detecting means on the detectable portion of the first developer remaining amount detecting means. This system reduces the perplexity of the user if occasions demand, and the possibility that a value apart from the actual value is indicated is low.

Also, assuming that the detected value of the first developer remaining amount detecting means is A1, the weight of the first developer remaining amount detecting means is a, the detected value of the second developer remaining amount detecting means is A2, the weight of the first developer remaining amount detecting means is b (a+b=1.0), the overlapped portion is sectioned, for example, into four portions as follows.

Before a first stage (a=1.0, b=0.0), the developer remaining amount estimate A1×1.0+A2×0.0;

in the first stage (a=0.8, b 0.2), the developer remaining amount estimate=A1×0.8+A2×0.2;

in a second stage (a=0.6, b=0.4), the developer remaining amount estimate=A1×0.6+A2×0.4;

in a third stage (a=0.4, b=0.6), the developer remaining amount estimate=A1×0.4+A2×0.6;

in a fourth stage (a=0.2, b=0.8), the developer remaining amount estimate=A1×0.2+A2×0.8; and after the fourth stage (a=0.0, b=1.0), the developer remaining amount estimate A1×0.0+A2×1.0.

In this way, the gradually shifting system is effective, and smoother shifting can be conducted as the number of sections increases more.

Figure 39:
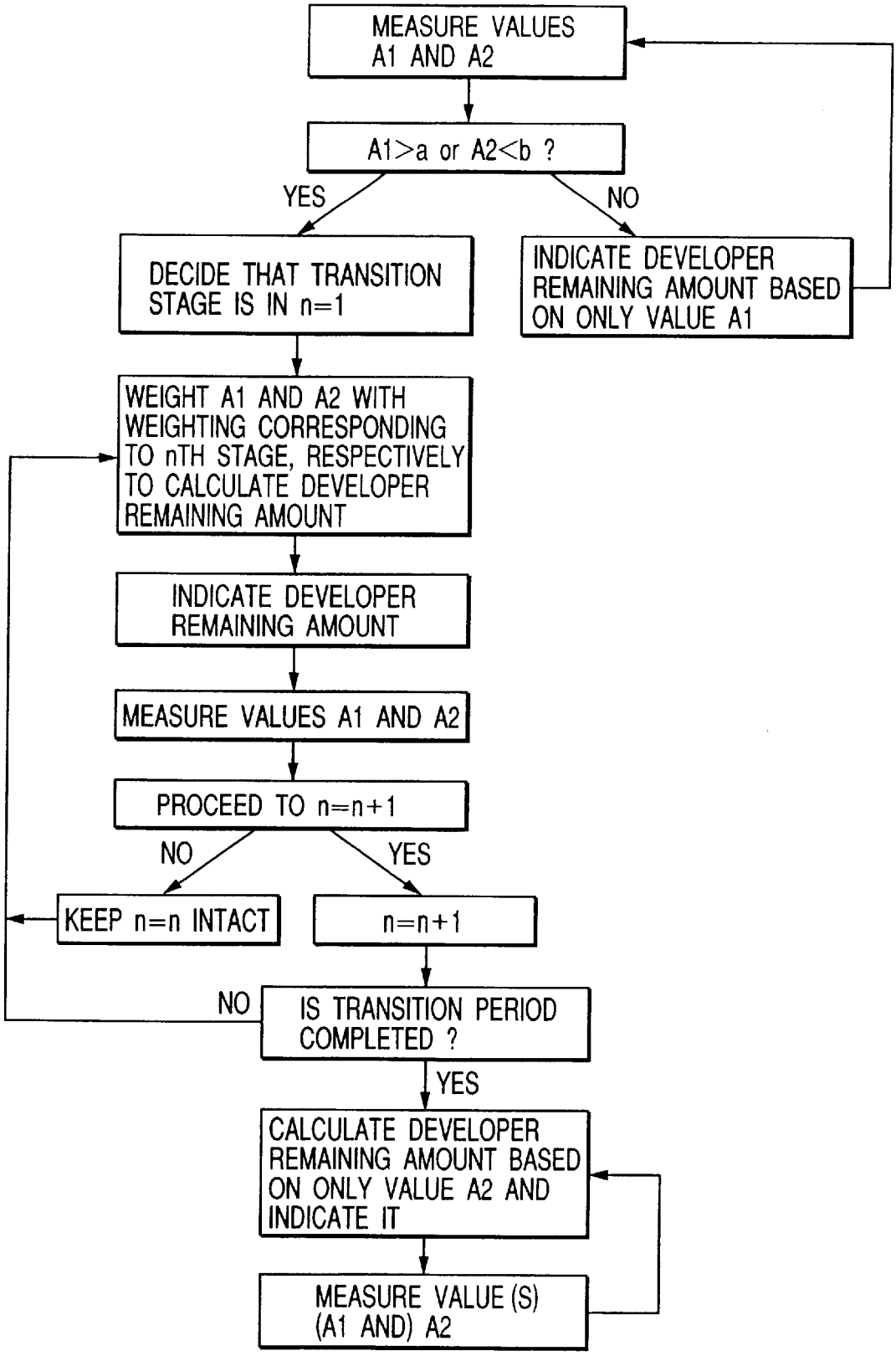
FIG. 39 is a flowchart showing the successive detection of the developer remaining amount in accordance with an embodiment of the present invention.

Subsequently, an embodiment of a control method in the case of conducting the detection in a mode shown in FIG. 37D will be described with reference to a flowchart shown in FIG. 39.

According to this embodiment, the developer remaining amount information (detected values A1 and A2) detected by the first and second developer remaining amount detecting means is inputted to a CPU. In the CPU, the detected values Al and A2 are compared with predetermined values a and b in large and small relations, and it is judged whether only the first developer remaining amount detecting means is effective in the present developer remaining amount state, or both of the first and second developer remaining amount detecting means are effective in the present developer remaining amount state.

As a result, if only the first developer remaining amount detecting means is effective, only the detected value A1 is converted into the amount of developer to indicate the remaining amount of developer. If both of the first and second developer remaining amount detecting means are effective, it is judged from the detected values A1 and A2 that a shifting period is an n-th stage, and the respective detected values are weighted to calculate and indicate the amount of developer.

The above operation is repeated, and thereafter, if it is judged from the detected values A1 and A2 that the shifting period is completed, that is, if only the second developer remaining amount detecting means is effective, only the detected value A2 is converted into the remaining amount o f developer to indicate the remaining amount of developer.

In this embodiment, although the developer remaining amount information A1 and A2 are detected every time development is conducted, a detectin g timing is not particularly limited.

Figure 37E:
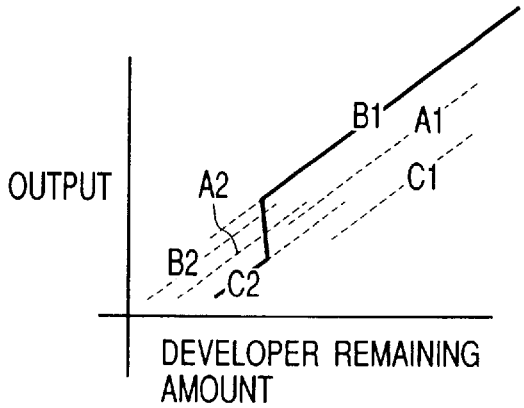

According to another method, as shown in FIG. 37E, even if the indicated value of the developer remaining amount is held, and the detected result by the second developer remaining amount detecting means is employed at the time where the detected value of the second developer remaining amount detecting means is lower than the held value, the indicated remaining amount of developer is not suddenly increased, thereby being capable of reducing the perplexity of the user.

Figure 40:
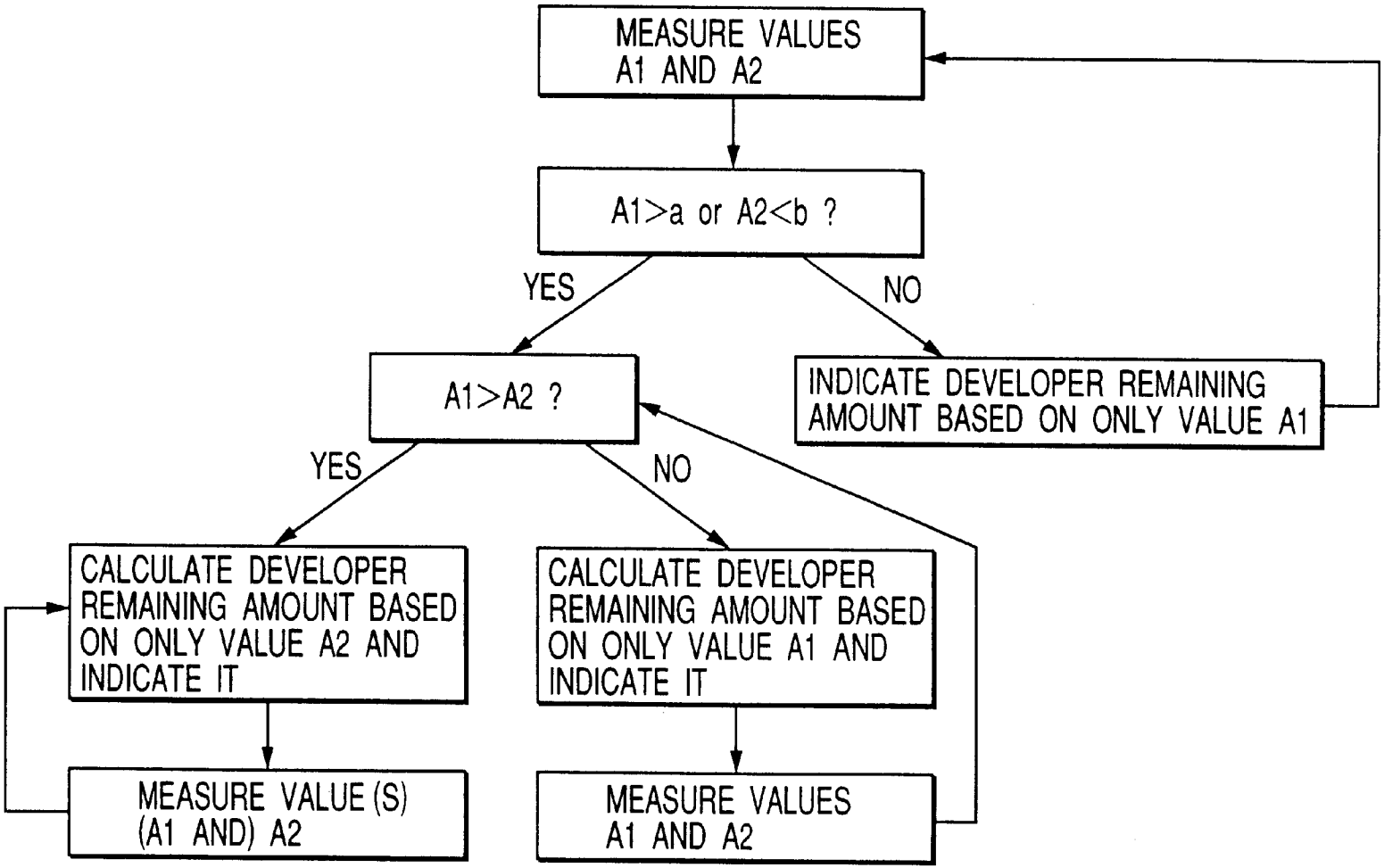
FIG. 40 is a flowchart showing the successive detection of the developer remaining amount in accordance with another embodiment of the present invention.

Subsequently, an embodiment of a control method in the case of conducting the detection in a mode shown in FIG. 37E will be described with reference to a flowchart shown in FIG. 40.

According to this embodiment, the developer remaining amount information (detected values A1 and A2) detected by the first and second developer remaining amount detecting means is inputted to the CPU. In the CPU, the detected values A1 and A2 are compared with predetermined values a and b, and it is judged whether only the first developer remaining amount detecting means is effective in the present developer remaining amount state, or both of the first and second developer remaining amount detecting means are ineffective in the present developer remaining amount state.

As a result, if only the first developer remaining amount detecting means is effective, only the detected value A1 is converted into the amount of developer to indicate the remaining amount of developer. If both of the first and second developer remaining amount detecting means are ineffective, only the detected value A1 is converted into the amount of developer to indicate the amount of developer.

The above operation is repeated, and thereafter, if only the detected value A2 become effective, only the detected value A2 is converted into the remaining amount of developer to indicate the remaining amount of developer.

In this embodiment, although the developer remaining amount information A1 and A2 are detected every time development is conducted, a detecting timing is not particularly limited.

As described above, in the case where the regions detectable by a plurality of developer remaining amount detecting means are partially overlapped with each other, control is optimized, thereby being capable of indicating the remaining amount of developer which makes it difficult to perplex the user.

Figure 38A:
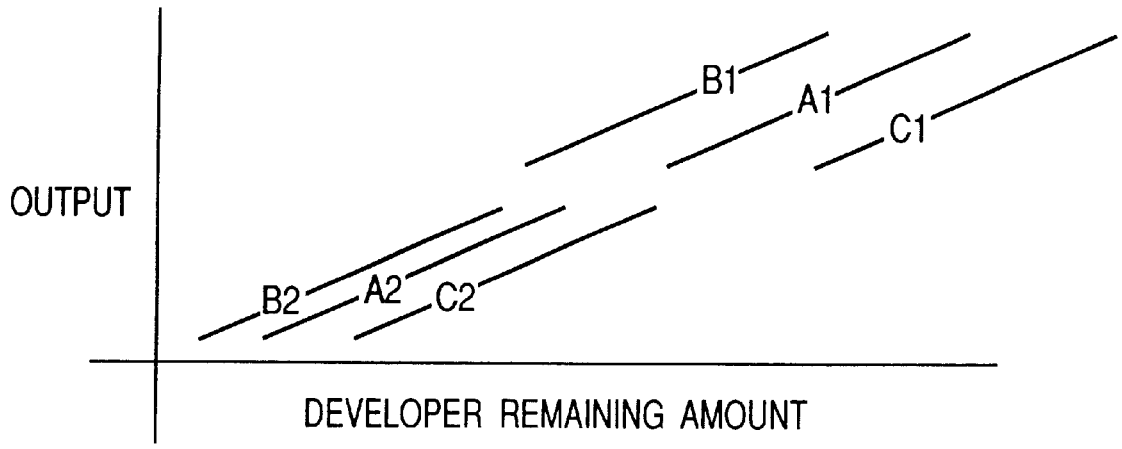
FIGS. 38A and 38B are graphs showing a relation between a detected value from the respective developer remaining amount detecting means and a developer remaining amount in accordance with the present invention, respectively.

As described above, in the above embodiment, as shown in FIGS. 37A to 37E, the detectable regions overlap with each other. However, there is the possibility that the regions where the remaining amount of developer is detectable do not overlap each other at all, as shown in FIG. 38A.

Figure 38B:
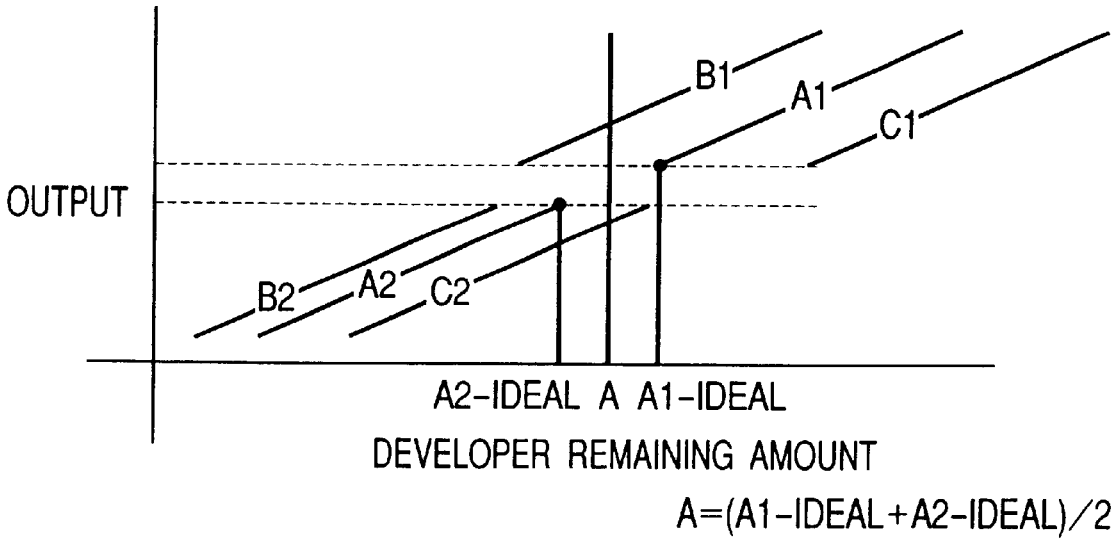

In this case, as shown in FIG. 38B, in the region where the remaining amount of developer cannot be detected by any developer remaining amount detecting means, it is desirable that if a level of the developer is kept constant, for example, by a value such as the average value A of the minimum value A1-ideal of the detected ideal value of the first developer remaining amount detecting means and the maximum value A2-ideal of the detected ideal value of the second developer remaining amount detecting means, and that value is used immediately when the second developer remaining amount detecting means can detect the remaining amount of developer to estimate the remaining amount of developer under the control. It is needless to say that a center value may be used instead of the average value of the minimum value A1-ideal and the maximum value A2-ideal, or the actual value of the first developer remaining amount detecting means may be used In such a case, when an error in detection exists and the indication of the remaining amount of developer is increased, similar control is needed from the point of view of indicating a more accurate detection result.

Figure 41:
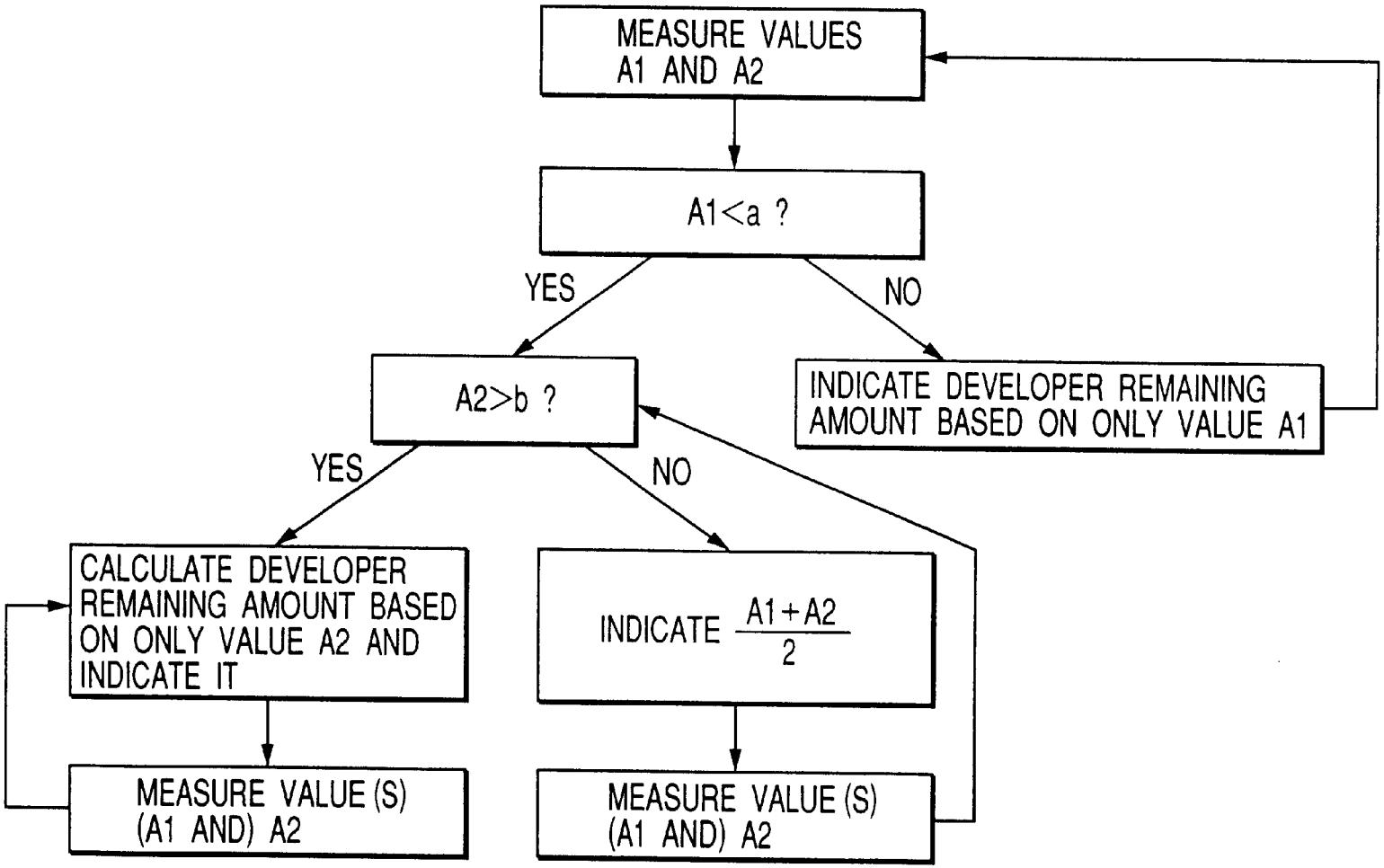
FIG. 41 is a flowchart showing the successive detection of the developer remaining amount in accordance with still another embodiment of the present invention.

Subsequently, an embodiment of a control method in the case of conducting the detection in a mode shown in FIG. 38B will be described with reference to a flowchart shown in FIG. 41.

According to this embodiment, the developer remaining amount information (detected values A1 and A2) detected by the first and second developer remaining amount detecting means is inputted to the CPU. In the CPU, the detected values A1 and A2 are compared with predetermined values a and b, and it is judged whether only the first developer remaining amount detecting means is effective in the present developer remaining amount state, or both of the first and second developer remaining amount detecting means are ineffective in the present developer remaining amount state.

As a result, if only the first developer remaining amount detecting means is effective, only the detected value A1 is converted into the amount of developer to indicate the remaining amount of developer. If the first developer remaining amount detecting means is also ineffective and the second developer remaining amount detecting means is ineffective, the average value of the minimum value detectable by the first developer remaining amount detecting means and the maximum value detectable by the second developer remaining amount detecting means is indicated. On the other hand, if the first developer remaining amount detecting means is ineffective and the second developer remaining amount detecting means is effective, only the detected value A2 is converted into the remaining amount of developer to indicate the remaining amount of developer.

The above operation is repeated.

In this embodiment, although the developer remaining amount information A1 and A2 are detected every time development is conducted, a detecting timing is not particularly limited.

In this embodiment, only the control using two kinds of developer remaining amount detecting means was described. However, it is needless to say that the same effects can be obtained by using the above respective control methods described in this embodiment even if not two kinds, but a plurality of developer remaining amount detecting means are provided.

(Fourth Embodiment)

Subsequently, another embodiment of the present invention will be described. This embodiment is identical with the first embodiment except that the following system is employed as the first developer remaining amount detecting means.

As the first developer remaining amount detecting means in this embodiment, there is applied a system in which the light emitting period of a laser that functions as exposing means is integrated and stored, and the depleted amount of developer is detected in accordance with the integrated period. That is, in this embodiment, a conversion table or a conversion expression which convert the light emitting period of the laser into the depleted amount of developer is installed in the main body, and the depleted amount of developer is determined in accordance with the converting method.

The first developer remaining amount detecting means in this embodiment can basically detect a state of "unused developer" to a state of "occurrence of a blank area in an image". However, there is the tendency that the depleted amount is different between a case of continuing to output, for example, a low-printing-ratio character pattern and a case of continuing to output an image pattern with a relatively high printing ratio, etc. even if the integrated light emitting period is the same, and the precision in detection deteriorates as the toner is depleted.

Figure 42:
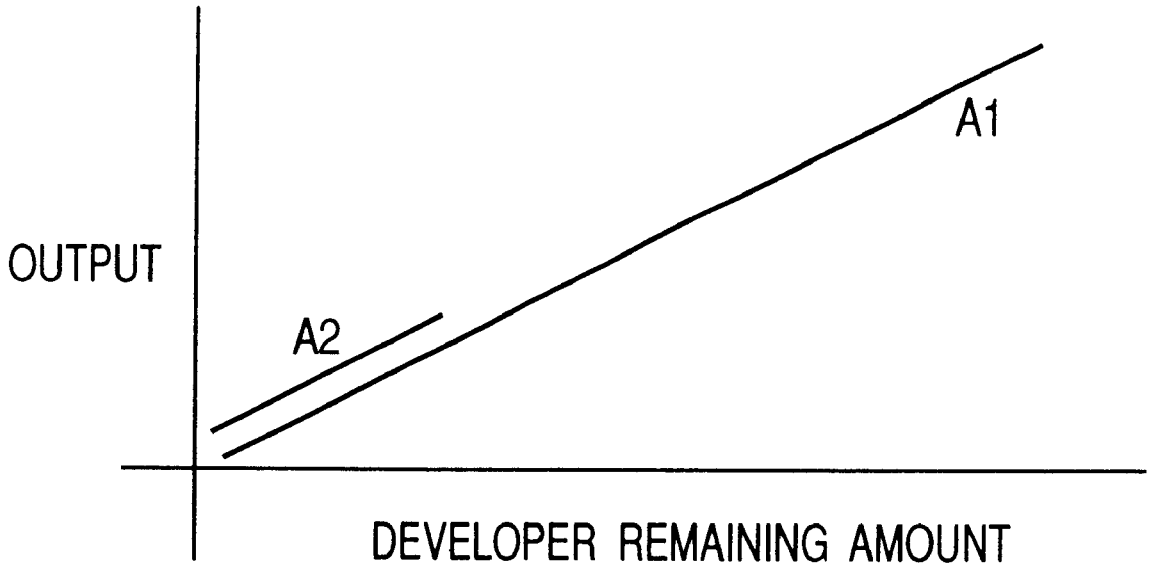
FIG. 42 is a graph showing a relation between a detected value from the respective developer remaining amount detecting means and a developer remaining amount in accordance with the present invention.

FIG. 42 shows a transition of the integrated light emitting period of a laser with respect to the remaining amount of developer of the first developer remaining amount detecting means (a straight line A1 in FIG. 42) and a transition of the capacitance with respect to the remaining amount of developer of the second developer remaining amount detecting means (a straight line A2 in FIG. 42) in this embodiment.

Likewise, in this embodiment, if no detection error exists, the detected value of the first developer remaining amount detecting means may be used until a blank area occurs in an image without shifting the detected value to the second developer remaining amount detecting means. However, as described above, because an error in the detected value of the first developer remaining amount detecting means increases more as the used amount of developer is larger, the second developer remaining amount detecting means is used so as to enhance a precision in detection from a time where the remaining amount of developer is small to a time where the blank area occurs in the image.

A shift of the detected value from the first developer remaining amount detecting means to the second developer remaining amount detecting means will be described hereinafter.

Similarly, in this case, as described in the third embodiment, the gradually shifting system or such a control that the indicated result of the remaining amount of developer is not largely increased may be applied. However, the second developer remaining amount detecting means that detects a state where the amount of developer is small is higher in the precision of detection, and because the detection higher in precision is rapidly demanded in the state just before the blank area occurs in the image, only the output result of the second developer remaining amount detecting means, which is high in the precision of detection, may be employed immediately after the second developer remaining amount detecting means that detects a state where the amount of developer is small, can detect the remaining amount of developer.

As described above, in the case where the developer remaining amount detectable regions are overlapped with each other only when the amount of developer is small, the control described in the third embodiment is used, or the detected result higher in precision is instantly used, thereby providing a developer remaining amount indication high in advantages to the user.

Figure 43:
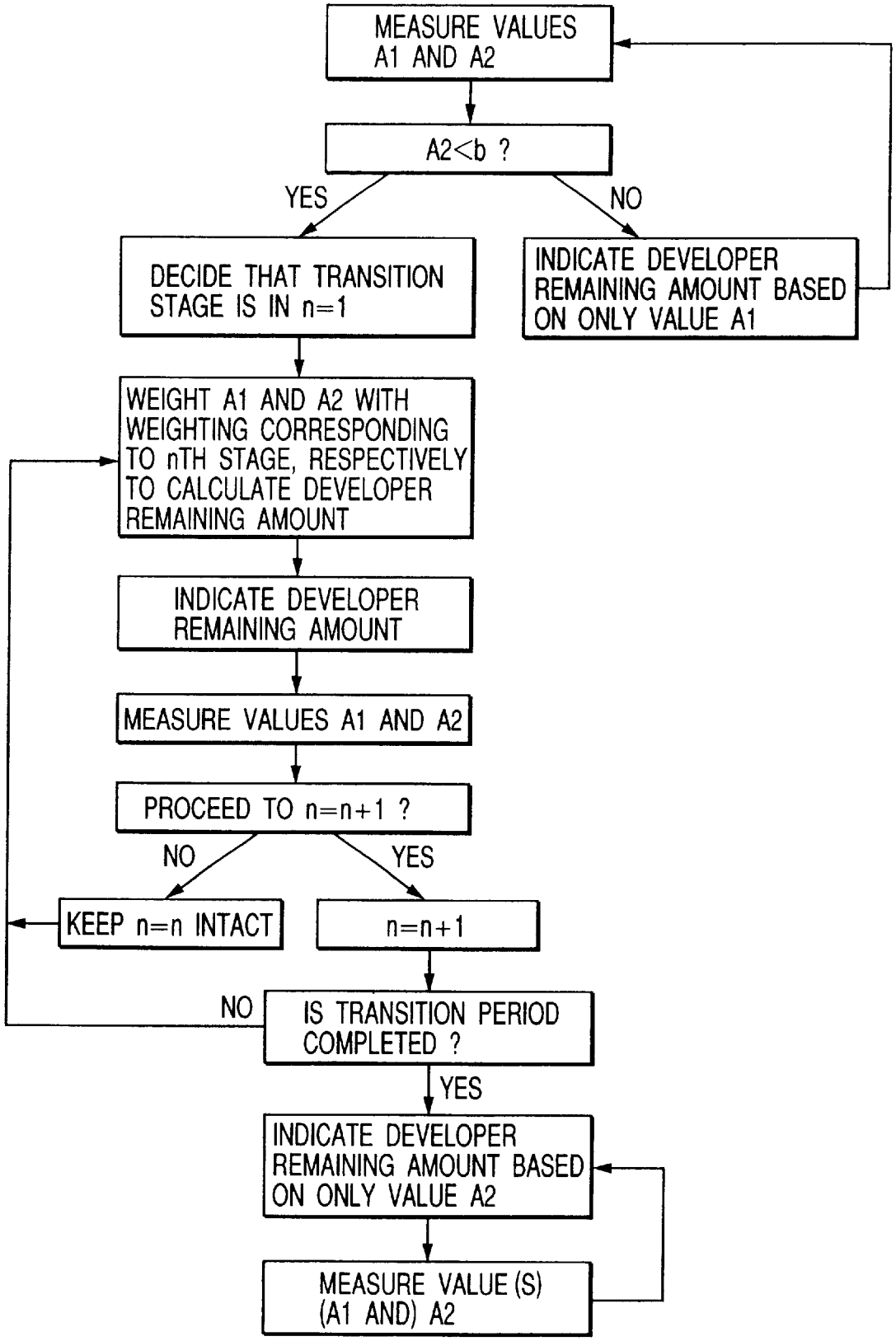
FIG. 43 is a flowchart showing the successive detection of the developer remaining amount in accordance with still another embodiment of the present invention.

Subsequently, an embodiment of a control method in the case of conducting the detection in a mode shown in FIG. 42 will further be described with reference to a flowchart shown in FIG. 43.

According to this embodiment, the developer remaining amount information (detected values A1 and A2) detected by the first and second developer remaining amount detecting means is inputted to the CPU. In the CPU, the detected value A2 are compared with a predetermined value b, and it is judged whether the second developer remaining amount detecting means is effective in the present developer remaining amount state, or not.

As a result, if the second developer remaining amount detecting means is ineffective, only the detected value A1 is converted into the amount of developer to indicate the remaining amount of developer. If the second developer remaining amount detecting means is effective, it is judged from the detected value A2 that a shifting period is an n-th stage, and the respective detected values are weighted to calculate and indicate the remaining amount of developer.

The above operation is repeated, and thereafter, the shifting period is completed, and only the detected value A2 is converted into the remaining amount of developer to indicate the remaining amount of developer.

In this embodiment, although the developer remaining amount information A1 and A2 are detected every time development is conducted, the detecting timing is not particularly limited.

(Fifth Embodiment)

Figure 44:
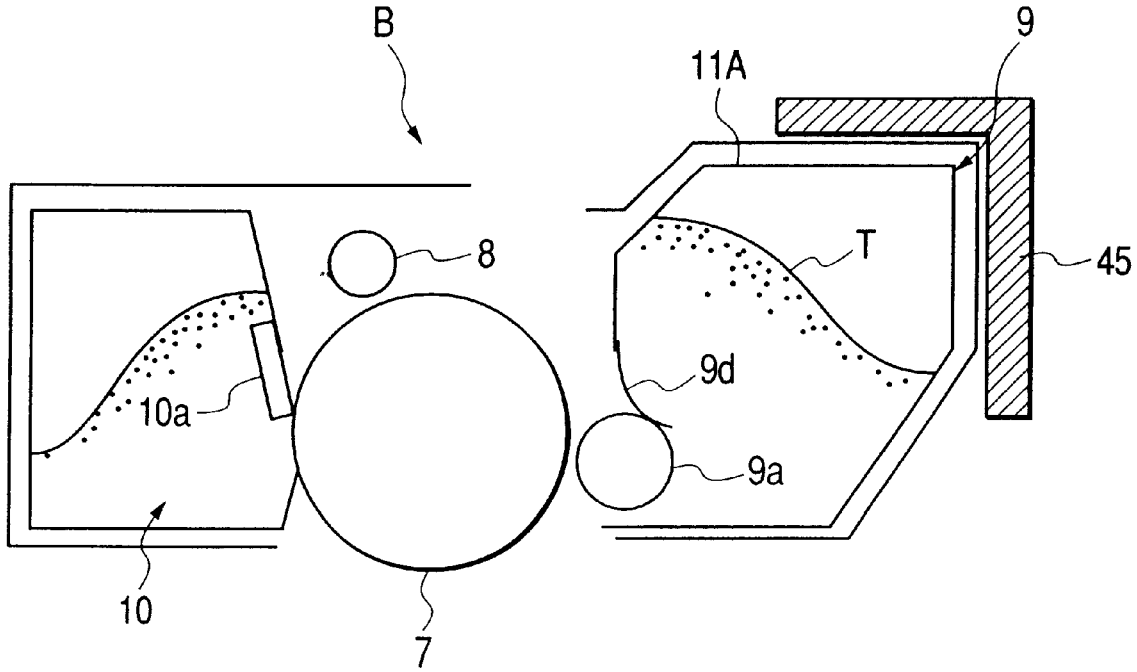
FIG. 44 is a longitudinal cross-sectional view showing a process cartridge in accordance with still another embodiment of the present invention.

Subsequently, still another embodiment of the present invention will be described with reference to FIG. 44. FIG. 44 shows only the process cartridge B installed in an electrophotographic image forming apparatus. However, it should be understood that this embodiment is identical in structure with the first embodiment except that the following system is employed as the first developer remaining amount detecting means.

As the first developer remaining amount detecting means in this embodiment, there is applied a system in which an electrically conductive plate electrode 45 shown in FIG. 44 is disposed outside of a developer container 11A, and the remaining amount of developer is estimated from a capacitance value between the developing roller 9*a* and the electrically conductive plate 45.

According to the system of this embodiment, because an interval between the paired developing roller 9*a* and electrically conductive plate 45 is large, the variable of the capacitance is relatively small so that the detection is enabled since the amount of developer is large until a blank area occurs in an image although a precision in detection is not so high.

Figure 45:
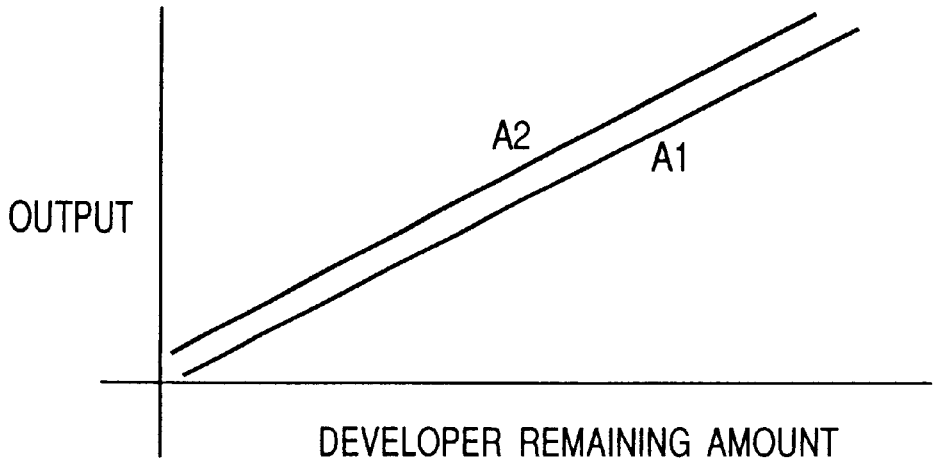
FIG. 45 is a graph showing a relation between a detected value from the respective developer remaining amount detecting means and a developer remaining amount in accordance with the present invention.

In this embodiment, as shown in FIG. 45, two developer remaining amount detecting means can detect the remaining amount of developer regardless of the amount of developer, respectively, as shown in FIG. 45. In FIG. 45, the detected value of the first developer remaining amount detecting means is obtained from the straight line A1, and the detected value of the second developer remaining amount detecting means is obtained from the straight line A2.

However, because both of those two developer remaining amount detecting means have the detection error, the following control operation is conducted to estimate the remaining amount of developer.

There is the tendency that the first developer remaining amount detecting means always have a substantially constant detection error regardless of the remaining amount of developer, whereas the second developer remaining amount detecting means increases the detection error as the remaining amount of developer becomes smaller.

For that reason, assuming that the detected value of the first developer remaining amount detecting means is A1, the weight of the first developer remaining amount detecting means is a, the detected value of the second developer remaining amount detecting means is A2, and the weight of the first developer remaining amount detecting means is b (a+b=1.0), the entire amount of developer is sectioned into, for example, six stages, as follows:

In a first stage (a=0.0, b=1.0), the estimated value of the developer remaining amount=A1×0.0+A2×1.0;

in a second stage (a=0.2, b=0.8), the estimated value of the developer remaining amount=A1×0.2+A2×0.8;

in a third stage (a 0.4, b=0.6), the estimated value of the developer remaining amount A1×0.4 +A2×0.6;

in a fourth stage (a=0.6, b=0.4), the estimated value of the developer remaining amount=A1×0.6+A2×0.4;

in a fifth stage (a=0.8, b=0.2), the estimated value of the developer remaining amount=A1×0.8+A2×0.2; and in a sixth stage (a=1.0, b=0.0), the estimated value of the developer remaining amount=A1×1.0+A2×0.0.

In this way, a system in which the detected value of the second developer remaining amount detecting means is much weighted at the first, and the weight is gradually shifted to the first developer remaining amount detecting means which can conduct the more accurate detection.

In this embodiment, a description was given of the control of the means having the tendency that the first developer remaining amount detecting means always have a substantially constant detection error regardless of the remaining amount of developer, whereas the second developer remaining amount detecting means increases the detection error as the remaining amount of developer becomes smaller. The control systems including other cases will be put in order as follows:

1) The optimum control is changed in accordance with any of these situations: (1) the precision of two developer remaining amount detecting means is enhanced, (2) the precision is deteriorated and (3) the precision is not substantially changed as the developer is depleted.

2) The detected result of the above type (1) may be set to be lower in its weight in an initial stage and become higher in weight as the developer is depleted.

3) The detected result of the above type (2) may be set to be higher in its weight in an initial stage and become lower in the weight as the developer is depleted.

4) The detected result of the above type (3) may be weighted to the same degree from the initial stage to the occurrence of a blank area in an image.

5) In the case of providing the detecting means of the same type, it is preferable that an average value of those values is employed.

Figure 46:
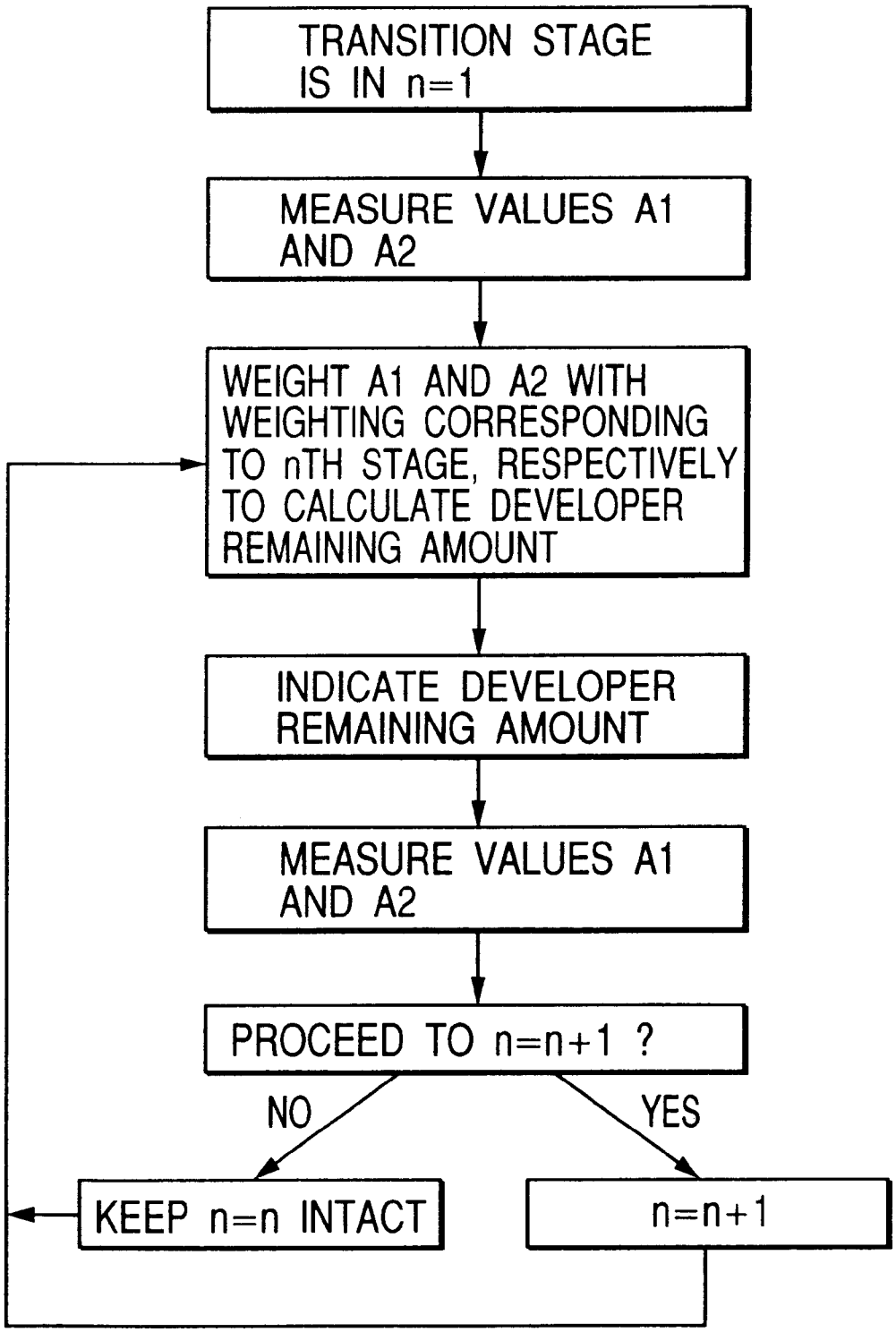
FIG. 46 is a flowchart showing the successive detection of the developer remaining amount in accordance with still another embodiment of the present invention.

Subsequently, an embodiment of a control method in the case of conducting the detection in a mode shown in FIG. 45 will be further described with reference to a flowchart shown in FIG. 46.

According to this embodiment, the developer remaining amount information (detected values A1 and A2) detected by the first and second developer remaining amount detecting means is inputted to the CPU. In the CPU, it is judged from the detected values A1 and A2 that a shifting period is an n-th stage, and the respective detected values are weighted to calculate and indicate the remaining amount of developer.

The above operation is repeated.

In this embodiment, although the developer remaining amount information A1 and A2 are detected every time development is conducted, the detecting timing is not particularly limited.

(Sixth Embodiment)

Figure 47:
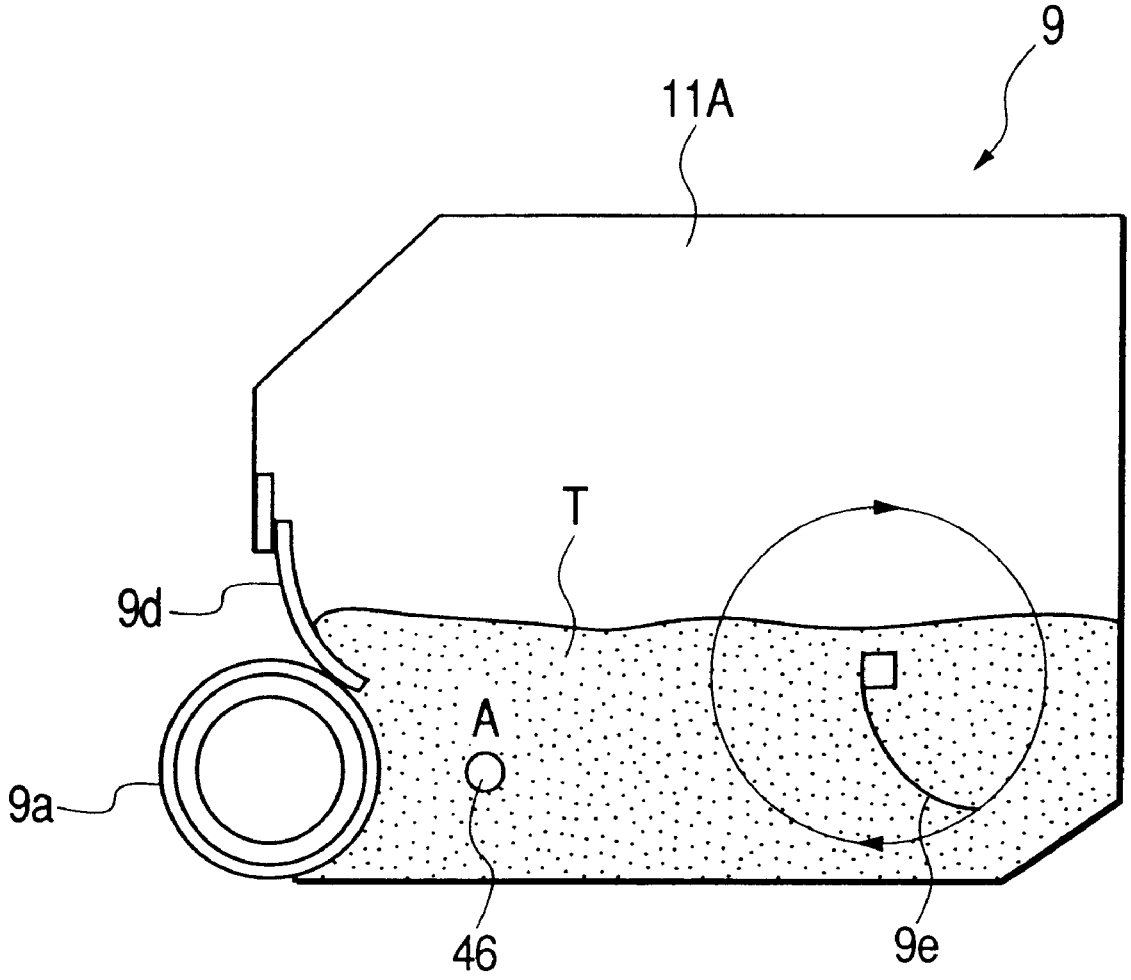
FIG. 47 is a longitudinal cross-sectional view showing only a developing means portion of the process cartridge in accordance with still another embodiment of the present invention.

Subsequently, still another embodiment of the present invention will be described with reference to FIG. 47. FIG. 47 shows only the developing means 9 of the process cartridge B installed in an electrophotographic image forming apparatus. However, it should be understood that this embodiment is identical in structure with the first embodiment except that the following system is employed as the second developer remaining amount detecting means.

As the second developer remaining amount detecting means in this embodiment, there is applied a system in which an electrically conductive bar 46 is disposed in parallel with an axial line of the developing roller 9*a* as shown in FIG. 47, and the capacitance between the developing roller 9*a* and the electrically conductive bar 46 is measured to mainly detect the remaining amount of developer in the vicinity of the developing roller.

According to the system of this embodiment, the successive remaining amount detection can be conducted if the variable of the capacitance is made large. However, in order not to impede the flow of the developer, a surface area opposed to the developing roller 9*a* is reduced and is not allowed to extremely approach the developing roller 9*a*. For that reason, it is difficult to increase the variable of the capacitance, and in general, only the presence/absence of the developer is detected.

Figure 48:
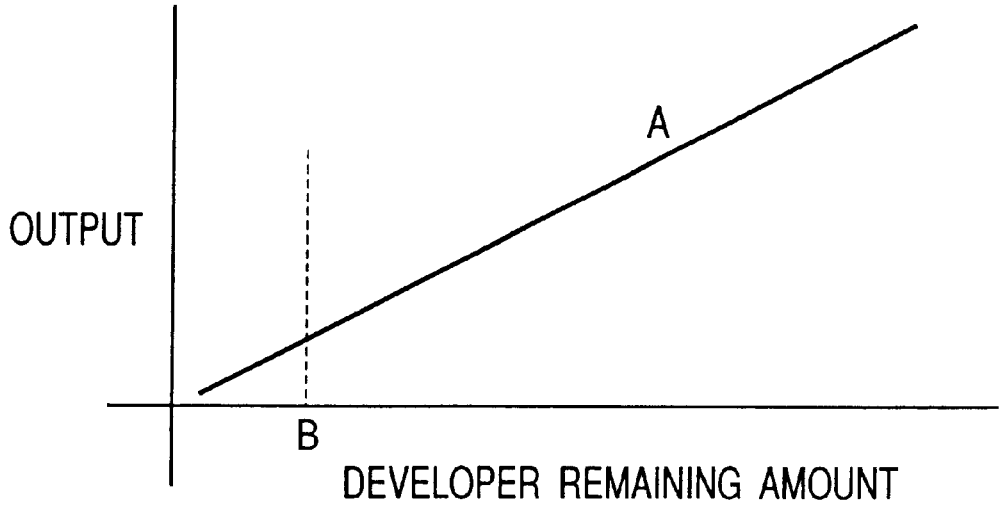
FIG. 48 is a graph showing a relation between a detected value from the respective developer remaining amount detecting means and a developer remaining amount in accordance with the present invention.

As shown in FIG. 48, in the case where a range A detectable by the first developer remaining amount detecting means includes the presence/absence detecting portion B, because the presence/absence detection is higher in the precision of detection, it is preferable that the detected value is employed immediately as soon as the presence/absence detection is conducted.

Figure 49:
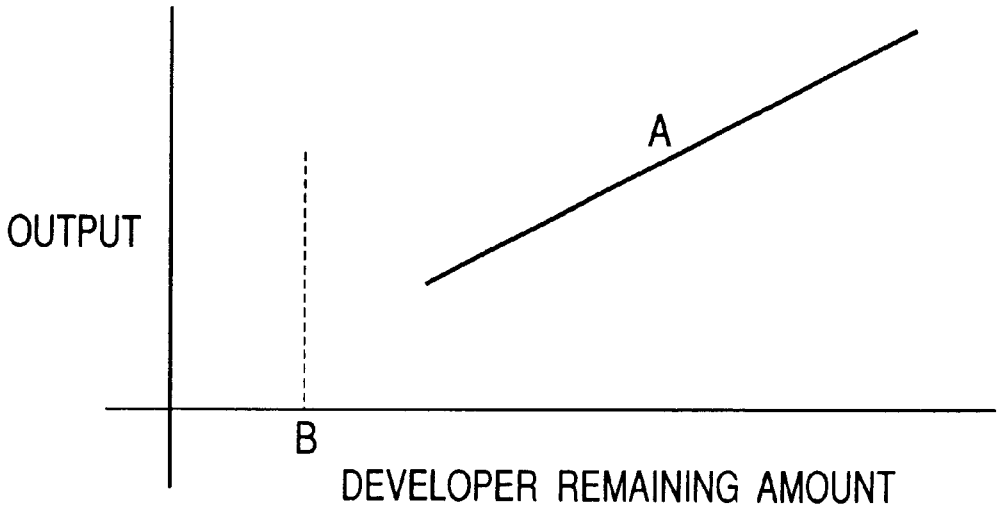
FIG. 49 is a graph showing a relation between a detected value from the respective developer remaining amount detecting means and a developer remaining amount in accordance with the present invention.

As shown in FIG. 49, in the case where the range A detectable by the first developer remaining amount detecting means does not include the presence/absence detecting portion B, because the presence/absence detection is higher in the precision of detection, since it is difficult to conduct an indication in an analog manner so that the indicated remaining amount of developer is gradually changed, so that for example, "a blank area occurrence warning state" which is a state before the indication of "a state just before a blank area occurs in an image" by one stage may be indicated during that time. It is preferable that the detected value is employed immediately as soon as the presence/absence detection is conducted because the presence/absence detection is higher in the precision of detection.

(Seventh Embodiment)

Figure 50:
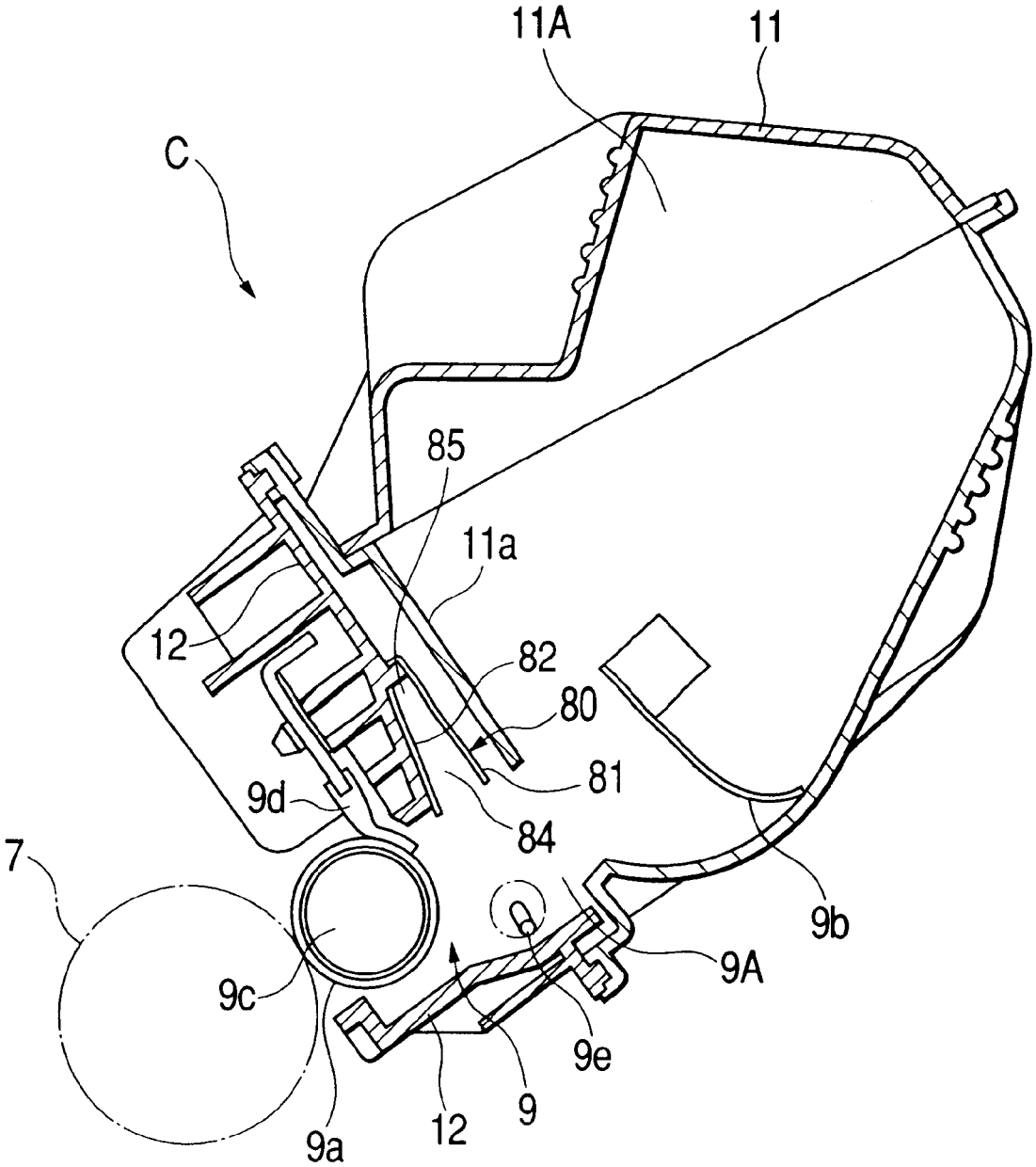
FIG. 50 is a longitudinal cross-sectional view showing a developing device having developer remaining amount detecting means in accordance with still another embodiment of the present invention, respectively.

FIG. 50 shows an embodiment of a developing device C which is made into a cartridge in accordance with another embodiment of the present invention.

The developing device C of th is embodiment includes a developer bearing member such as the developing roller 9*a* and the developing chamber 9A contains the toner therein in order to supply the developer to the developer bearing member, and makes the developer bearing member, the developing chamber 9A and a develop ing frame 11 made of pla stic integrally into a cartridge. That is, the developing device C of this embodiment makes the structural portions of the developing device of the process cartridge B described in the first to sixth embodiments into a unit, that is, it can be considered that the respective members except for the photosensitive drum 7, the charging means 8 and the cleaning means 10 from the process cartridge B are integrated together. Accordingly, all the developing device structural portions and the developer amount detecting means structures as described in the first to sixth embodiments are applied to the developing device of this embodiment similarly. Therefore, the above description made in the first to sixth embodiments is applied to a description of those structures and operation.

It is needless to say that the third electrode 83 can be provided in the developing device of this embodiment similarly.

(Eighth Embodiment)

In the above embodiments 1 to 7, as the developer remaining amount detecting means, there were described a system in which electrode members are arranged to use a change in the capacitance, or the system in which the light emitting period of the exposing means for forming an electrostatic latent image on the photoelectric drum 7, that is, a laser or an LED is integrated to estimate the depleted amount of developer, and the remaining amount of developer is detected in accordance with the estimated result. However, even if the following systems are employed, similar effects as those in the above embodiments can be obtained.

Figure 51B:
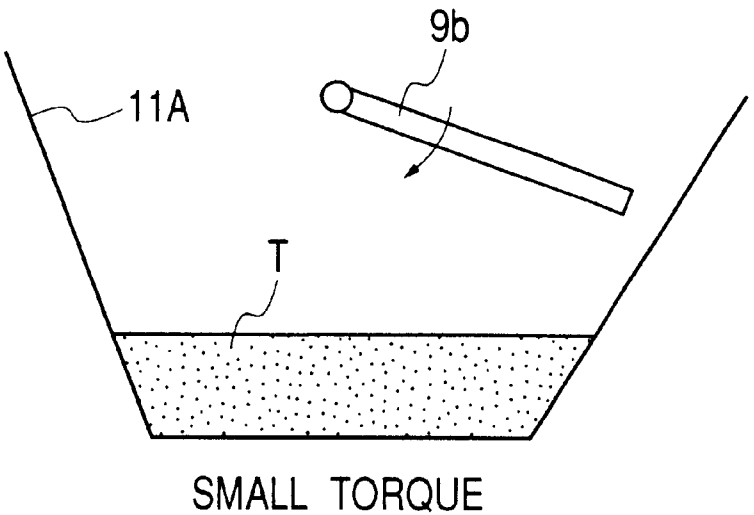
FIGS. 51A and 51B are schematic structural diagrams showing the developer remaining amount detecting means in accordance with another embodiment of the present invention, respectively.
Figure 51A:
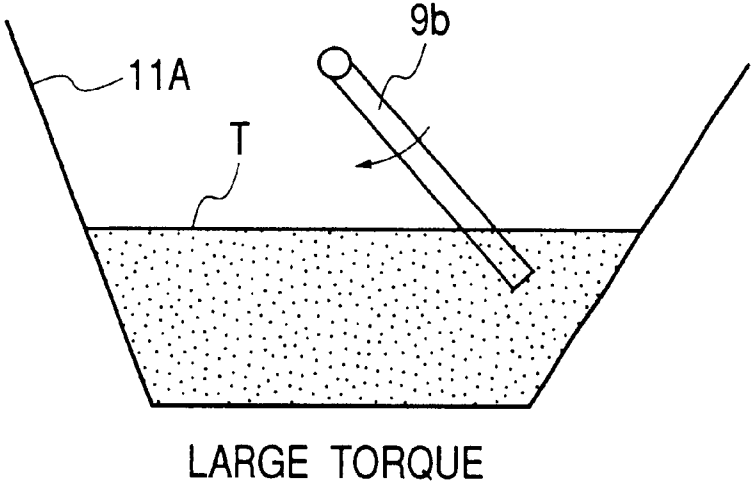

(1) As shown in FIGS. 51A and 51B, a system is provided in which a variation in a force exerted on an agitating feeding member 9*b* that agitates and feeds the developer T within the developer container 11A, or a variation in torque in the case where the developer is agitated and fed by rotation, etc., are read to detect the remaining amount of developer within the developer container 11A.

Figure 52B:
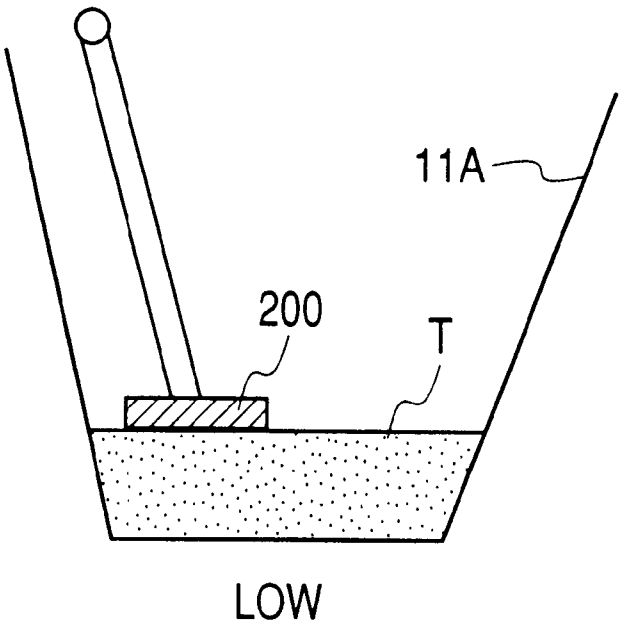
FIGS. 52A and 52B are schematic structural diagrams showing the developer remaining amount detecting means in accordance with still another embodiment of the present invention, respectively.
Figure 52A:
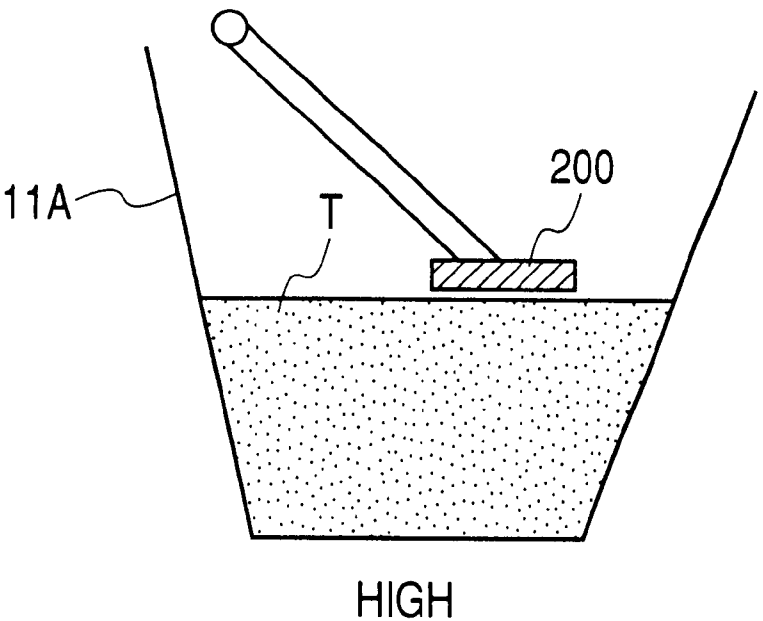

(2) As shown in FIGS. 52A and 52B, a system is provided in which a substance 200 that follows the movement of the uppermost surface of the developer T within the developer container 11A is disposed, and the height of the substance 200 is measured to detect the remaining amount of developer.

(3) A system is provided in which the remaining amount of developer is detected by the weight of the developer T that remains within the developer container 11A.

Figure 53:
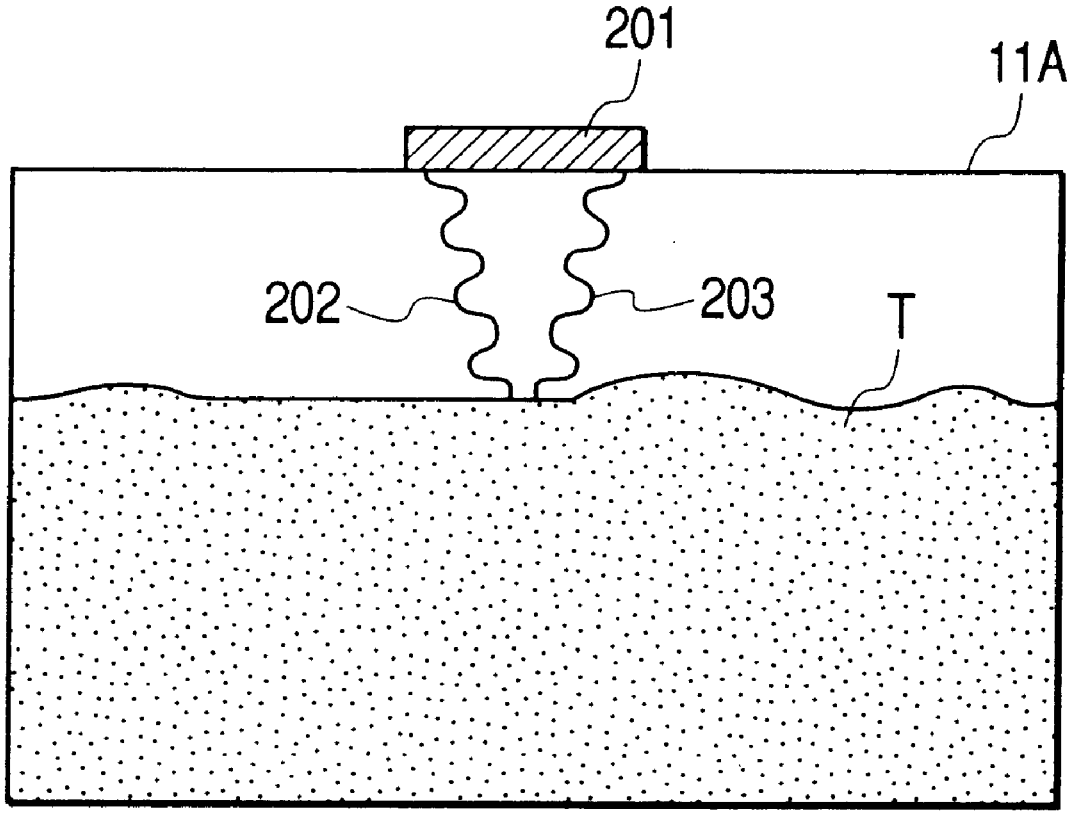
FIG. 53 is a schematic structural diagram showing the developer remaining amount detecting means in accordance with still another embodiment of the present invention; respectively.

(4) As shown in FIG. 53, a system is provided in which a light 202 is applied to a developer surface from a light emitting and light receiving element 201 located in the vicinity of the upper portion of the developer container 11A to measure a wavelength of a reflected light 203, the response time, and the travel distance substantially perpendicular to an incident angle, or to measure the height of the developer surface from the frequency of a reflected acoustic wave, etc., in the case where an acoustic wave is employed instead of light, thereby detecting the remaining amount of developer.

(5) A system is provided in which a coil is disposed within the developer container 11A, and the remaining amount of developer is detected by using a phenomenon that the magnetic permeability depends on the amount of developer that passes through the coil.

(6) A system in is provided in which the remaining amount of developer is falsely successively detected by the provision of a plurality of means described in the above (1) to (5).

According to the present invention described along the above respective first to eighth embodiments, the remaining amount of developer can be successively detected with a high precision.

Figure 57:
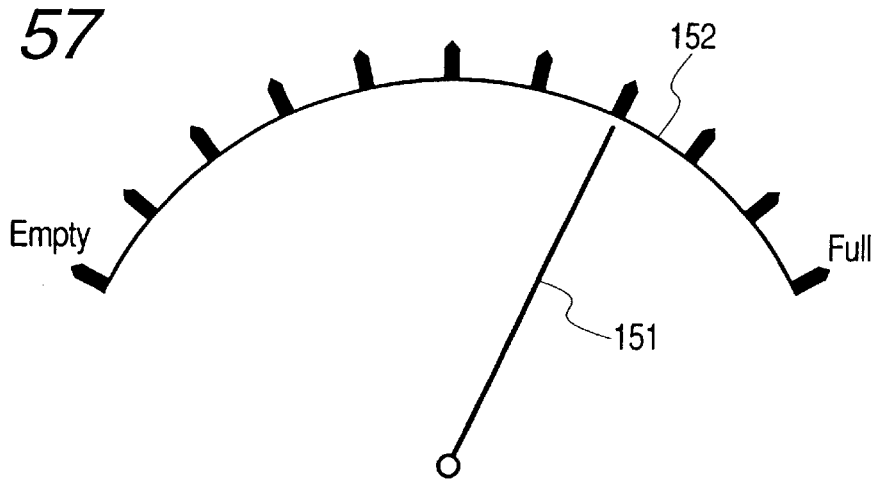
FIG. 57 is a diagram showing a developer amount indication in accordance with an embodiment of the present invention.
Figure 58:
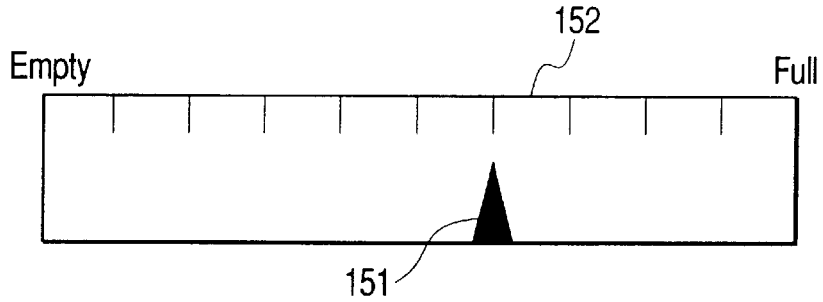
FIG. 58 is a diagram showing a developer amount indication in accordance with another embodiment of the present invention.

The developer remaining amount information from the developer amount detecting device is indicated by the developer amount indicating means. The developer amount indicating method will be described. For example, the detected information by the above-described developer amount detecting device is indicated on a terminal screen of a user's personal computer, etc., as shown in FIGS. 57 and 58. In FIGS. 57 and 58, a portion of a gauge 152 indicated by a pointer that moves in accordance with the amount of developer notifies the user of the amount of developer.

Figure 59:
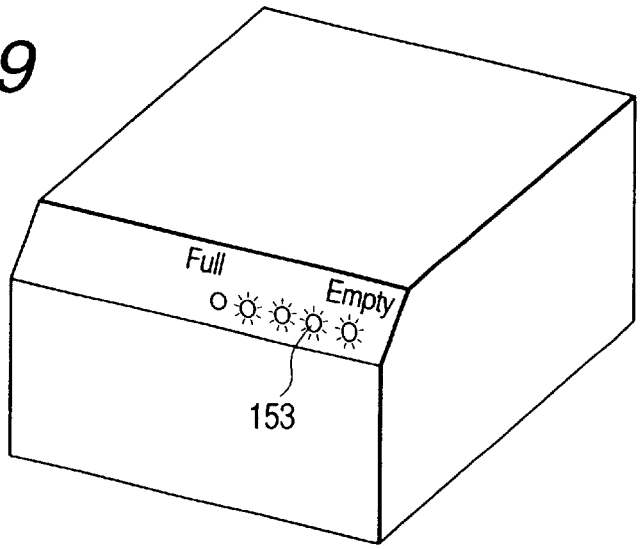
FIG. 59 is a diagram showing a developer amount indication in accordance with still another embodiment of the present invention.

Also, as shown in FIG. 59, an indicating portion such as an LED may be disposed directly on the main body of the electrophotographic image forming apparatus so as to flicker the LED 153 in accordance with the amount of developer.

The present invention is not limited to a case in which the amount of developer is successively detected over the entire region of 100% to 0% assuming that the amount of developer that is contained in the container is 100% at first. For example, the amount of developer within the container may be successively detected over the region of 50% to 0%. That the remaining amount of developer is 0% does not mean only that the developer completely goes short. For example, that the remaining amount of developer is 0% includes the case that the remaining amount of developer is reduced to the degree where a given image quality (developing quality) is not obtained even if the developer remains within the container.

As was described above, the above-described embodiments include a plurality of developer remaining amount detecting means for successively detecting the developer remaining amount within the developer container and are structured as follows:

(1) The developer remaining amounts detectable by the respective developer remaining amount detecting means are overlapped with each other, and values detected by the respective developer remaining amount detecting means are weighted, respectively, and an overlapped period is sectioned into a plurality of stages, and weighing is gradually shifted from the detected value of a previous developer remaining amount detecting means to the detected value of a succeeding developer remaining amount detecting means in each of the stages.

(2) The developer remaining amounts detectable by the respective developer remaining amount detecting means are overlapped with each other, and there is used only the detected value by the developer remaining amount detecting means higher in a precision of detection immediately at a stage where the remaining amount of developer enters an overlapped region.

(3) The developer remaining amounts detectable by the respective developer remaining amount detecting means overlap each other, and values detected by the respective developer remaining amount detecting means are weighted, respectively, and the weighing against the detected value of the developer remaining amount detecting means that causes deterioration in the precision of detection as the developer is depleted is gradually reduced in accordance with the depletion of the developer when the remaining amount of developer is estimated, and the weighing against the detected value of the developer remaining amount detecting means that enhances the precision in detection as the developer is depleted is gradually increased in accordance with the depletion of the developer when the remaining amount of developer is estimated.

(4) The remaining amount of developer detectable by the respective developer remaining amount detecting means are not overlapped with each other, and in the regions where the remaining amount of developer cannot be detected which are not overlapped with each other, an average value of the ideal detected minimum value of the developer remaining amount detecting means is more in the detectable developer amount region and the ideal detected maximum value of the developer remaining amount detecting means is less in the detectable developer amount region, or its approximate value is indicated.

With the above structures, the following advantages are obtained.

(1) Because the detected value of the first developer remaining amount detecting means is shifted to the detected value of the second developer remaining amount detecting means in an optimum method in accordance with the relation of the detectable regions of the plurality of developer remaining amount detecting means and the detection error, an indication of the developer remaining amount more preferable to the user can be conducted.

(2) The developer can be used without adversely affecting an image, without troubling the user and without waste.

(3) Even in a developing device or a process cartridge with a long lifetime, with the simple structure, a state where the developer is full to an near-end state immediately before printing fails can be detected with accuracy and high precision, and the convenience in employing the apparatus by the user can be improved, and moreover the apparatus is inexpensive.

(4) Even in the case where the apparatus is used by a plurality of users or a large-scaled print job is conducted, the depleted state of the developer can be accurately monitored, the replacement timing of the developing device or the process cartridge can be accurately grasped, the convenience in employing the apparatus by the user can be improved, and the apparatus is inexpensive.

As was described above, according to the present invention, the amount of developer can be successively detected. Also, according to the present invention, the user can be preferably informed of the amount of developer.

While the invention has been described with reference to the structures disclosed herein, it is not confined to the details set forth and this application is intended to cover such modifications or changes as may come within the purposes of the improvements or the scope of the following claims.

What is claimed is:

1. A developing device, comprising:

a developer container which is mountable to an electrophotographic image forming apparatus main body, contains a developer for developing an electrostatic latent image formed on an electrophotographic photosensitive member, and includes a developer bearing member for carrying the developer to said electrophotographic photosensitive member; and a plurality of developer remaining amount detecting means for successively detecting a remaining amount of developer within said developer container, wherein regions detected by said plurality of developer remaining amount detecting means are overlapped with each other, and detected values by said plurality of developer remaining amount detecting means are weighted, respectively, and wherein an overlapped period is sectioned into a plurality of stages, and weighing is gradually shifted from a detected value of previous developer remaining amount detecting means to a detected value of succeeding developer remaining amount detecting means in each of the stages, and said apparatus main body detects the detected value to detect the remaining amount of developer.

2. A developing device, comprising:

a developer container which is mountable to an electrophotographic image forming apparatus main body, contains a developer for developing an electrostatic latent image formed on an electrophotographic photosensitive member, and includes a developer bearing member for carrying the developer to said electrophotographic photosensitive member; and a plurality of developer remaining amount detecting means for successively detecting a remaining amount of developer within said developer container, wherein regions detected by said plurality of developer remaining amount detecting means are not overlapped with each other, and in non-overlapped regions where the remaining amount of developer cannot be detected, an average value of an ideal detected minimum value of developer remaining amount detecting means more in a detectable developer amount region and an ideal detected maximum value of developer remaining amount detecting means less in a detectable developer amount region, or its approximate value is indicated.

3. A developing device as claimed in any one of claims 1 or 2, wherein at least one value of parameters detected by said plurality of developer remaining amount detecting means comprises a capacitance.

4. A developing device according to claim 3, wherein one of said plurality of developer remaining amount detecting means comprises:

(a) a measuring electrode member disposed at a portion of said developer container which is in contact with the developer and including at least one pair of input side and output side electrodes having portions arranged in parallel at a given interval; and (b) a reference electrode member disposed at a portion of said developer container which is out of contact with the developer and including at least one pair of input side and output side electrodes having portions arranged in parallel at a given interval.

5. A developing device according to claim 4, wherein said measuring electrode member and said reference electrode member are manufactured by forming an electrode pattern on a same surface of a same substrate.

6. A developing device according to claim 5, wherein values of capacitances produced when a voltage is applied to said measuring electrode member and said reference electrode member are the same.

7. A developing device according to claim 5, wherein opposed lengths and an interval of opposed portions of electrodes of said measuring electrode member and said reference electrode member which are arranged in parallel at the given interval are the same.

8. A developing device according to claim 3, wherein one of said plurality of developer remaining amount detecting means includes an electrically conductive plate electrode disposed outside of said developer container, and the remaining amount of developer is detected in accordance with a value of the capacitance between the electrically conductive plate electrode and said developer bearing member.

9. A developing device according to claim 4, wherein another one of said plurality of developer remaining amount detecting means comprises:

(a) a first electrode; and (b) a second electrode disposed opposite to said first electrode;

where said first electrode and said second electrode are disposed at a position where the developer removed from a surface of said developer bearing member by a developer layer thickness regulating member that regulates an amount of developer attracted onto the surface of said developer bearing member can enter a space between said first electrode and said second electrode.

10. A developing device according to claim 9, wherein said first and second electrodes are disposed along a longitudinal direction of a developing roller that functions as said developer bearing member.

11. A developing device according to claim 9, wherein said first electrode is disposed at a position farther from said developer bearing member than said second electrode.

12. A developing device according to claim 9, wherein the developer that has entered the space between said first electrode and said second electrode leaves from an entering direction.

13. A developing device according to claim 9, wherein the developer that has entered the space between said first electrode and said second electrode passes between said first electrode and said second electrode.

14. A developing device according to claim 9, wherein said first electrode and said second electrode are shaped in a plate, and an interval between said first electrode and said second electrode is widened on an entrance side of the developer.

15. A developing device according to claim 9, wherein said first electrode is shaped in a plate.

16. A developing device according to claim 9, wherein said second electrode is shaped in a plate.

17. A developing device according to claim 9, wherein said first electrode is shaped in a bar.

18. A developing device according to claim 9, wherein said second electrode is shaped in a bar.

19. A developing device according to claim 9, further comprising a third electrode for producing a capacitance between said third electrode and said developer bearing member when a voltage is applied from said electrophotographic image forming apparatus main body to said developer bearing member.

20. A developing device according to claim 19, wherein an electric signal corresponding to the capacitance between said developer bearing member and said third electrode is transmitted to said electrophotographic image forming apparatus main body when the voltage is applied to said developer bearing member.

21. A developing device according to claim 19, wherein said third electrode is integrated with said second electrode.

22. A developing device according to claim 21, wherein said third electrode is folded back with respect to said second electrode.

23. A developing device according to claim 19, wherein said third electrode is disposed opposite to said developer bearing member.

24. A developing device according to claim 19, wherein said third electrode is disposed closer to said developer bearing member than said first electrode and said second electrode.

25. A developing device according to claim 4, wherein another one of said plurality of developer remaining amount detecting means comprises:

an electrically conductive electrode bar disposed opposite to said developer bearing member.

26. A developing device according to claim 25, wherein said electrically conductive electrode bar is disposed along a longitudinal direction of a developing roller that functions as said developer bearing member.

27. A developing device as claimed in claims 1 or 2, wherein at least one value of parameters detected by said plurality of developer remaining amount detecting means comprises a light exposure integrating time when forming an electrostatic latent image on the electrophotographic photosensitive member.

28. A developing device as claimed in claims 1 or 2, wherein at least one value of parameters detected by said plurality of developer remaining amount detecting means comprises a force exerted on means for agitating and carrying the developer in said developer container.

29. A developing device as claimed in claims 1 or 2, wherein at least one value of parameters detected by said plurality of developer remaining amount detecting means comprises a magnetic permeability value of the developer in said developer container.

30. A developing device as claimed in claims 1 or 2, wherein at least one value of parameters detected by said plurality of developer remaining amount detecting means comprises a weight of said developer container.

31. A developing device as claimed in claims 1 or 2, wherein at least one value of parameters detected by said plurality of developer remaining amount detecting means comprises a height of an uppermost surface of the developer in said developer container.

32. A process cartridge detachably mountable on an electrophotographic image forming apparatus main body, comprising:

(a) an electrophotographic photosensitive member;

(b) a developing device having a developer container which contains a developer for developing an electrostatic latent image formed on an electrophotographic photosensitive member, and includes a developer bearing member for carrying the developer to said electrophotographic photosensitive member; and (c) a plurality of developer remaining amount detecting means for successively detecting a remaining amount of developer within said developer container, wherein regions detected by said plurality of developer remaining amount detecting means are overlapped with each other, and detected values by said plurality of developer remaining amount detecting means are weighted, respectively, and wherein an overlapped period is sectioned into a plurality of stages, and weighing is gradually shifted from a detected value of previous developer remaining amount detecting means to a detected value of succeeding developer remaining amount detecting means in each of the stages, and said apparatus main body detects the detected value to detect the remaining amount of developer.

33. A process cartridge detachably mountable on an electrophotographic image forming apparatus main body, comprising:

(a) an electrophotographic photosensitive member;

(b) a developing device having a developer container which contains a developer for developing an electrostatic latent image formed on an electrophotographic photosensitive member, and includes a developer bearing member for carrying the developer to said electrophotographic photosensitive member; and (c) a plurality of developer remaining amount detecting means for successively detecting a remaining amount of developer within said developer container, wherein regions detected by said plurality of developer remaining amount detecting means are not overlapped with each other, and in non-overlapped regions where the remaining amount of developer cannot be detected, an average value of an ideal detected minimum value of developer remaining amount detecting means more in a detectable developer amount region and an ideal detected maximum value of developer remaining amount detecting means less in a detectable developer amount region, or its approximate value is indicated.

34. A process cartridge as claimed in claims 32 or 33, wherein at least one value of parameters detected by said plurality of developer remaining amount detecting means comprises a capacitance.

35. A process cartridge according to claim 34, wherein one of said plurality of developer remaining amount detecting means comprises:

(a) a measuring electrode member disposed at a portion of said developer container which is in contact with the developer and including at least one pair of input side and output side electrodes having portions arranged in parallel at a given interval; and (b) a reference electrode member disposed at a portion of said developer container which is out of contact with the developer and including at least one pair of input side and output side electrodes having portions arranged in parallel at a given interval.

36. A process cartridge according to claim 35, wherein said measuring electrode member and said reference electrode member are manufactured by forming an electrode pattern on a same surface of a same substrate.

37. A process cartridge according to claim 36, wherein values of capacitances produced when a voltage is applied to said measuring electrode member and said reference electrode member are the same.

38. A process cartridge according to claim 36, wherein opposed lengths and an interval of opposed portions of electrodes of said measuring electrode member and said reference electrode member which are arranged in parallel at the given interval are the same.

39. A process cartridge according to claim 34, wherein one of said plurality of developer remaining amount detecting means includes an electrically conductive plate electrode disposed outside of said developer container, and the remaining amount of developer is detected in accordance with a value of capacitance between the electrically conductive plate electrode and said developer bearing member.

40. A process cartridge according to claim 35, wherein another one of said plurality of developer remaining amount detecting means comprises:

(a) a first electrode; and (b) a second electrode disposed opposite to said first electrode, wherein said first electrode and said second electrode are disposed at a position where the developer removed from a surface of said developer bearing member by a developer layer thickness regulating member that regulates an amount of developer attracted onto the surface of said developer bearing member can enter a space between said first electrode and said second electrode.

41. A process cartridge according to claim 40, wherein said first and second electrodes are disposed along a longitudinal direction of a developing roller that functions as said developer bearing member.

42. A process cartridge according to claim 40, wherein said first electrode is disposed at a position farther from said developer bearing member than said second electrode.

43. A process cartridge according to claim 40, wherein the developer that has entered the space between said first electrode and said second electrode leaves from an entering direction.

44. A process cartridge according to claim 40, wherein the developer that has entered the space between said first electrode and said second electrode passes between said first electrode and said second electrode.

45. A process cartridge according to claim 40, wherein said first electrode and said second electrode are shaped in a plate, and an interval between said first electrode and said second electrode is widened on an entrance side of the developer.

46. A process cartridge according to claim 40, wherein said first electrode is shaped in a plate.

47. A process cartridge according to claim 40, wherein said second electrode is shaped in a plate.

48. A process cartridge according to claim 40, wherein said first electrode is shaped in a bar.

49. A process cartridge according to claim 40, wherein said second electrode is shaped in a bar.

50. A process cartridge according to claim 40, further comprising a third electrode for producing a capacitance between said third electrode and said developer bearing member when a voltage is applied from said electrophotographic image forming apparatus main body to said developer bearing member.

51. A process cartridge according to claim 50, wherein an electric signal corresponding to the capacitance between said developer bearing member and said third electrode is transmitted to said electrophotographic image forming apparatus main body when the voltage is applied to said developer bearing member.

52. A process cartridge according to claim 50, wherein said third electrode is integrated with said second electrode.

53. A process cartridge according to claim 52, wherein said third electrode is folded back with respect to said second electrode.

54. A process cartridge according to claim 50, wherein said third electrode is disposed opposite to said developer bearing member.

55. A process cartridge according to claim 50, wherein said third electrode is disposed closer to said developer bearing member than said first electrode and said second electrode.

56. A process cartridge according to claim 35, wherein another one of said plurality of developer remaining amount detecting means comprises:

an electrically conductive electrode bar disposed opposite to said developer bearing member.

57. A process cartridge according to claim 56, wherein said electrically conductive electrode bar is disposed along a longitudinal direction of a developing roller that functions as said developer bearing member.

58. A process cartridge as claimed in claims 32 or 33, wherein at least one value of parameters detected by said plurality of developer remaining amount detecting means comprises a light exposure integrating time when forming an electrostatic latent image on the electrophotographic photosensitive member.

59. A process cartridge as claimed in claims 32 or 33, wherein at least one value of parameters detected by said plurality of developer remaining amount detecting means comprises a force exerted on means for agitating and carrying the developer in said developer container.

60. A process cartridge as claimed in claims 32 or 33, wherein at least one value of parameters detected by said plurality of developer remaining amount detecting means comprises a magnetic permeability value of the developer in said developer container.

61. A process cartridge as claimed in claims 32 or 33, wherein at least one value of parameters detected by said plurality of developer remaining amount detecting means comprises a weight of said developer container.

62. A process cartridge as claimed in claims 32 or 33, wherein at least one value of parameters detected by said plurality of developer remaining amount detecting means comprises a height of an uppermost surface of the developer in said developer container.

63. An electrophotographic image forming apparatus for forming an image on a recording medium, comprising:

(a) an electrophotographic photosensitive member;

(b) electrostatic latent image forming means for forming an electrostatic latent image on said electrophotographic photosensitive member;

(c) a developing device having a developer container which contains a developer for developing the electrostatic latent image formed on said electrophotographic photosensitive member, and includes a developer bearing member for carrying the developer to said electrophotographic photosensitive member; and (d) a plurality of developer remaining amount detecting means for successively detecting a remaining amount of developer within said developer container, wherein regions detected by said plurality of developer remaining amount detecting means are overlapped with each other, and detected values by said plurality of developer remaining amount detecting means are weighted, respectively, and wherein an overlapped period is sectioned into a plurality of stages, and weighing is gradually shifted from a detected value of previous developer remaining amount detecting means to a detected value of succeeding developer remaining amount detecting means in each of the stages.

64. An electrophotographic image forming apparatus for forming an image on a recording medium, comprising:

(a) an electrophotographic photosensitive member;

(b) electrostatic latent image forming means for forming an electrostatic latent image on said electrophotographic photosensitive member;

(c) a developing device having a developer container which contains a developer for developing the electrostatic latent image formed on said electrophotographic photosensitive member, and includes a developer bearing member for carrying the developer to said electrophotographic photosensitive member; and (d) a plurality of developer remaining amount detecting means for successively detecting a remaining amount of developer within said developer container, wherein regions detected by said plurality of developer remaining amount detecting means are not overlapped with each other, and in non-overlapped regions where the remaining amount of developer cannot be detected, an average value of an ideal detected minimum value of developer remaining amount detecting means more in a detectable developer amount region and an ideal detected maximum value of developer remaining amount detecting means less in a detectable developer amount region, or its approximate value is indicated.

65. An electrophotographic image forming apparatus onto which a process cartridge is detachably mountable for forming an image on a recording medium, comprising:

(a) mounting means for detachably mounting the process cartridge, said process cartridge having an electrophotographic photosensitive member, and a developing device having a developer container which contains a developer for developing an electrostatic latent image formed on said electrophotographic photosensitive member, and includes a developer bearing member for carrying the developer to said electrophotographic photosensitive member; and (b) a plurality of developer remaining amount detecting means for successively detecting a remaining amount of developer within said developer container, wherein regions detected by said plurality of developer remaining amount detecting means are not overlapped with each other, and in non-overlapped regions where the remaining amount of developer cannot be detected, an average value of an ideal detected minimum value of developer remaining amount detecting means more in a detectable developer amount region and an ideal detected maximum value of developer remaining amount detecting means less in a detectable developer amount region, or its approximate value is indicated.

66. An electrophotographic image forming apparatus as claimed in claims 63, 64 or 65, wherein at least one value of parameters detected by said plurality of developer remaining amount detecting means comprises a capacitance.

67. An electrophotographic image forming apparatus according to claim 66, wherein one of said plurality of developer remaining amount detecting means comprises:

(a) a measuring electrode member disposed at a portion of said developer container which is in contact with the developer and including at least one pair of input side and output side electrodes having portions arranged in parallel at a given interval; and (b) a reference electrode member disposed at a portion of said developer container which is out of contact with the developer and including at least one pair of input side and output side electrodes having portions arranged in parallel at a given interval.

68. An electrophotographic image forming apparatus according to claim 67, wherein said measuring electrode member and said reference electrode member are manufactured by forming an electrode pattern on a same surface of a same substrate.

69. An electrophotographic image forming apparatus according to claim 68, wherein values of capacitances produced when a voltage is applied to said measuring electrode member and said reference electrode member are the same.

70. An electrophotographic image forming apparatus according to claim 68, wherein opposed lengths and an interval of opposed portions of electrodes of said measuring electrode member and said reference electrode member which are arranged in parallel at the given interval are the same.

71. An electrophotographic image forming apparatus according to claim 66, wherein one of said plurality of developer remaining amount detecting means includes an electrically conductive plate electrode disposed outside of said developer container, and the remaining amount of developer is detected in accordance with a value of capacitance between the electrically conductive plate electrode and said developer bearing member.

72. An electrophotographic image forming apparatus according to claim 67, wherein another one of said plurality of developer remaining amount detecting means comprises:

(a) a first electrode; and (b) a second electrode disposed opposite to said first electrode, wherein said first electrode and said second electrode are disposed at a position where the developer removed from a surface of said developer bearing member by a developer layer thickness regulating member that regulates an amount of developer attracted onto a surface of said developer bearing member can enter a space between said first electrode and said second electrode.

73. An electrophotographic image forming apparatus according to claim 72, wherein said first and second electrodes are disposed along a longitudinal direction of a developing roller that functions as said developer bearing member.

74. An electrophotographic image forming apparatus according to claim 72, wherein said first electrode is disposed at a position farther from said developer bearing member than said second electrode.

75. An electrophotographic image forming apparatus according to claim 72, wherein the developer that has entered the space between said first electrode and said second electrode leaves from an entering direction.

76. An electrophotographic image forming apparatus according to claim 72, wherein the developer that has entered the space between said first electrode and said second electrode passes between said first electrode and said second electrode.

77. An electrophotographic image forming apparatus according to claim 72, wherein said first electrode and said second electrode are shaped in a plate, and an interval between said first electrode and said second electrode is widened on an entrance side of the developer.

78. An electrophotographic image forming apparatus according to claim 72, wherein said first electrode is shaped in a plate.

79. An electrophotographic image forming apparatus according to claim 72, wherein said second electrode is shaped in a plate.

80. An electrophotographic image forming apparatus according to claim 72, wherein said first electrode is shaped in a bar.

81. An electrophotographic image forming apparatus according to claim 72, wherein said second electrode is shaped in a bar.

82. An electrophotographic image forming apparatus according to claim 72, further comprising a third electrode for producing a capacitance between said third electrode and said developer bearing member when a voltage is applied from said electrophotographic image forming apparatus main body to said developer bearing member.

83. An electrophotographic image forming apparatus according to claim 82, wherein an electric signal corresponding to the capacitance between said developer bearing member and said third electrode is transmitted to said electrophotographic image forming apparatus main body when the voltage is applied to said developer bearing member.

84. An electrophotographic image forming apparatus according to claim 82, wherein said third electrode is integrated with said second electrode.

85. An electrophotographic image forming apparatus according to claim 84, wherein said third electrode is folded back with respect to said second electrode.

86. An electrophotographic image forming apparatus according to claim 82, wherein said third electrode is disposed opposite to said developer bearing member.

87. An electrophotographic image forming apparatus according to claim 82, wherein said third electrode is disposed closer to said developer bearing member than said first electrode and said second electrode.

88. An electrophotographic image forming apparatus according to claim 67, wherein another one of said plurality of developer remaining amount detecting means comprises:

an electrically conductive electrode bar disposed opposite to said developer bearing member.

89. An electrophotographic image forming apparatus according to claim 88, wherein said electrically conductive electrode bar is disposed along a longitudinal direction of a developing roller that functions as said developer bearing member.

90. An electrophotographic image forming apparatus as claimed in claims 63, 64 or 65, wherein at least one value of parameters detected by said plurality of developer remaining amount detecting means comprises a light exposure integrating time when forming an electrostatic latent image on the electrophotographic photosensitive member.

91. An electrophotographic image forming apparatus as claimed in claims 63, 64 or 65, wherein at least one value of parameters detected by said plurality of developer remaining amount detecting means comprises a force exerted on means for agitating and carrying the developer in said developer container.

92. An electrophotographic image forming apparatus as claimed in claims 63, 64 or 65, wherein at least one value of parameters detected by said plurality of developer remaining amount detecting means comprises a magnetic permeability value of the developer in said developer container.

93. An electrophotographic image forming apparatus as claimed in claims 63, 64 or 65, wherein at least one value of parameters detected by said plurality of developer remaining amount detecting means comprises a weight of said developer container.

94. An electrophotographic image forming apparatus as claimed in claims 63, 64 or 65, wherein at least one value of parameters detected by said plurality of developer remaining amount detecting means comprises a height of the uppermost surface of the developer in said developer container.

95. A developer amount detecting method for detecting an amount of developer for developing an electrostatic latent image formed on an electrophotographic photosensitive member, said method comprising:

when detecting the amount of developer by using a plurality of developer remaining amount detecting means, overlapping regions detected by said plurality of developer remaining amount detecting means with each other; and changing over a detected value by a previous developer remaining amount detecting means to a detected value by a succeeding developer remaining amount detecting means in an overlapped region.

* * * * *

UNITED STATES PATENT AND TRADEMARK OFFICE

CERTIFICATE OF CORRECTION

PATENT NO. : 6,397,018 B1
DATED : May 28, 2002
INVENTOR(S) : Hideki Matsumoto et al.

It is certified that error appears in the above-identified patent and that said Letters Patent is hereby corrected as shown below:

Title page,
Item [56], References Cited,
U.S. PATENT DOCUMENTS, "5,890,036 A 3/1999 Karakuma et al." should read
-- 5,890,036 A 3/1999 Karakama et al. --.

Column 2,
Line 48, "scrapped" should read -- scraped --.
Line 57, "develop" should read -- developer --.

Column 3,
Line 20, "of a" should read -- of an --.
Line 28, "amount" should read -- amount of --.

Column 5,
Line 35, "which is immediately before" should read -- immediately before --.

Column 7,
Line 37, "an 34C" should read -- and 34C --.
Line 46, "FIG. 37A, 37B, 37C, 37D and 37E" should read -- FIGS. 37A to 37E --.

Column 9,
Line 37, "an developer" should read -- a developer --.
Line 42, "triboelectrication" should read -- triboelectrification --.

Column 10,
Line 8, "pa th" should read -- path --.
Line 7, "not" should read -- but not --.
Line 9, "convey ing" should read -- conveying --.
Line 27, "ho ds" should read -- holds --.

Column 11,
Line 50, "the-same" should read -- the same --.

Column 14,
Line 17, "circumstance as in" should read -- circumstance in --.
Line 19, "being" should be deleted.
Line 20, "capable of" should be deleted.
Line 47, "the opposed" should read -- opposed --.

UNITED STATES PATENT AND TRADEMARK OFFICE

CERTIFICATE OF CORRECTION

PATENT NO. : 6,397,018 B1
DATED : May 28, 2002
INVENTOR(S) : Hideki Matsumoto et al.

It is certified that error appears in the above-identified patent and that said Letters Patent is hereby corrected as shown below:

Column 16,
Lines 8 and 13, “scrapped” should read -- scraped --.
Line 20, “9H,” should read -- 9A, --.
Line 21, “scrapped-off” should read -- scraped-off --.

Column 17,
Line 44, “scrapped” should read -- scraped --.

Column 18,
Lines 11 and 43, “scrapped” should read -- scraped --.
Line 33, “and,” should read -- and --.

Column 20,
Line 28, “current $I_1$’” should read -- current $I_1$’, --.
Line 33, “current $I_2$” should read -- current $I_2$, --.
Line 34, “80” should read -- 80, --.

Column 23,
Line 33, “means” should read -- means. ¶Third Embodiment --.
Line 44, “FIGS. 37A, 37B, 37C, 37D and 37E,” should read -- FIGS. 37A to 37E, --.

Column 24,
Line 37, “b 9.2),” should read -- b = 0.2), --.
Line 46, “estimate” should read -- estimate = --.
Line 57, “A1” should read -- A1 --.

Column 25,
Line 10, “o” should be deleted.
Line 11, “f” should read -- of --.
Line 14, “detectin g” should read -- detecting --.
Line 47, “become” should read -- becomes --
Line 61, “with” should be deleted.

Column 28,
Line 5, “are” should read -- is --.
Line 22, “A1 and A2” should read -- , A1 and A2 --.

Column 29,
Line 11, “(a 0.4,” should read -- (a = 0.4, --.
Line 12, “amount” should read -- amount = --.

UNITED STATES PATENT AND TRADEMARK OFFICE

CERTIFICATE OF CORRECTION

PATENT NO. : 6,397,018 B1
DATED : May 28, 2002
INVENTOR(S) : Hideki Matsumoto et al.

It is certified that error appears in the above-identified patent and that said Letters Patent is hereby corrected as shown below:

Column 30,
Line 51, “th is” should read -- this --.
Line 56, “develop ing” should read -- developing --.
Line 57, “pla stic” should read -- plastic, --.

Column 31,
Line 52, “in” (first occurrence) should be deleted.

Column 32,
Lines 43-57 (indent body of paragraph).
Lines 58 and 61, “amount” should read -- amounts --.

Column 33,
Line 17, “to an” should read -- to a --.

Signed and Sealed this

Twenty-second Day of April, 2003

JAMES E. ROGAN
*Director of the United States Patent and Trademark Office*